US007121235B2

(12) United States Patent
Schmied

(10) Patent No.: US 7,121,235 B2
(45) Date of Patent: Oct. 17, 2006

(54) RECIPROCATING INTERNAL COMBUSTION ENGINE

(76) Inventor: Walter Schmied, Route 1, Box 459, Bonners Ferry, ID (US) 83805

( * ) Notice: Subject to any disclaimer, the term of this patent is extended or adjusted under 35 U.S.C. 154(b) by 0 days.

(21) Appl. No.: 10/627,288

(22) Filed: Jul. 25, 2003

(65) Prior Publication Data

US 2004/0159291 A1 Aug. 19, 2004

Related U.S. Application Data

(63) Continuation-in-part of application No. 10/147,372, filed on May 15, 2002, now Pat. No. 6,598,567, which is a continuation-in-part of application No. 10/136,780, filed on May 1, 2002, now abandoned, which is a continuation-in-part of application No. 09/819,938, filed on Mar. 27, 2001, now abandoned, which is a continuation of application No. 09/520,265, filed on Mar. 7, 2000, now abandoned, which is a continuation of application No. 08/926,088, filed on Sep. 2, 1997, now Pat. No. 6,032,622.

(51) Int. Cl.
*F02B 59/00* (2006.01)

(52) U.S. Cl. ..... 123/42; 123/568.11; 123/48 R

(58) Field of Classification Search ..... 123/42, 123/48 B, 48 D, 78 B, 78 BA, 78 D, 568.11–56, 123/43 R
See application file for complete search history.

(56) References Cited

U.S. PATENT DOCUMENTS 1,019,856 A 3/1912 Strickland
2,455,245 A 11/1948 Francis
3,285,503 A 11/1966 Bancroft
3,931,809 A 1/1976 Corte et al.
4,058,088 A 11/1977 Brown
4,331,108 A 5/1982 Collins
4,838,214 A 6/1989 Barrett
5,103,775 A 4/1992 Hue
5,456,219 A 10/1995 Clarke
5,526,778 A 6/1996 Springer
5,626,106 A * 5/1997 Erickson et al. ..... 123/42
5,647,307 A 7/1997 Clarke et al.
6,032,622 A * 3/2000 Schmied ..... 123/42
6,314,923 B1 * 11/2001 Tompkins ..... 123/42
6,598,567 B1 * 7/2003 Schmied ..... 123/42

FOREIGN PATENT DOCUMENTS

GB 413960 7/1934
GB 678361 9/1952

* cited by examiner

*Primary Examiner*—Marguerite McMahon
(74) *Attorney, Agent, or Firm*—Christensen O'Connor Johnson Kindness PLLC

(57) ABSTRACT

An internal combustion engine (1010 or 2000) is provided. The internal combustion engine includes a housing (1013 or 1068) and a piston assembly (6, 1012, and 2038) disposed in the housing. The piston assembly is substantially stationary relative to the housing. A cylinder (1, 1014, and 2040) is movably disposed within the housing. A combustion chamber (20, 1033, and 2064) is disposed between the piston assembly and the cylinder.

38 Claims, 48 Drawing Sheets

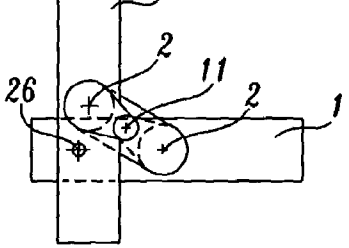
Fig.16A.
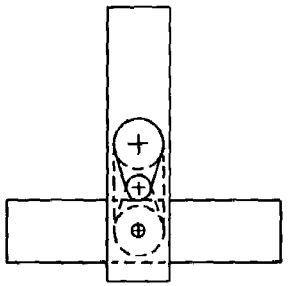
Fig.16C.
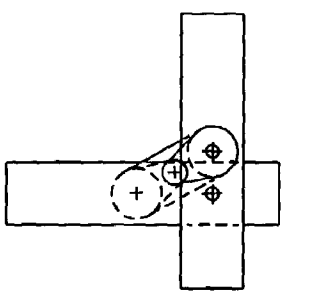
Fig.16E.
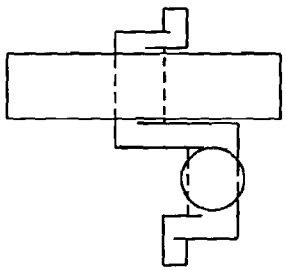
Fig.16G.
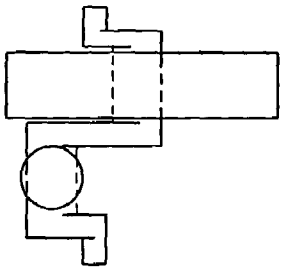
Fig.16B.
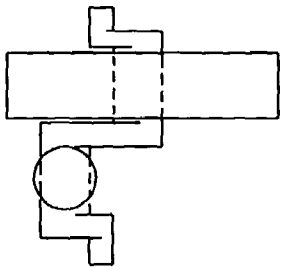
Fig.16D.
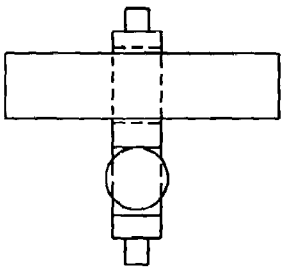
Fig.16F.
Fig.16H.

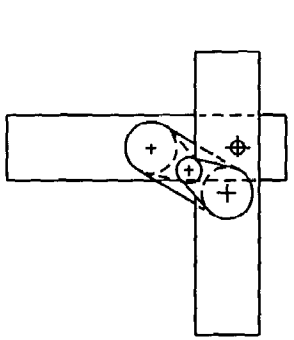
Fig.17A.
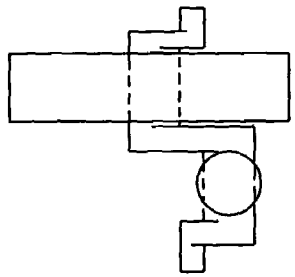
Fig.17B.
Fig.17C.
Fig.17D.
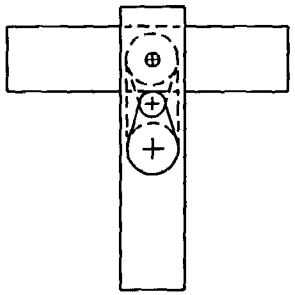
Fig.17E.
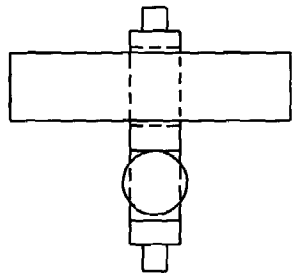
Fig.17F.
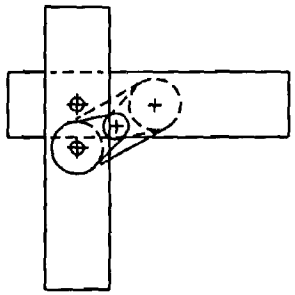
Fig.17G.
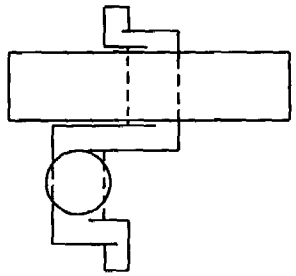
Fig.17H.

RECIPROCATING INTERNAL COMBUSTION ENGINE

CROSS-REFERENCES TO RELATED APPLICATIONS

This application is a continuation-in-part of U.S. patent application Ser. No. 10/147,372, filed May 15, 2002, now U.S. Pat. No. 6,598,567, which is a continuation-in-part of U.S. patent application Ser. No. 10/136,780, filed May 1, 2002, now abandoned, which is a continuation-in-part of U.S. patent application Ser. No. 09/819,938, filed Mar. 27, 2001, now abandoned, which is a continuation of U.S. patent application Ser. No. 09/520,265, filed Mar. 7, 2000, now abandoned, which is a continuation of (SMWI-1-12957) U.S. patent application Ser. No. 08/926,088, filed Sep. 2, 1997, now U.S. Pat. No. 6,032,622, issued Mar. 7, 2000, priority from the filing date of which is hereby claimed under 35 U.S.C. § 120 and the disclosures of which are all hereby expressly incorporated by reference.

FIELD OF THE INVENTION

The present invention is directed generally to internal combustion engines and, more particularly, to reciprocating internal combustion engines having substantially stationary pistons.

BACKGROUND OF THE INVENTION

As is well known in the art, an internal combustion engine is a machine for converting heat energy into mechanical work. In an internal combustion engine, a fuel-air mixture that has been introduced into a combustion chamber is compressed as a piston slides within the chamber. A high voltage for ignition is applied to a spark plug installed in the combustion chamber to generate an electric spark to ignite the fuel-air mixture. The resulting combustion pushes the piston downwardly within the chamber, thereby producing a force that is convertible to a rotary output.

Such internal combustion engines have a variety of problems. First, because of the multitude of moving parts, such engines are costly to assemble. Further, because of the moving parts, such engines are subjected to a shortened useful life due to frictional wear between the moving parts. Further still, because of the multiple parts, such engines are heavy. Further yet, previously developed internal combustion engines do not sufficiently harness all available energy contained in exhaust gases prior to discharge of the exhaust gases to the environment, thereby decreasing efficiency. Additionally, previously developed engines base the opening of a waste gate valve on back pressure alone, and not upon a power setting of the engine or the RPM of the engine, thereby decreasing the effectiveness of the waste gate valve. Further still, previously developed internal combustion engines do not direct injected fuel upon the exhaust valves, thereby leading to premature failure of the exhaust valve and/or increased cost expended in designing and cooling the exhaust valve. In addition, previously developed internal combustion engines do not permit the locating of a spark plug or injector in the pistons of the engine, thereby limiting the placement of these devices to potentially less desirable locations.

Thus, there exists a need for an internal combustion engine that not only produces a high power-to-weight ratio, but is also economical to manufacture, has a high degree of reliability, has fewer moving parts than the reciprocating engines currently available, and is efficient.

SUMMARY OF THE INVENTION

One embodiment of an internal combustion engine formed in accordance with the present invention is provided. The internal combustion engine includes a housing and a piston assembly disposed in the housing, wherein the piston assembly is substantially stationary relative to the housing. The internal combustion engine also includes a cylinder movably disposed within the housing and a combustion chamber disposed between the piston assembly and the cylinder.

Another embodiment of an internal combustion engine formed in accordance with the present invention is provided. The internal combustion engine includes a piston assembly disposed in the housing and a cylinder movably disposed within the housing. The internal combustion engine further includes an exhaust gas recovery chamber disposed between the cylinder and the housing, the exhaust gas recovery chamber adapted to receive exhaust gases produced in the internal combustion engine to aid in moving the cylinder.

Yet another embodiment of an internal combustion engine formed in accordance with the present invention is provided. The internal combustion engine includes a housing and a piston assembly disposed in the housing. The internal combustion engine further includes a cylinder movingly disposed within the housing and a waste gate valve in fluid communication with the cylinder. The waste gate valve is moveable to a release position in which exhaust gases produced in the cylinder are directed to be prematurely released from the internal combustion engine and a closed position in which the exhaust gases are impeded from being prematurely released from the internal combustion engine.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein:

FIG. 16 illustrates the cylinder motion for an internal combustion engine formed in accordance with the present invention;

FIG. 17 illustrates the motion of the cylinder assembly for an internal combustion engine formed in accordance with the present invention;

DETAILED DESCRIPTION OF THE PREFERRED EMBODIMENT

An internal combustion cylinder engine formed in accordance with the present invention suitably operates on the two cycle principle. The engine of the present invention is distinguished from those currently available through the use of one double cylinder 1 for each double cylinder housing 9. Through the center of the double cylinder 1 is cylinder journal pin 2. The cylinder journal pin 2 is suitably disposed therein on bearings (roller- or other) 10. The cylinder journal pin 2 is turnable. A connecting rod does not exist.

Figure 11:
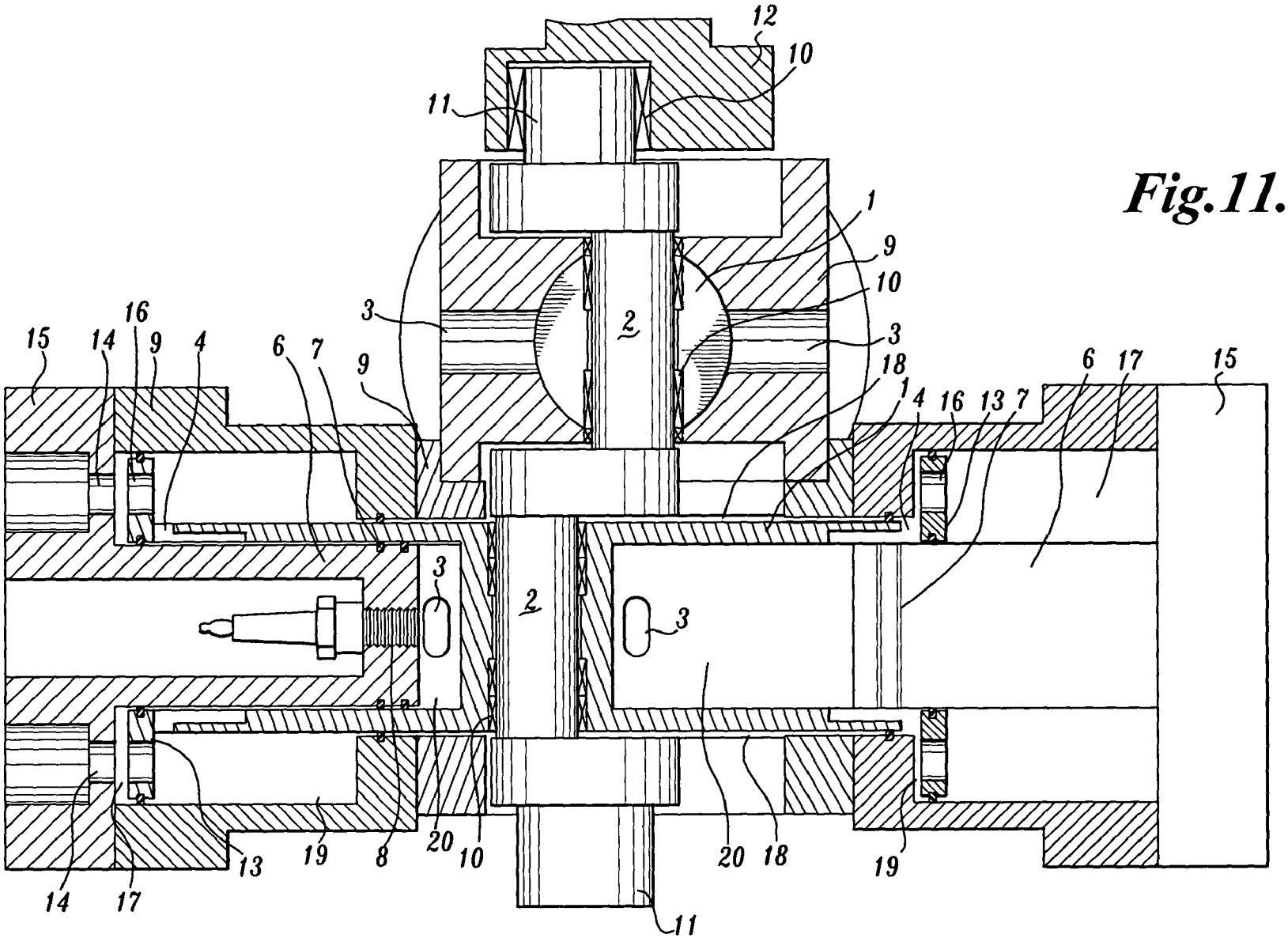
FIG. 11 is a cross-sectional view of an internal combustion engine formed in accordance with the present invention showing the major components of the engine.

Exhaust 3 and intake ports 4 are located on the opposite ends of the cylinder bore. As seen in FIG. 11, the exhaust and intake ports 3 and 4 are vertically spaced. This is different to the diametrical opposed intake and exhaust ports of known two cycle engines.

The intake ports 4 can be placed around the whole circumference of the cylinder. The exhaust ports 3 may be located on both sides of the diameter of the cylinder.

Figure 5:
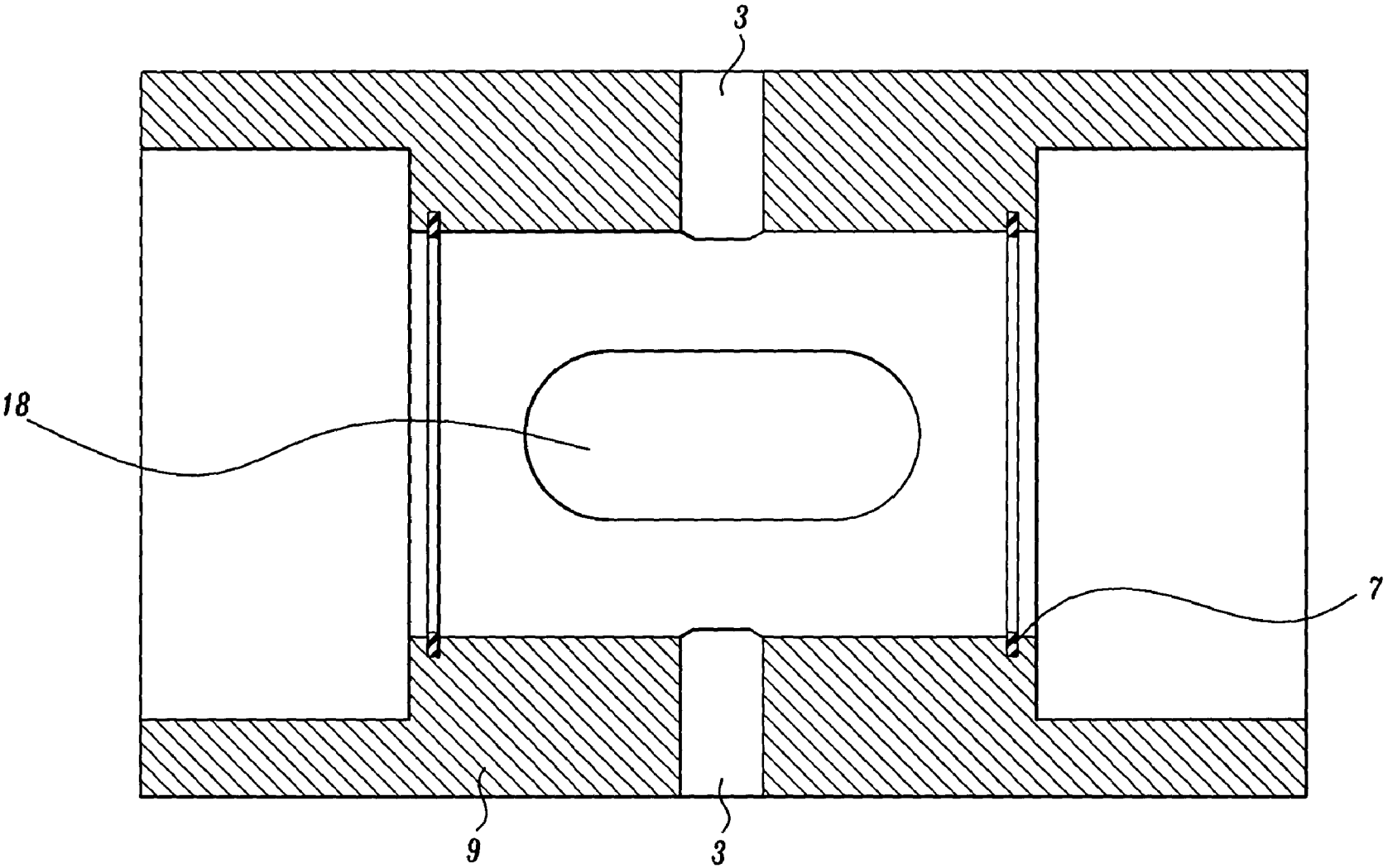
FIG. 5 is a cross-sectional view of an internal combustion engine formed in accordance with the present invention showing the cylinder journal pin slots, exhaust ports, housing and cylinder rings.
Figure 8C:
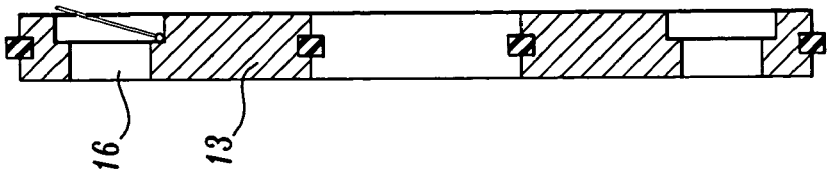
FIG. 8C is a cross-sectional end view of a precompression plate for an internal combustion engine formed in accordance with the present invention.
Figure 8B:
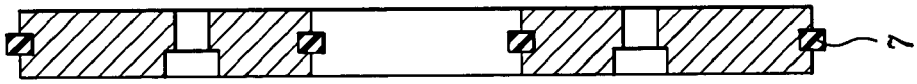
FIG. 8B is a cross-sectional end view of a precompression plate for an internal combustion engine formed in accordance with the present invention.
Figure 8A:
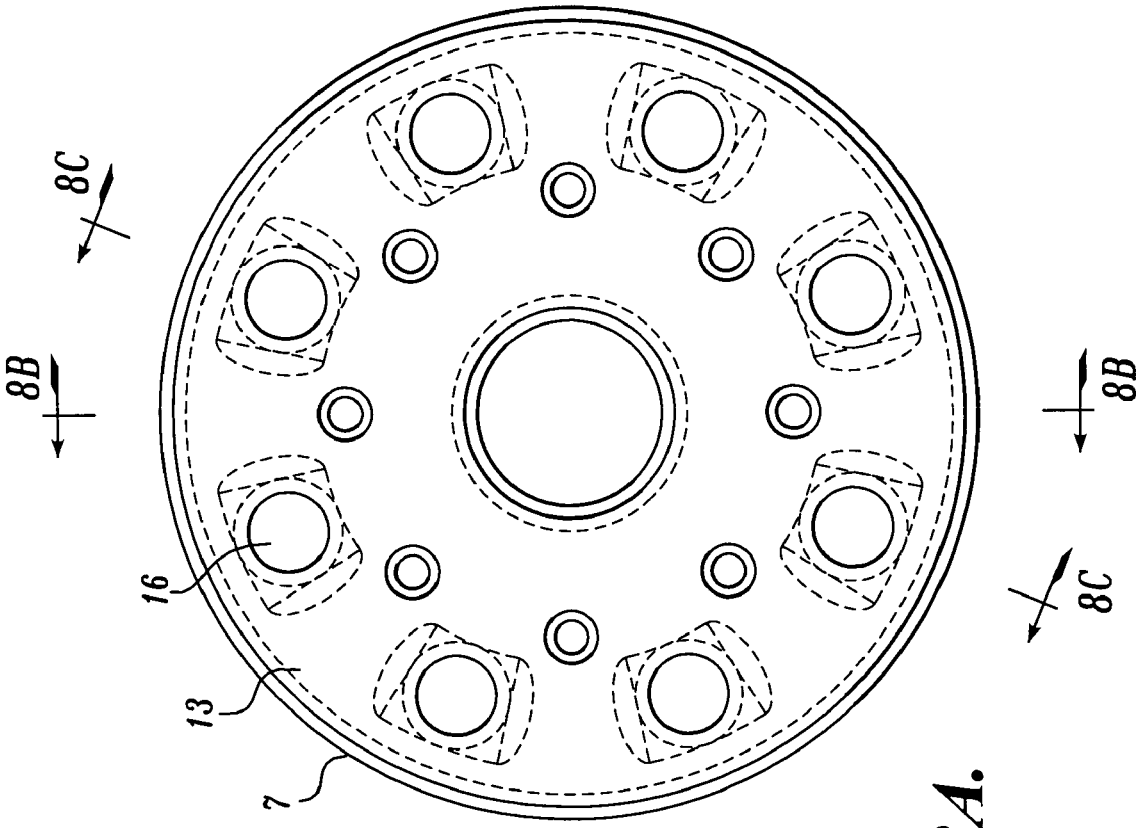
FIG. 8A is a top view of a precompression plate for an internal combustion engine formed in accordance with the present invention.
Figure 9:
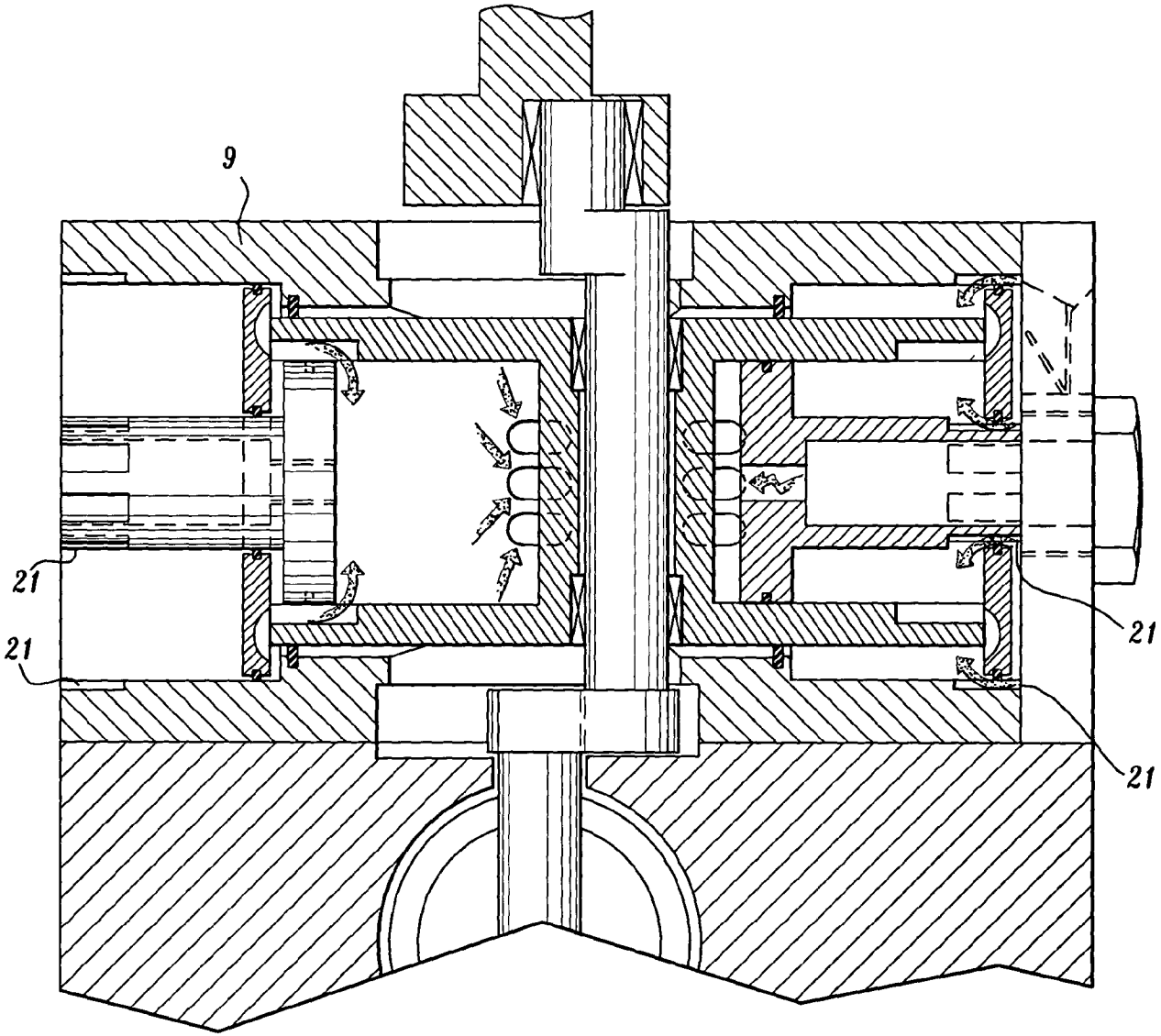
FIG. 9 is a cross-sectional side view of an internal combustion engine formed in accordance with the present invention showing the entrance of a fuel-air mixture into the combustion chamber and exhaustion of exhaust gases through the exhaust ports.
Figure 10:
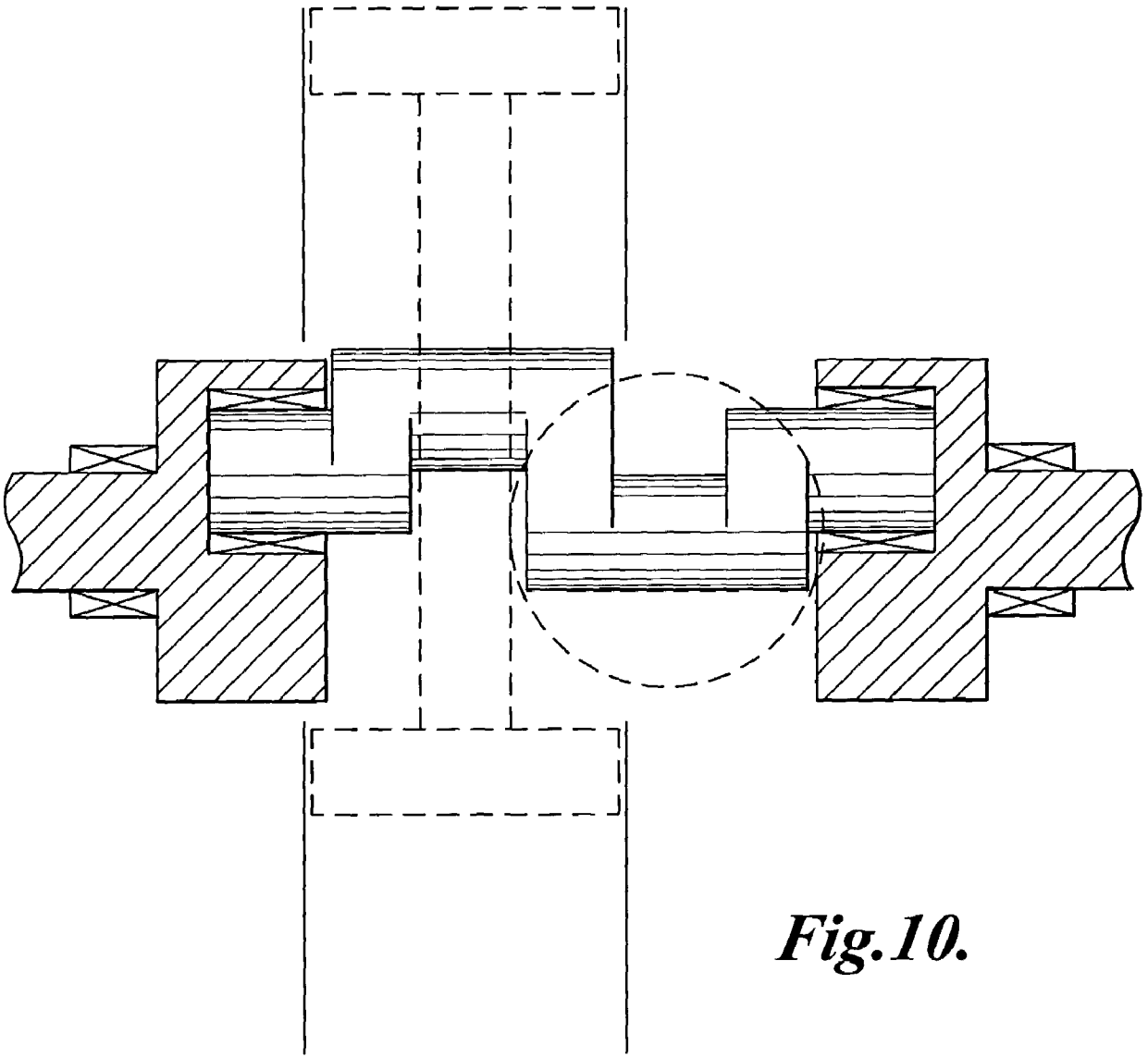
FIG. 10 is a cross-sectional side view of an internal combustion engine formed in accordance with the present invention showing a power take off shaft attached to the ends of the reciprocating and rotating mechanism.

Referring to FIGS. 5 and 8 exhaust ports 3 are located on both sides of the cylinder housing 9. The exhaust ports are centrally located and are alternately shared with the exhaust ports 3 of both the double cylinders when the cylinders are in the bottom dead end position.

The engine also includes pistons 6. The pistons 6 are stationary and are not a moving part of the engine. The pistons 6 can be adjusted for different compression ratios.

The pistons 6 contain a spark plug or injector hole 8 and piston rings 7. The injection hole 8 is suitable for an alternate embodiment of the engine, such as a diesel engine.

Figure 6:
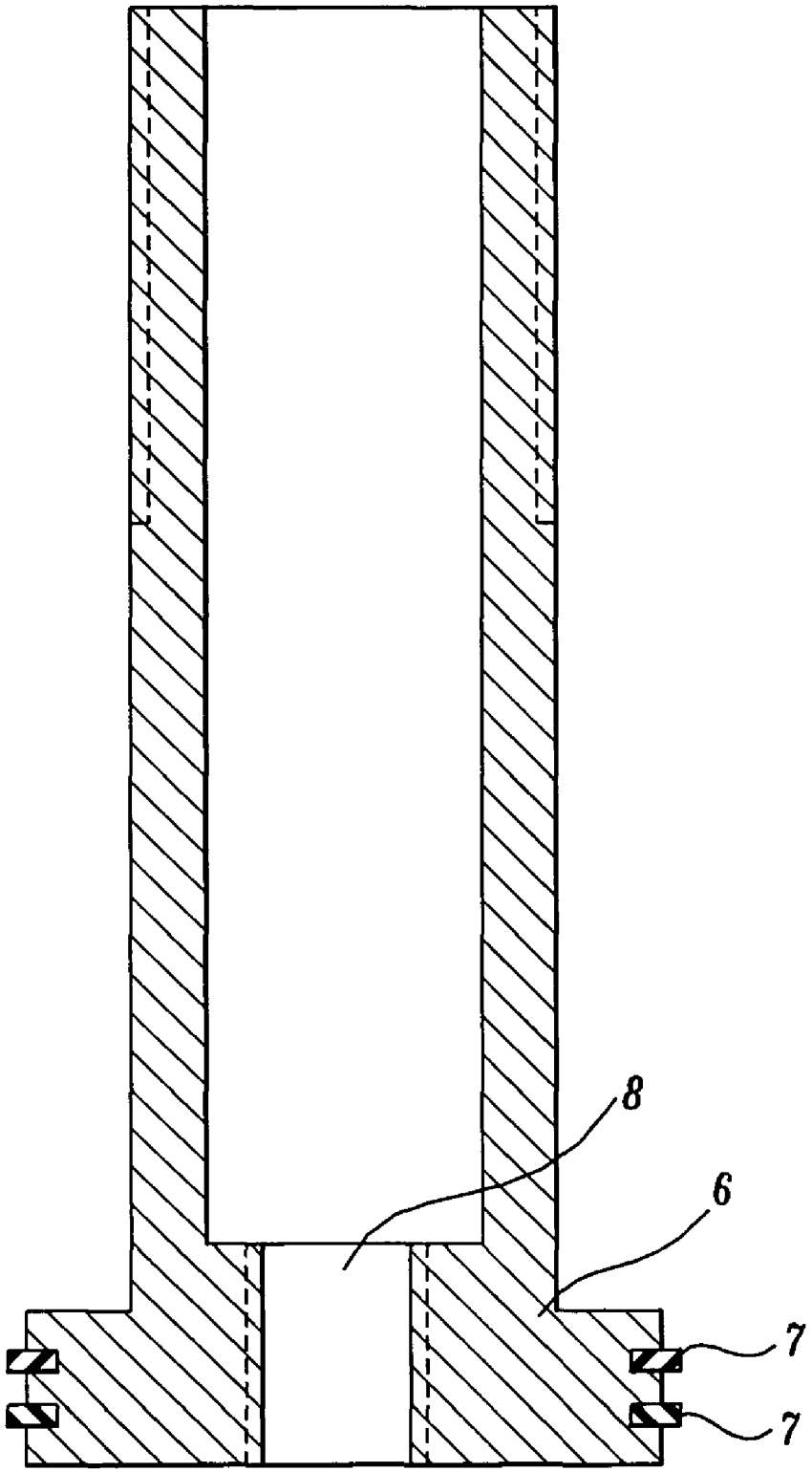
FIG. 6 is a cross-sectional view of a piston for an internal combustion engine formed in accordance with the present invention showing the piston rings and the spark plug or injector hole.
Figure 7:
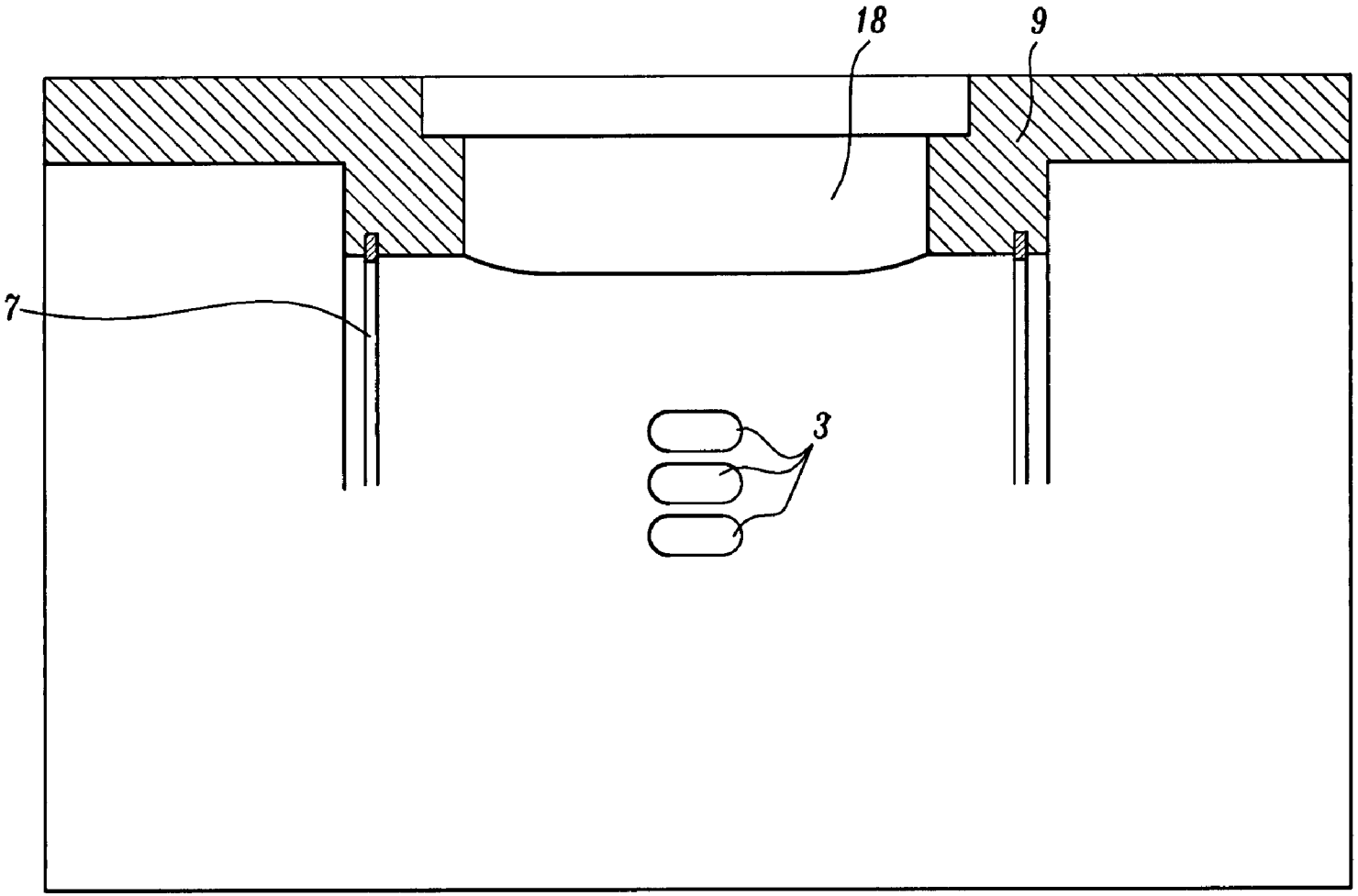
FIG. 7 is a cross-sectional view of an internal combustion engine formed in accordance with the present invention showing the housing, exhaust ports and the cylinder rings.

Referring now to FIG. 6, an end of the pistons 6 includes at least one piston ring 7. The diameter of this end of the piston 6 is substantially equal to the diameter of the cylinder. The rest of its length can favorably have a smaller diameter. The center of the pistons 6 are partly hollow to give access to the spark plug or injector hole 8.

The open end of the double cylinders 8 includes an annular precompression plate 13 attached thereto. The precompression plate 13 and the piston rings 7 engage the walls of the cylinders to define a seal therebetween. Each precompression plate 13 is fastened together to its cylinder and glides over the piston 6 between top dead center and bottom dead center.

The precompression plates 13 are mainly responsible for the different steps of the intake cycle.

Referring now to FIG. 11, the double cylinder housing 9 includes an intake chamber 17. The intake chamber 17 is closed off by a cylinder housing plate 15. The cylinder housing plate 15 holds a primary reed valve assembly 14 and the piston 6.

Each double cylinder housing 9 has a slot 18 located on each side of the cylinder. Each slot 18 is in the center along the line of the cylinder bore. The slots 18 are fashioned in a way, such that the cylinder journal pins 2, extending through the double cylinder housing 9, glide freely throughout its stroke length.

Figure 1B:
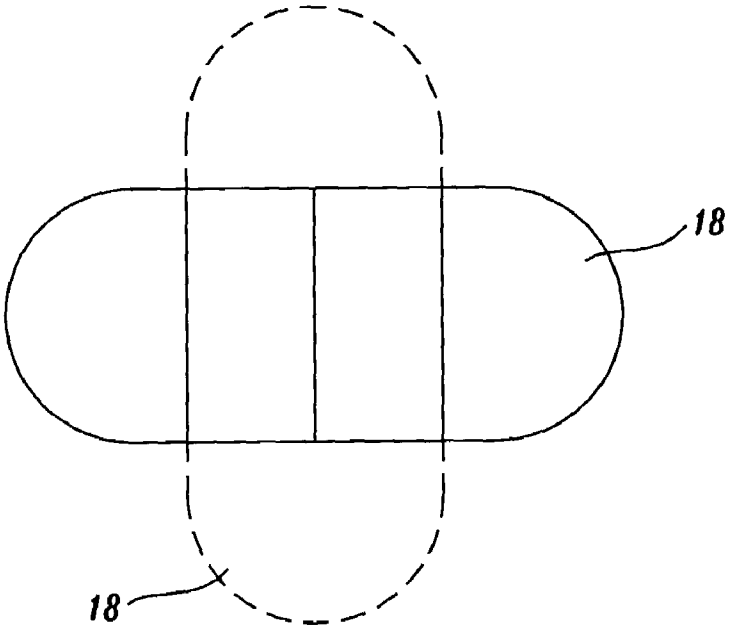
FIG. 1B illustrates the motion and common center point of an internal combustion engine formed in accordance with the present invention.
Figure 1A:
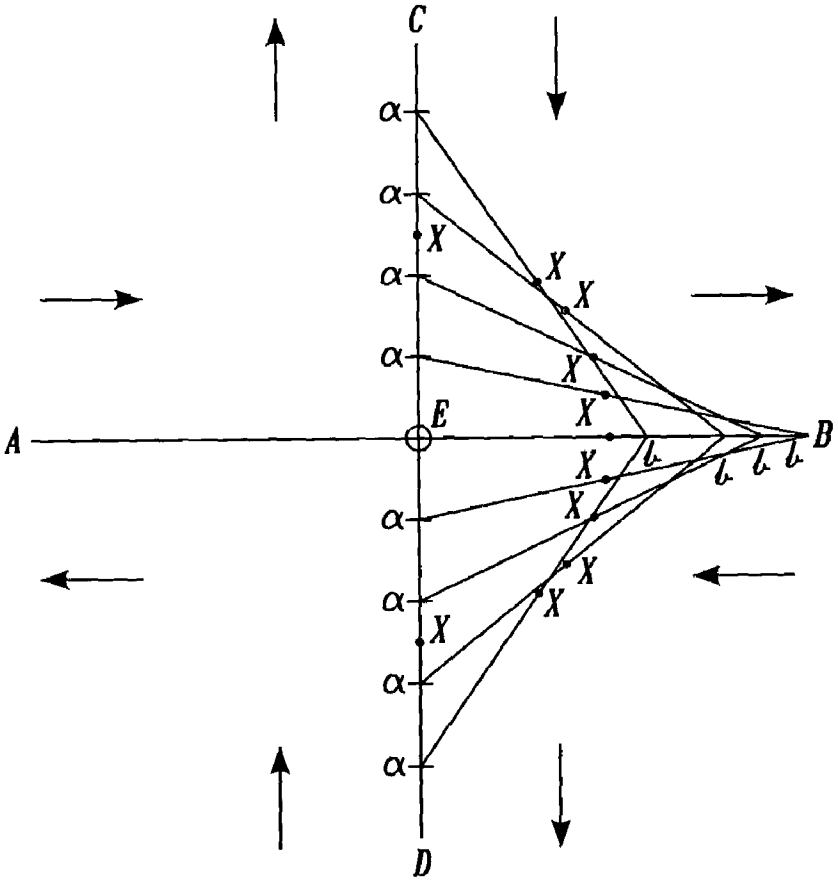
FIG. 1A is a diagrammatic view showing the linear and rotary displacement of an internal combustion engine formed in accordance with the present invention.

Still referring to FIG. 11, two double cylinder housings 9 are connected together at a ninety degree angle. The pair of double cylinder housings 9 are positioned such that the slots 18 face each other in the same angle and have the same centerpoint, as seen in FIG. 1.

Referring back to FIGS. 11 and 12, the two cylinder journal pins 2 are eccentrically connected to each other in a crankshaft type way, such that their centerlines are one-half stroke distance apart. On both ends of the cylinder journal pin 2 is a power takeoff shaft 12 connected to the pin 2 by a power takeoff ("PTO") journal 11. The center of the PTO journal 11 is located on a line located halfway between the centerlines of the connected cylinder journal pin 2.

Figure 2:
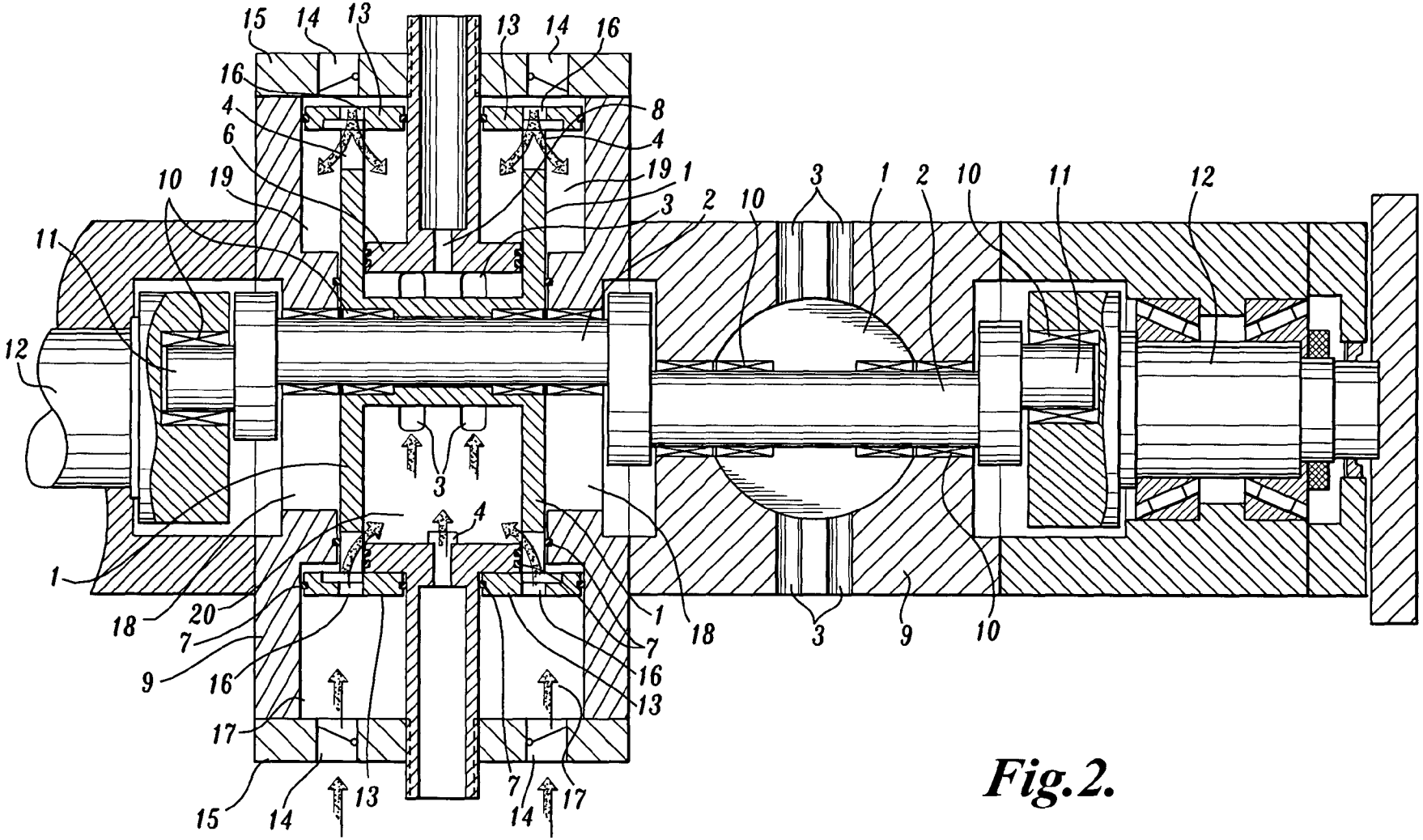
FIG. 2 is a cross-sectional side view of an internal combustion engine formed in accordance with the present invention showing a first set of cylinders extending normal to a second set of cylinders, wherein each set of cylinders are in contact with a reciprocating and rotating mechanism.
Figure 3:
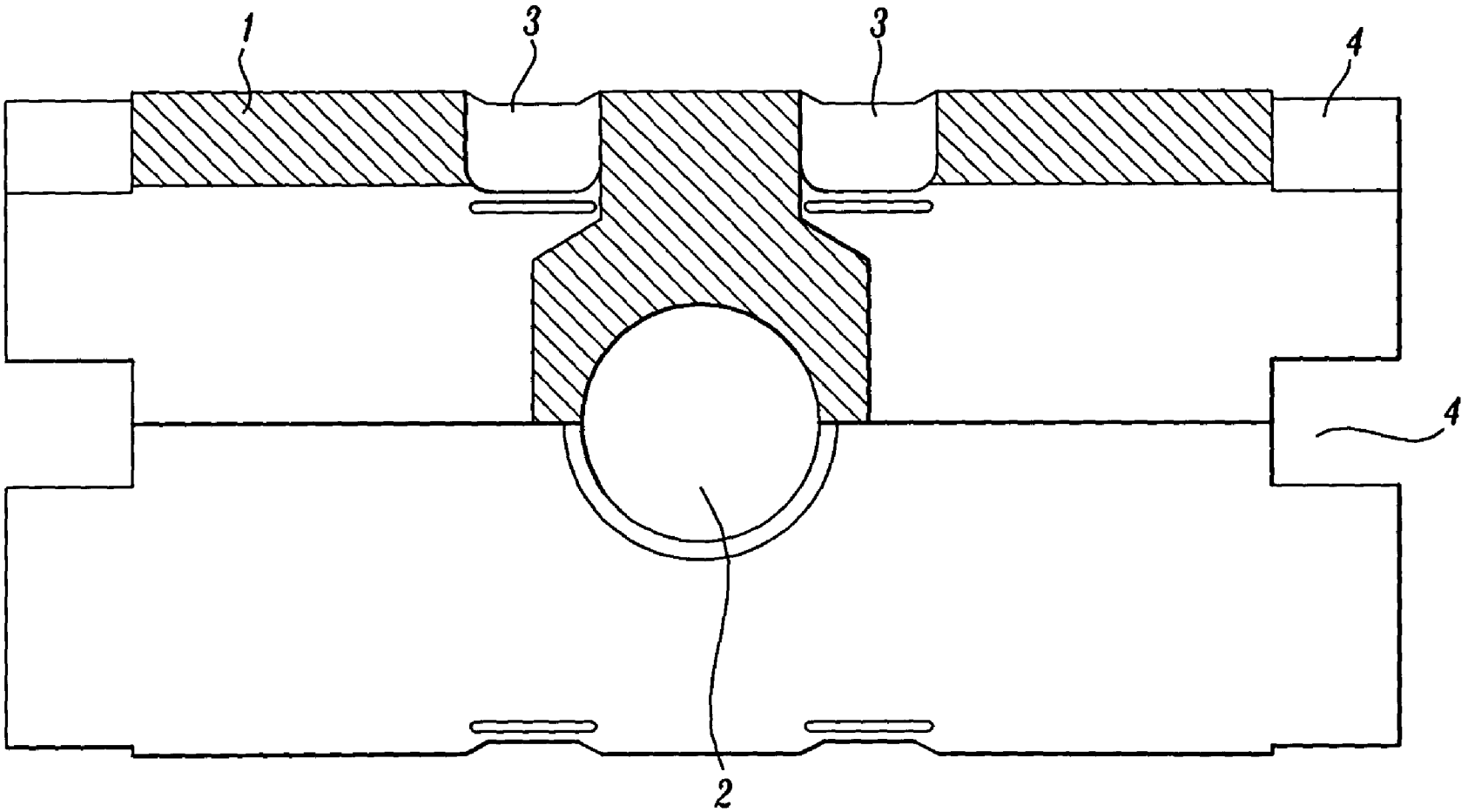
FIG. 3 is a cross-sectional view of a portion of an internal combustion engine formed in accordance with the present invention showing the exhaust ports, intake ports and the reciprocating and rotating mechanism.
Figure 4:
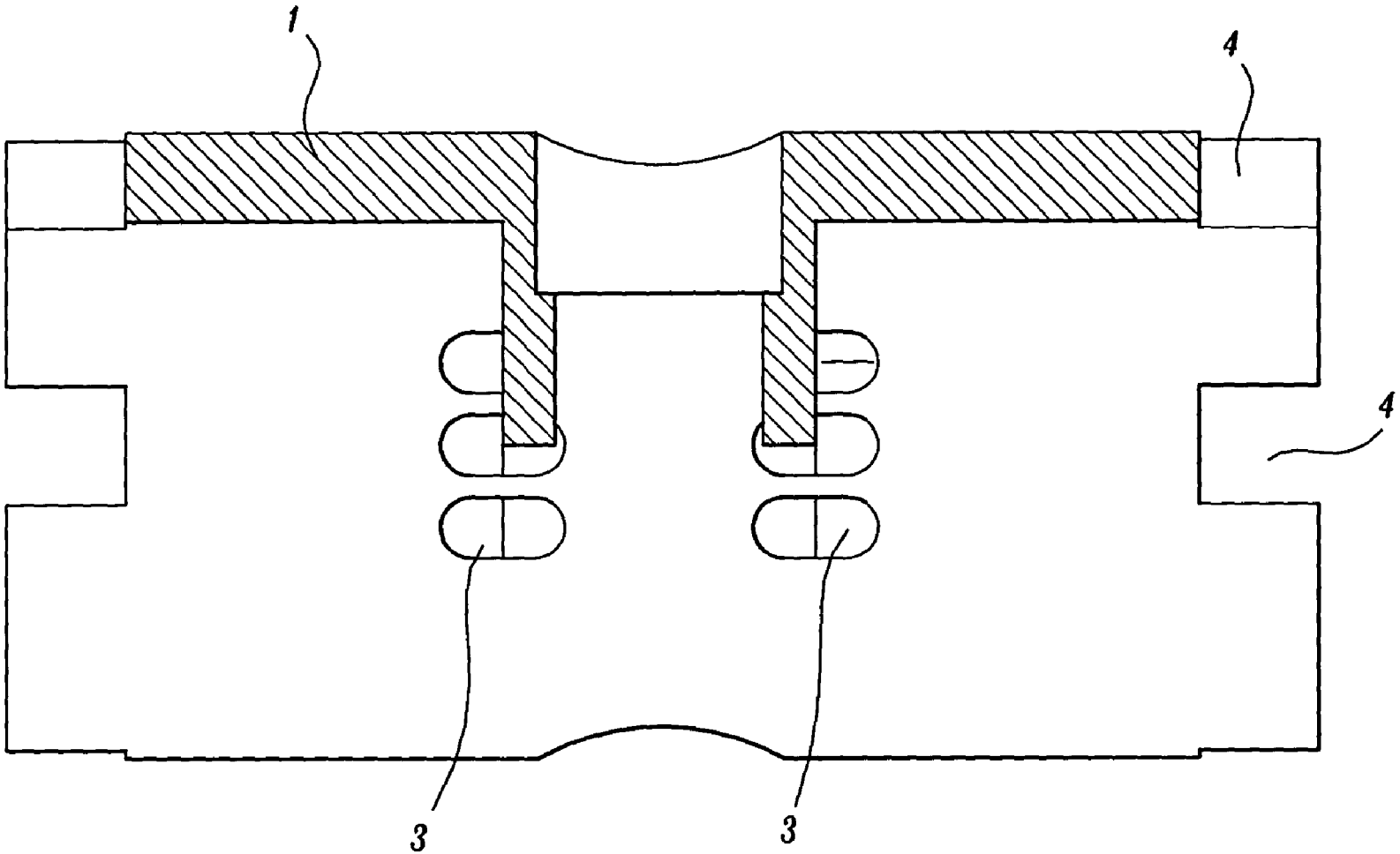
FIG. 4 is a cross-sectional view of an internal combustion engine formed in accordance with the present invention showing a cylinder, intake ports and exhaust ports.

The PTO journals 11 may be set in bearings 10 located in the PTO shafts 12. The centerline of the PTO shafts 12 match the centerline of the motor assembly, as seen in FIG. 2.

The cylinder journal pins 2 move the distance of the stroke in a straight line, and are guided by the double cylinder assembly, the slots 18 and the connection in a ninety degree angle of the cylinder housings 9. The whole cylinder pin assembly rotates at the same time in itself around the PTO shaft 12 centerline. Thus, the cylinder journal pin assembly has two axes of rotation. The first axis of rotation is defined by a longitudinal axis extending through the elongate direction of the cylinder journal pin assembly. The second axis of rotation is defined normal to a point defined midway between the ends of the stroke length of the cylinders.

The transformation of the straight motion into a circular motion is based on the following:

FIG. 1: Two lines AB and CD having the same length cross each other at a right angle (ninety degrees) at the halfway point E of each line. A line AB equal to half the length of AB or CD moves with its point a on the line CD from point C to D and back. At the same time point b moves on line AB from A to B and back. This demonstrates the straight motion of the connected cylinder journal pin 2. As a result, point X located at the halfway point of line ab moves in a circle. This demonstrates the circular motion of the PTO journal 11. The PTO journal 11 rotates the PTO shaft 12.

Air or air/fuel mixture enters the intake chamber 17 through the primary reed valve assembly 14 into the intake chamber 17 during the combustion stroke. The intake chamber 17 is favorably bigger than the actual cylinder displacement.

The precompression plate 13 which is attached to the double cylinder 1 transfers the air or air/fuel mixture during the compression stroke through a secondary reed valve assembly 16 located in the precompression plate 13 into the precompression chamber.

The same can be done over transfer ports 21 located in the cylinder housing and piston shaft, as seen in FIG. 11. At the combustion stroke the air/mixture enters close at the bottom dead center position through the intake ports 4 and into a cylinder chamber 20. It pushes out the rest of the gases from combustion through the already open cylinder exhaust ports 3 that match in this position the exhaust ports located in the cylinder housing 9.

As the cylinder 1 starts the compression stroke, the intake ports 4 close, the exhaust ports 3 stop to match and the cylinder chamber 20 is sealed. As a result of the oversized intake chamber 17 the cylinder chamber 20 gets a charge comparable to that of a super or turbocharged engine. It gets this already at lowest rpm, as soon as the throttle is completely open.

Through the lack of connecting rods and its corresponding movement around the crankshaft, friction on the cylinder walls is reduced. The diagram of the piston speed, in this case cylinder speed, changes favorably at any rpm.

The combustion pressure is also better and there is a more efficient transformation of energy into mechanical power.

Figure 12:
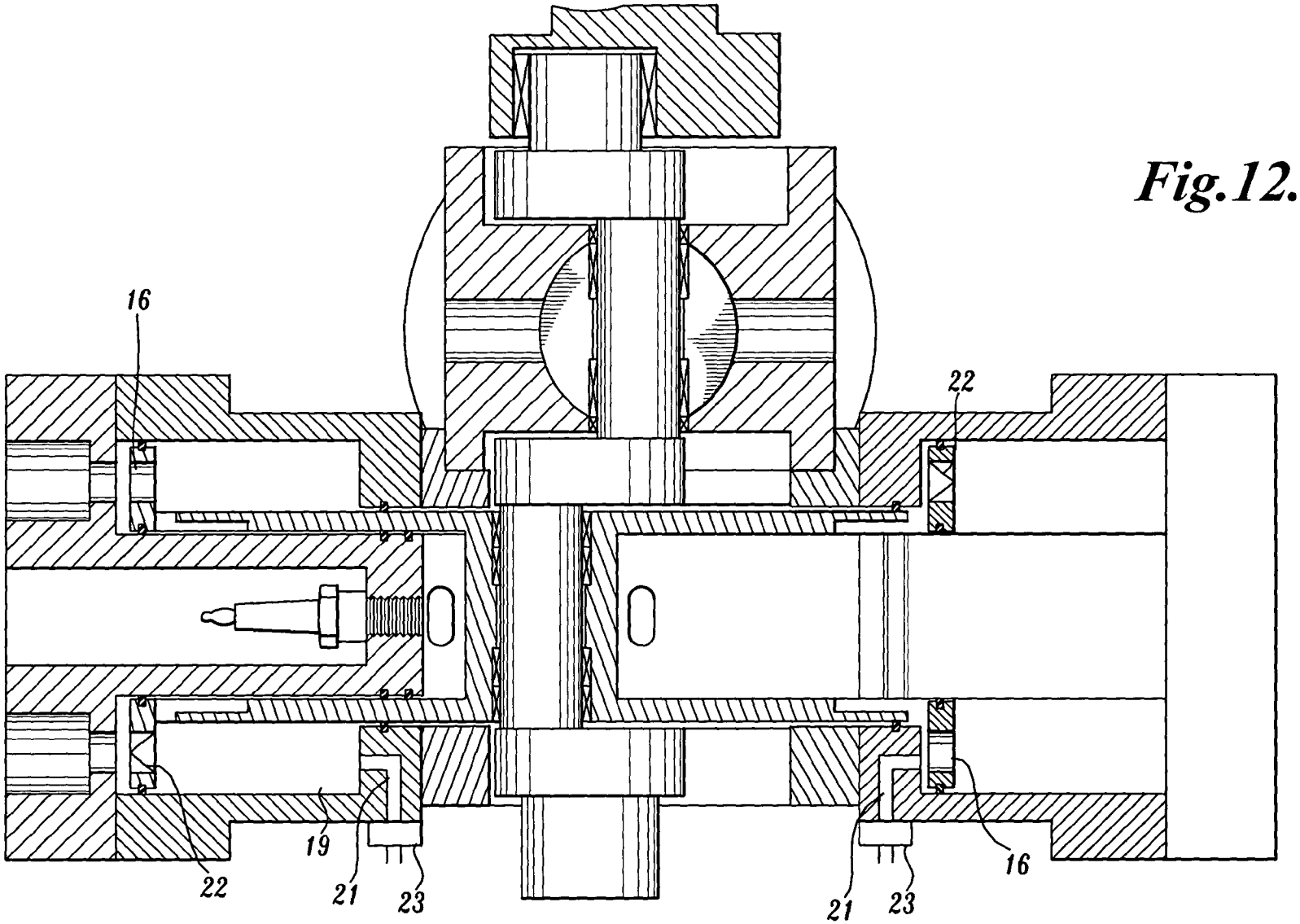
FIG. 12 is a cross-sectional side view of an internal combustion engine formed in accordance with the present invention showing the major components of the engine with an over pressure valve attached to the cylinders.

FIG. 12 illustrates the same principle for a normal piston-cylinder arrangement.

Figure 13:
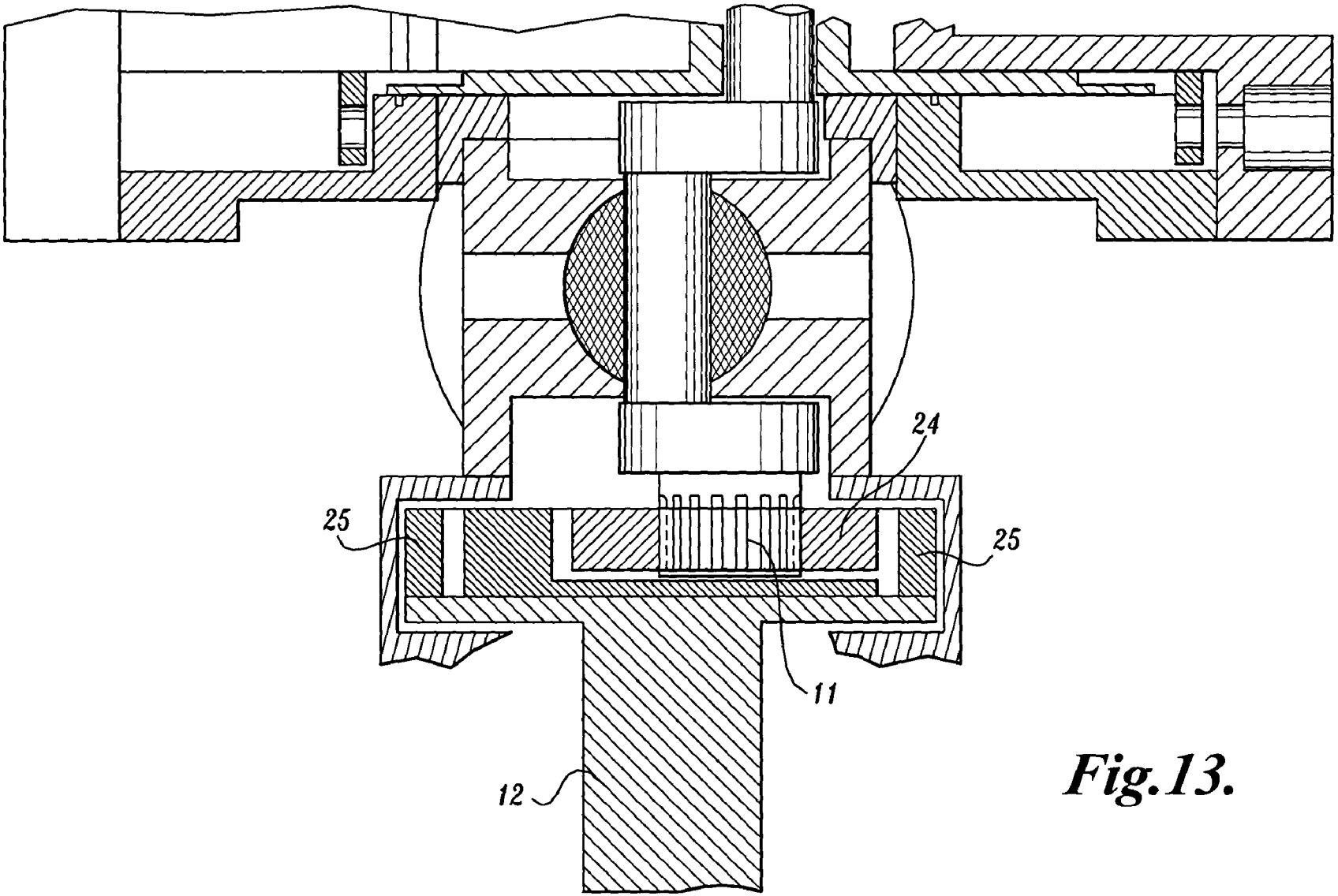
FIG. 13 is a cross-sectional view of an internal combustion engine formed in accordance with the present invention showing a reduction plate attached to one end of the reciprocating and rotating mechanism.

FIG. 13 shows the same as FIG. 2, just with other dimensions.

Figure 14:
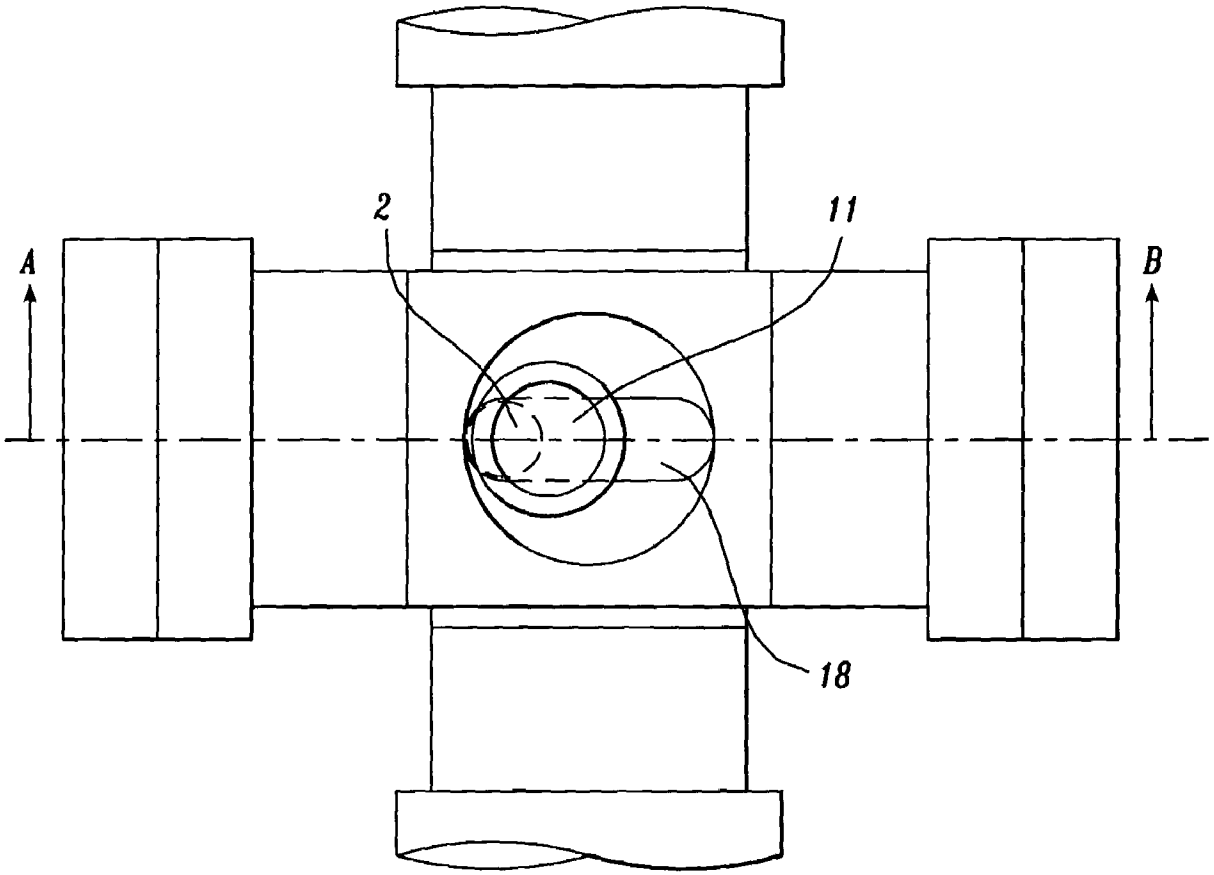
FIG. 14 is a side view of an internal combustion engine formed in accordance with the present invention showing the power take off journal.
Figure 15:
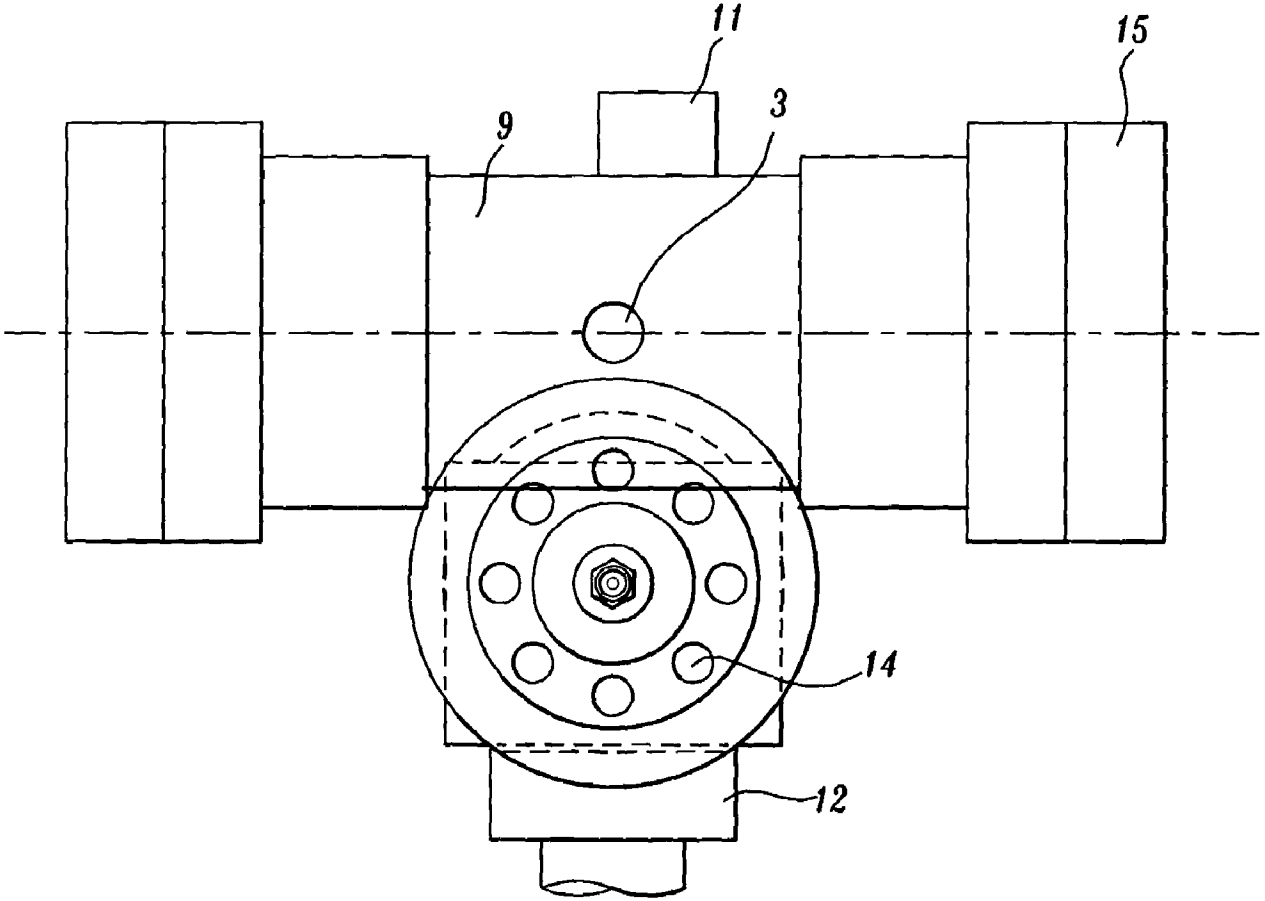
FIG. 15 is an end view of an internal combustion engine formed in accordance with the present invention showing the reed valve assembly.

In FIG. 14, over pressure valves 22 are positioned between the reed valves of the secondary reed valve assembly 16. After reaching a certain precompression, depending on adjustment, a surplus of air/fuel mixture at precompression is bleeding back into the intake chamber 17.

Independent from the altitude of operation or the rpm of the engine, as long as the adjusted precompression is reached, the engine will deliver its full horsepower and torque range.

Located at the bottom of the precompression chamber 19 are one or more cylinder housing vent holes 21. The vent holes 21 lead over compressor reed valves 23 to air hose connections located anywhere on the engine or the vehicle in which the engine is installed. In a diesel engine, surplus air might be used for compressor purposes during normal operation of the engine from any one or all cylinders.

In gasoline engines only a part of the cylinders can be used that way on demand. In this situation air for these particular cylinders has to bypass a carburetor.

In fuel injected gas engines, a bypass is not necessary as long as the injectors for the cylinders are shut off.

This guarantees that only air is compressed.

A part of the gas engine keeps operating and powers the compressor part if selected. After the compressor is not needed and the air hose or other appliance is disconnected, the vent holes are automatically closed and the engine is switched back to normal operation on all cylinders.

Referring to FIG. 13, a gear 24 is attached to the PTO journal 11. The gear 24 rotates like the PTO journal 11 and the cylinder journal pin 2 around itself. At the same time it rotates with its centerline around the centerline of the power takeoff shaft 12 to which an inside gear ring 25 is attached.

If the gear 25 rotates 360° it has to cam its teeth twice with the teeth of the gear ring 25.

Through the manipulation of diameters and the possible amount of teeth involved different reduction ratios of the actual engine rpm to a desired PTO shaft 12 rpm is possible. In the example of FIG. 13 the gear 24 on the PTO journal 11 has 30 teeth. The gear ring 25 on the PTO shaft 12 has 40 teeth. At one 360° rotation of the cylinder pin assembly and the gear 24 around its centerline, the gear has to cam 60 teeth at the gear ring 25. The gear ring 25 has only 40 teeth, therefore it has to rotate in the process the distance of 20 teeth, what amounts to a 180° rotation of the PTO shaft 12. A ratio of a 2:1 rpm reduction is accomplished.

FIGS. 16 and 17 show the only three major moving parts of a four cylinder engine. The two double cylinders 1 and the cylinder pin assembly with the two cylinder pins 2 and the PTO journal 11. Steps one to eight demonstrate one 360° rotation in one quarter stroke increments. Engines with more or less than four cylinders can be built.

All known systems of carburetion, fuel injection or additional use of turbochargers, compressors and blowers can be used on this engine, necessary or not. Also, all known types of ignition systems, lubrication systems, cooling systems, emission control systems and other engine related known systems can be adapted and, therefore, are within the scope of the present invention.

FIGS. 18–65 illustrate an alternate embodiment of a reciprocating internal combustion engine 1010 formed in accordance with the present invention. The engine 1010 is unlike conventional reciprocating internal combustion engines, in that the engine 1010 reciprocates two cylinder liners 1014*a* and 1014*b*, orthogonally oriented relative to one another, between opposing pairs of "substantially stationary" pistons 1012*a* and 1012*b*, and 1012*c* and 1012*d* respectively. As used within this detailed description, the phrase "substantially stationary" is intended to mean a part, that although may be capable of some movement, does not move in accordance with a crankshaft or analogous component of an engine, as does a piston, camshaft, connecting rod, or valve of a conventional engine. In other words, a substantially stationary part's movement is separate and independently actuatable relative to the crankshaft or analogous component of an engine.

In the embodiment illustrated in FIGS. 18–65, many of the components are identical to one another, such as the pistons 1012*a*, 1012*b*, 1012*c*, and 1012*d* and each of the two cylinder liners 1014*a* and 1014*b*. Therefore, a numbering scheme has been adopted in which components of identical structure are assigned a common reference numeral followed by a selected letter to distinguish them from their identical counterpart. Where the context permits, reference in the following description to an element of one component having an identical counterpart shall be understood as also referring to the corresponding element of the identical counterpart.

Figure 18:
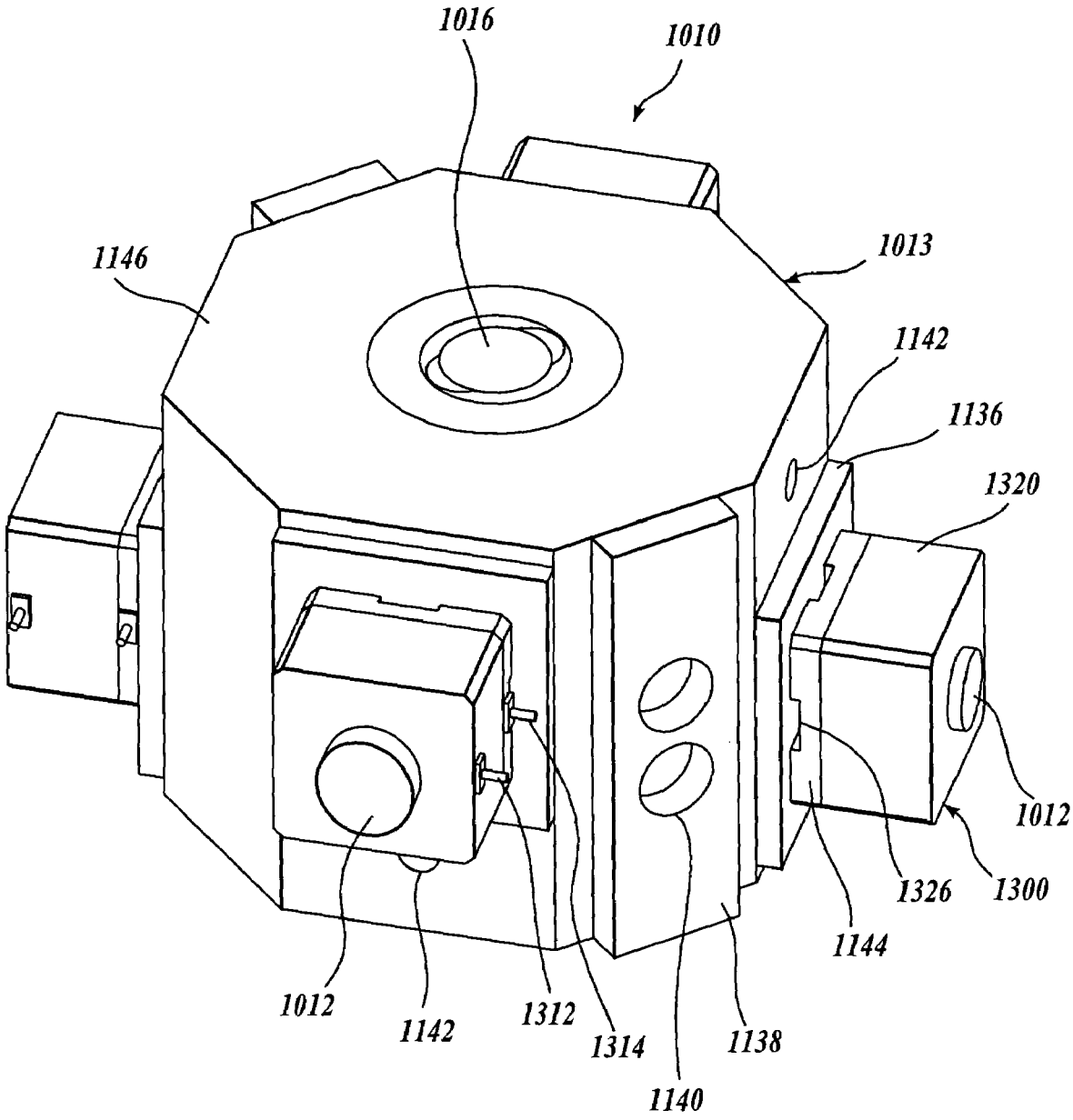
FIG. 18 is a perspective view of an alternate embodiment of a reciprocating internal combustion engine formed in accordance with the present invention, showing an engine block and related components, such as a control plate housing and an intake manifold, attached thereto.
Figure 19:
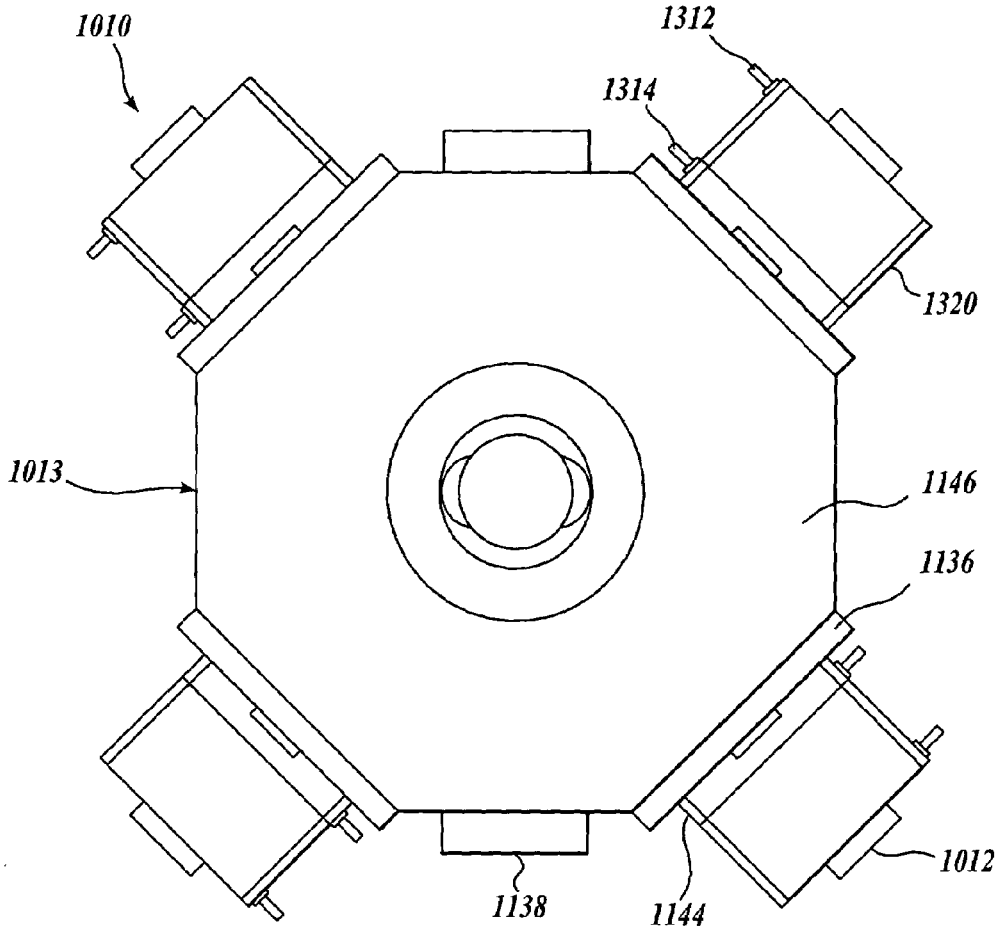
FIG. 19 is a top planar view of the internal combustion engine depicted in FIG. 18.
Figure 20:
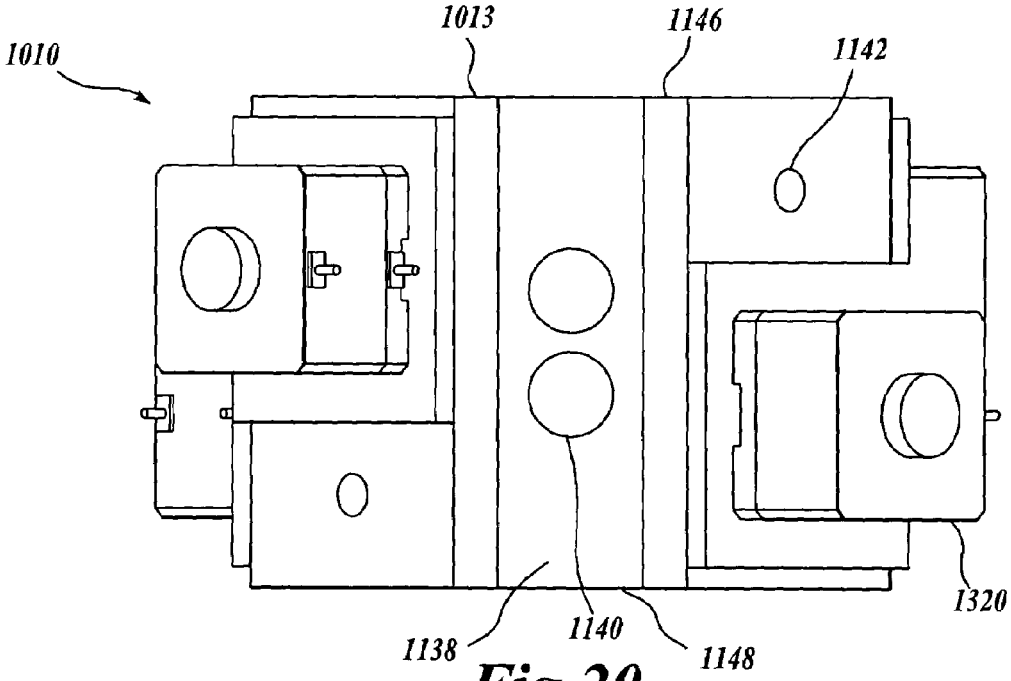
FIG. 20 is a side planar view of the internal combustion engine depicted in FIG. 18.

Referring now to FIGS. 18–20, an engine block 1013 and other related external components of one illustrated embodiment formed in accordance with the present invention will be discussed. The engine block 1013 is suitably an octagonal block structure having an upper planar end surface 1146 opposite a lower planar end surface 1148 with internal cavities for housing the pistons, cylinders, and other related components therebetween. The engine block 1013 is formed from a rigid material, such as steel, cast iron, or aluminum, by techniques well known in the art, such as machining and/or casting. Fastened to the sidewalls of the engine block 1013 are two intake manifolds 1138 and four square mounting plates 1136. Coupled to each of the mounting plates 1136 is a housing mounting plate 1144, upon each of which is coupled a control plate housing 1320.

Figure 21:
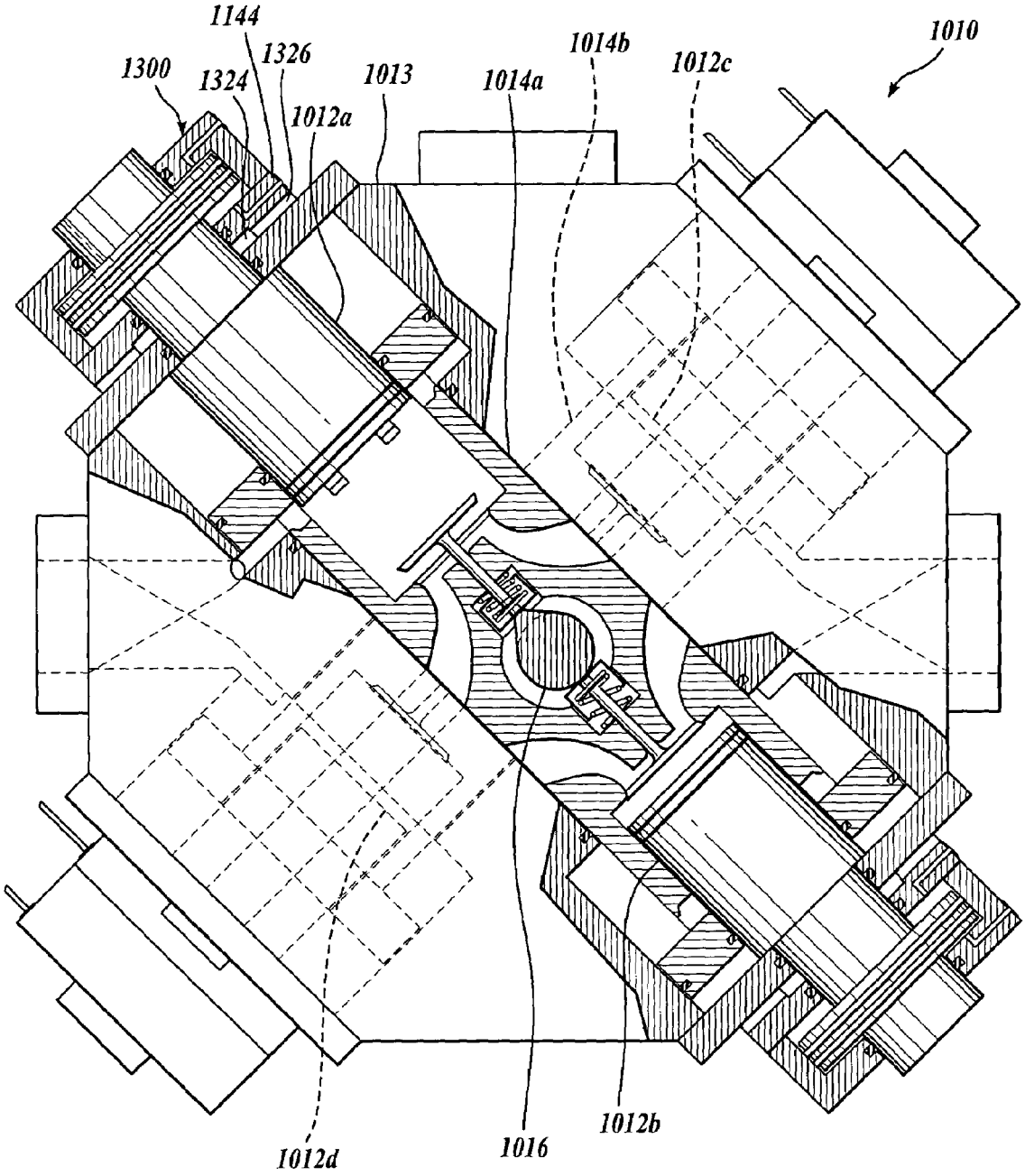
FIG. 21 is a top planar view of the internal combustion engine depicted in FIG. 18, with a portion of the engine block cut-away, showing a cross-sectional view of a reciprocating cylinder liner receiving an opposing pair of substantially stationary pistons.

Referring now to FIGS. 18 and 21, the housing mounting plate 1144 will be described. The housing mounting plate 1144 serves as an insulator, impeding the transfer of heat generated in the engine block 1013 to the various components of a compression ratio and power setting control system 1300, which will be described in further detail below. To impede heat transfer, the housing mounting plate 1144 contains an inner cavity 1324. The inner cavity 1324 impedes heat transfer by limiting the contact between components of the compression ratio and power setting control system 1300 and the mounting plate 1136. Further, the housing mounting plate 1144 includes four cooling ports 1326 in fluid communication with the inner cavity 1324 and the outer environment, to allow heated air to exchange with exterior cool air.

Referring again to FIGS. 18–20, protruding from the control plate housings 1320 are the distal ends of each of the pistons 1012 and upper chamber piping 1312 associated with the compression ratio and power setting control system 1300. Protruding from the housing mating plate 1144 is lower chamber piping 1314 also associated with the compression ratio and power setting control system 1300. Located above or below the control plate housing 1320, as the case may be, is an exhaust port 1142. The exhaust ports 1142 are in fluid communication with the exhaust gas passages 1037 (see FIG. 27) located internally in the engine block 1013, and allow the discharge of products of combustion generated in the combustion chambers of the engine 1010 to the atmosphere. Preferably, well known exhaust gas collection, treatment, and/or muffler systems (not shown) are coupled in fluid communication with the exhaust ports 1142. Each intake manifold 1138 includes two intake ports 1140. Preferably coupled to each intake port 1140 are well-known intake systems that may include such components as a carburetor and/or a filter.

Referring to FIG. 21 and focusing mainly now on the internal components of the internal combustion engine 1010, the engine 1010 includes two double cylinder liners 1014*a* and 1014*b*, each of which houses two substantially stationary opposing pistons 1012*a* and 1012*b* and 1012*c* and 1012*d*, respectively, in opposite ends of the cylinder liners 1014*a* and 1014*b*. The cylinder liners 1014*a* and 1014*b* are perpendicularly and offset mounted relative to one another within the engine block 1013. The cylinder liners 1014*a* and 1014*b* alternately reciprocate between a first extended position and a second extended position. More specifically, with reference to cylinder liner 1014*a*, the cylinder liner 1014*a* reciprocates between a first extended position wherein the cylinder liner 1014*a* is at a top-dead-center (TDC) position relative to a first piston 1012*b* and a bottom-dead-center (BDC) position relative to a second piston 1012*a*, as shown in FIG. 21, and a second extended position, where the cylinder liner 1014*a* is at a BDC position relative to the first piston 1012*b* and a TDC position relative to the second opposing piston 1012*a*. The second cylinder liner 1014*b* similarly reciprocates between a first extended position and a second extended position. However, the second cylinder liner 1014*b* reciprocates 180° out of phase of the first cylinder liner 1014*a* so that when the first cylinder liner 1014*a* is in extended position, the second cylinder liner 1014*b* is in a mid-stroke position. The cylinder liners 1014 are coupled to one another by a crank-cam 1016. The crank-cam 1016 converts the linear motion of the cylinder liners 1014 to rotary motion, as will be discussed in further detail below.

Figure 22:
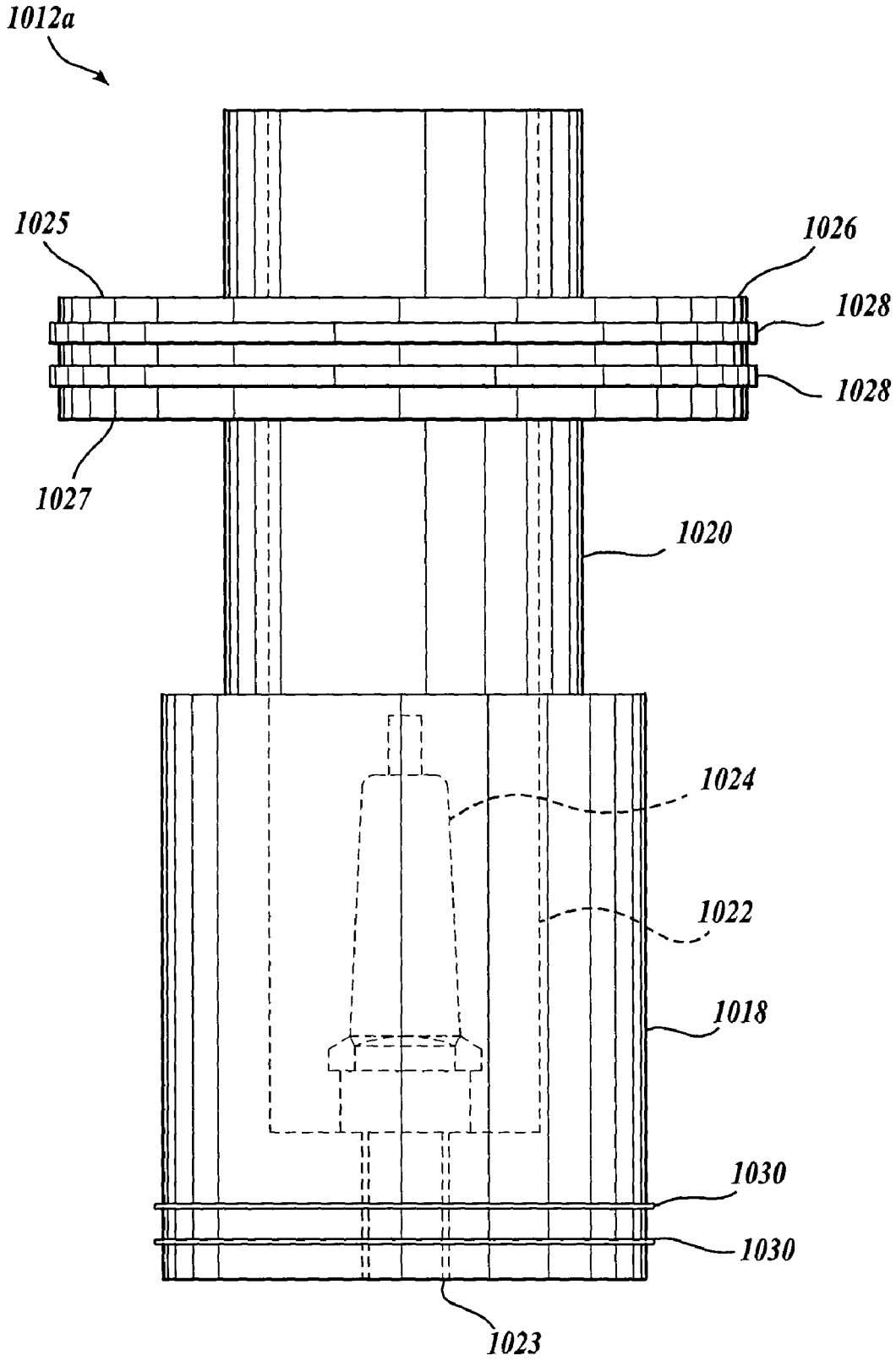
FIG. 22 is an elevation view of one embodiment of one of the substantially stationary pistons shown in FIG. 21.

Referring to FIG. 22, the physical structure of one of the four substantially stationary pistons 1012 formed in accordance with the present invention will now be described. Inasmuch as the pistons 1012 are substantially identical to one another, reference to the piston 1012*a*, illustrated in FIG. 22, shall be understood as also referring to the corresponding other three pistons 1012*b*, 1012*c*, and 1012*d* (see FIG. 21) where context permits. The piston 1012*a* is a hollowed, cylindrical plunger having a piston head 1018 concentrically and perpendicularly mounted to a shaft 1020. Both the piston head 1018 and shaft 1020 have aligned internal bores, forming a channel 1022 running axially through the center of the piston 1012. The channel 1022 allows a substantial reduction in the weight of the piston 1012, while also permitting access to the spark plug 1024 and/or a fuel injector (not shown) disposed within the piston head 1018. The pistons 1012 contain a spark plug or injector hole 1023 for the mounting of a spark plug 1024 and/or fuel injector therein.

Circumferentially mounted on the piston head 1018 are two compression rings 1030. As is well known in the art, the compression rings 1030 prevent the blow-by of combustion gases and products past the piston head 1018, mainly during the compression and expansion portions of the thermodynamic cycle. Although not shown, the piston head 1018 may also include an oil control ring, as is well known in the art. In proximity to the compression rings 1030, the diameter of the piston head 1018 is substantially equal to the diameter of the cylinder liner 1014. The diameter of the piston head 1018 may be tapered thereafter along the length of the piston head 1018, resulting in a portion of the piston head 1018 spaced from the compression rings having a relatively smaller diameter.

Circumferentially mounted on the shaft 1020 is a compression ratio control plate 1026. The compression ratio control plate 1026 is adaptable to receive pressurized control fluid on the upper and lower annular surfaces 1025 and 1027 of the plate 1026. By selectively providing a pressure differential across the annular surfaces 1025 and 1027, the axial position of the piston 1012*a* may be adjusted relative to the engine block to allow the power setting and compression ratio of the engine to be adjusted, as will be described in greater detail below. Two oil control rings 1028 are circumferentially mounted on the compression ratio control plate 1026 to prevent the leakage of any control fluid thereby.

Figure 23:
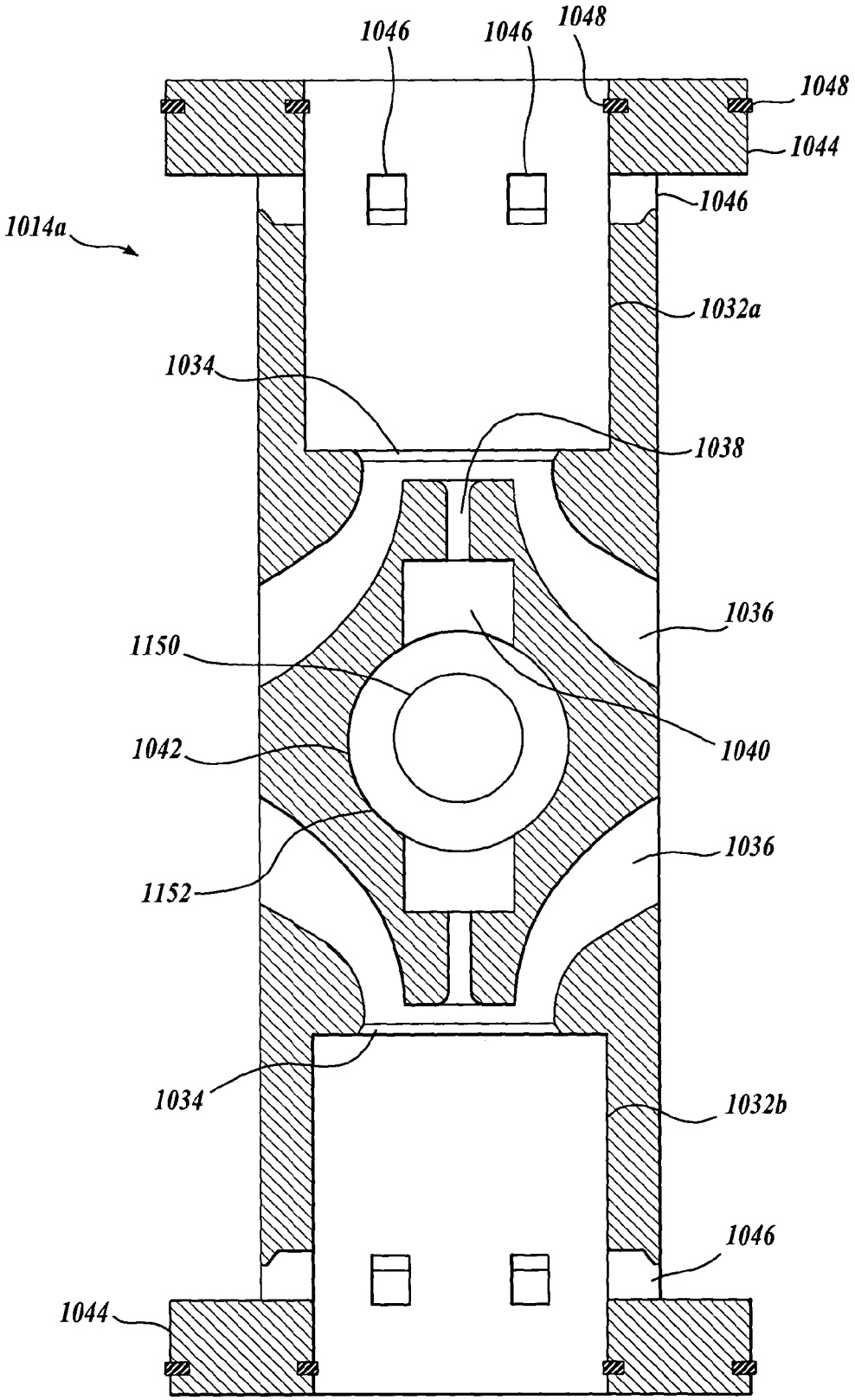
FIG. 23 is a cross-sectional view of one embodiment of the reciprocating cylinder liner shown in FIG. 21.

Referring to FIG. 23, reciprocating double cylinder liner 1014*a*, which operates in conjunction with two of the above-described substantially stationary pistons 1012, will now be described. Inasmuch as the double cylinder liners 1014 are substantially identical to one another, reference to the cylinder liner 1014*a* illustrated in FIG. 23 shall be understood as also referring to the other cylinder liner 1014*b* (see FIG. 21), where context permits. The double cylinder liner 1014*a* is a generally elongate cylindrical structure having a first axially aligned bore concentrically formed in an upper distal end of the cylinder liner 1014*a*, thereby forming a first cylinder 1032*a* for reciprocatingly receiving a piston 1012*a* (see FIG. 21). Located on an opposite lower distal end of the cylinder liner 1014*a* is a second concentrically formed, axially aligned bore in the cylinder liner 1014*a*, thereby forming a second cylinder 1032*b* for reciprocatingly receiving a second piston 1012*b* (see FIG. 21). The cylinders 1032*a* and 1032*b* are shaped and sized to receive the pistons 1012*a* and 1012*b* in a clearance fit relationship, as is well known in the art.

Figure 24:
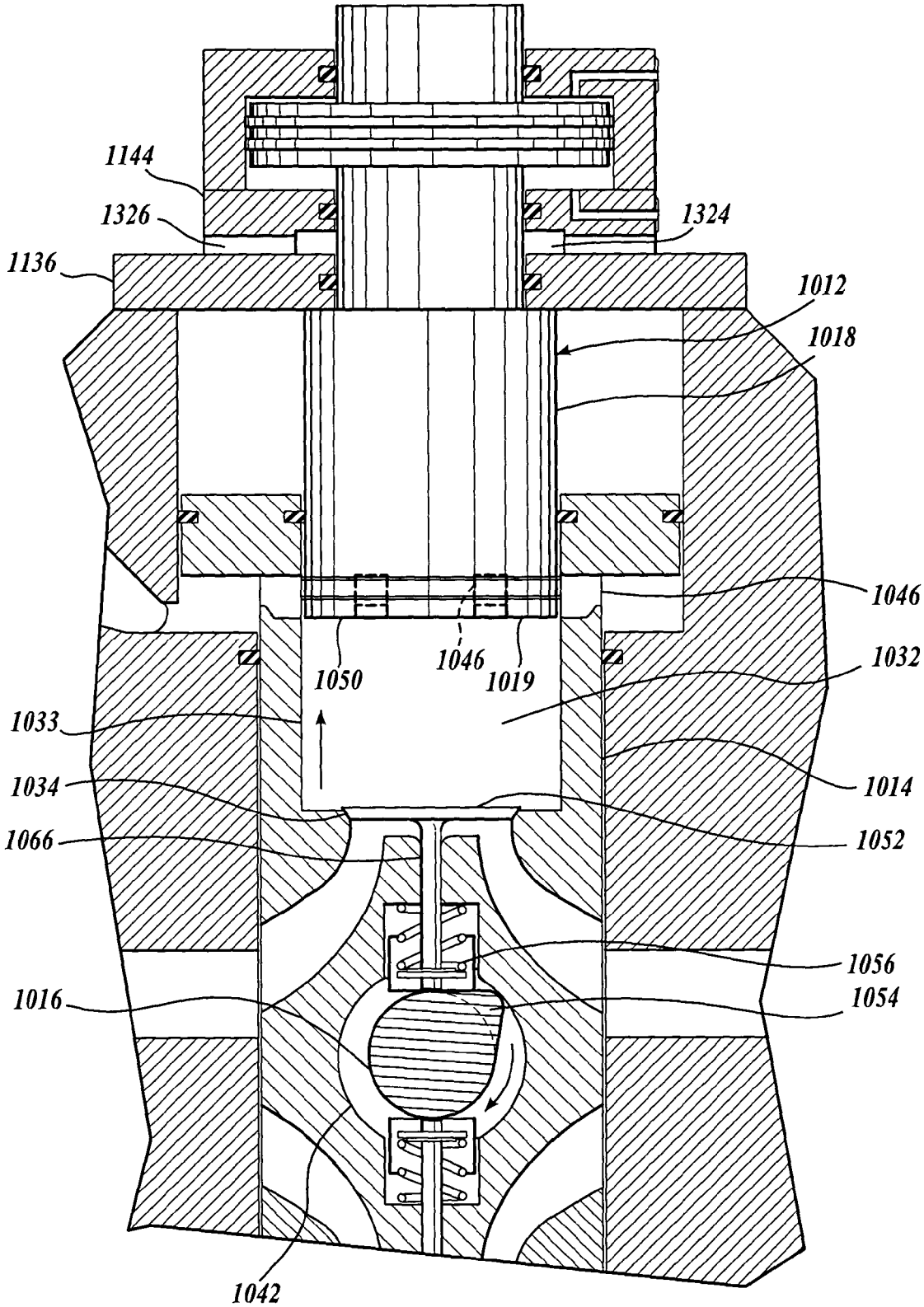
FIG. 24 is a fragmentary cross-sectional view of a portion of the reciprocating cylinder liner and related components shown in FIG. 21, illustrating the reciprocating cylinder liner as a compression portion of a thermodynamic cycle is initiated.

Referring now to FIGS. 21, 23 and 24, at the inner or bottom ends of the cylinders 1032 are exhaust valve seats 1034. The exhaust valve seats 1034 are formed by well-known techniques in the art to receive an exhaust valve therewithin. In fluid communication with the exhaust valve seats 1034 are four exhaust gas passages 1036 for discharging exhaust gases from the cylinders 1032. Centrally bored through the cylinder liner 1014*a* is a valve stem bore 1038. The valve stem bore 1038 is sized to receive a stem of the exhaust valve 1052. In communication with the valve stem bore 1038 is a valve spring housing 1040. The valve stem housing 1040 is sized and configured to house a spring for biasing the exhaust valve in the closed position. In communication with the valve spring housing 1040 is a crank-cam housing 1042. The crank-cam housing 1042 is sized and configured to house the crank-cam 1016 and allow its rotation therewithin.

Figure 28:
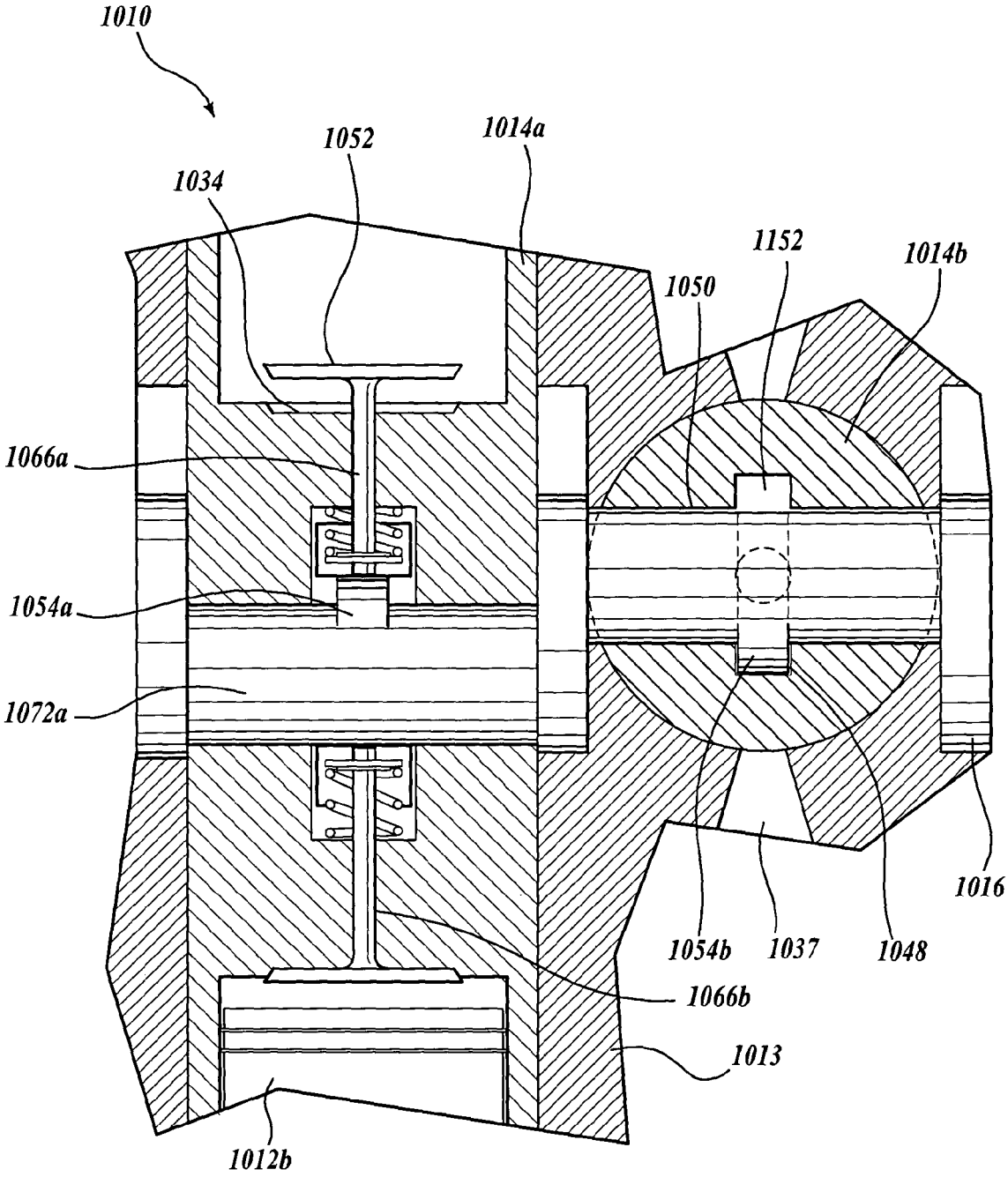
FIG. 28 is a fragmentary cross-sectional view of the reciprocating internal combustion engine of FIG. 18, the cross-sectional cut taken substantially along the centerline of the crank-cam so as to be coplanar with the centerline of a first cylinder liner and pass perpendicularly though the centerline of a second cylinder liner oriented normal to the first cylinder liner.
Figure 29:
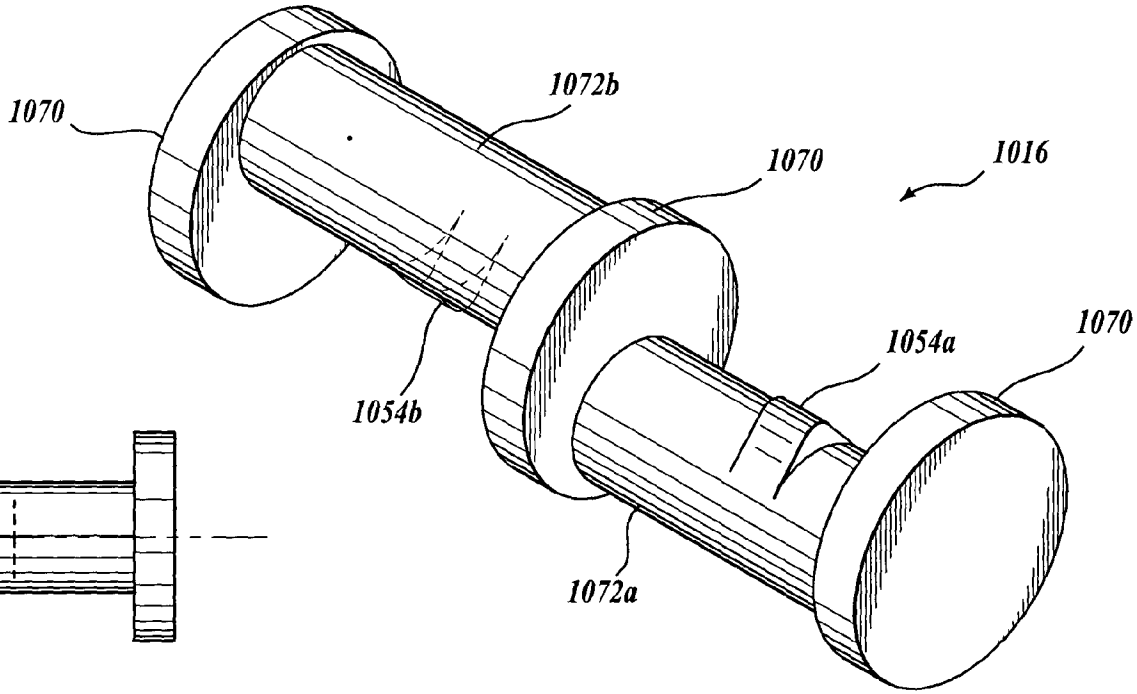
FIG. 29 is a perspective view of one embodiment of the crank-cam shown in FIG. 28 formed in accordance with the present invention.
Figure 30:
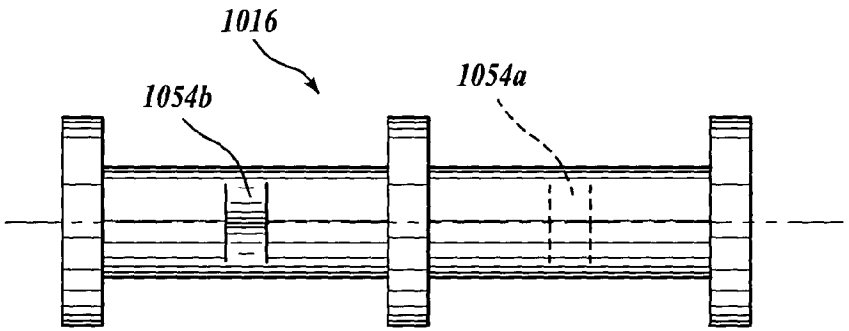
FIG. 30 is a bottom view of the crank-cam shown in FIG. 29.
Figure 31:
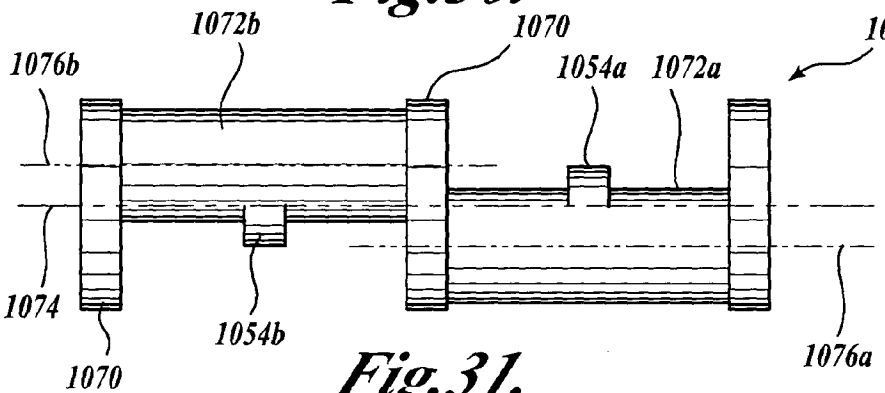
FIG. 31 is an elevation view of the crank-cam shown in FIG. 29.
Figure 32:
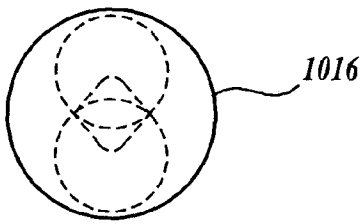
FIG. 32 is a side view of the crank-cam shown in FIG. 31.

Referring now to FIGS. 23 and 28, the crank-cam housing 1042 is formed by a cylindrically shaped bore 1150 perpendicularly passing through the cylinder liner 1014*a* at a location equidistant from the ends of the cylinder liner. The radius of the bore 1150 is substantially equal to the distance measured from the centerline of the crank-cam 1016 to an outer surface of a crank-cam 1016 crank journal 1072. A radius of this dimension allows the crank journal to rotate freely within the bore 1150 of the crank-cam housing 1042 during operation. The diameter of the bore 1150 is stepped suddenly outward in the center of the bore 1150 to form a lobe clearance bore 1152. The radius of the lobe clearance bore 1152 is equal to or greater than a distance measured from a centerline of the crank-cam to the distal end or peak of the lobe 1054 of the crank-cam 1016. A radius of this dimension provides sufficient clearance for the lobe 1054 to rotate freely within the crank-cam housing 1042.

Located on opposite distal ends of the cylinder liner 1014*a* are annular precompression plates 1044. The annular precompression plates 1044 are utilized to compress and deliver pressurized combustion gases to the cylinders 1032, as will be discussed in more detail below. In proximity to the annular precompression plates 1044 are intake ports 1046. In the illustrated embodiment, the intake ports 1046 are spaced circumferentially about the cylinders 1032 at 60° intervals; however, it should be apparent to one skilled in the art that other configurations are suitable. The intake ports 1046 allow the entry of combustion gases into the cylinders 1032 during operation for scavenging and charging of the cylinders 1032. Located on the inner and outer surfaces of the annular precompression plates are inner and outer combustion gas/oil seals 1048. The seals 1048 prevent the passage of fluids thereby as will be described in more detail below.

Referring now to FIG. 24, in light of the above description of the reciprocating double cylinder liners 1014 and the substantially stationary pistons 1012, the relationship of these and related components to one another during significant events in a thermodynamic cycle will now be discussed. The illustrated embodiment of the reciprocating internal combustion engine 1010 of the present invention operates on a two-stroke cycle. Therefore, for every revolution of the crank-cam 1016, each piston 1012 completes the thermodynamic cycle in two strokes, a single stroke defined by movement of the cylinder liner 1014 from a TDC position to a BDC position (or vice versa) relative to the substantially stationary pistons 1012 contained within the cylinder liners 1014. Therefore, every stroke of the cylinder liner 1014 is either a power stroke, also known as an expansion stroke, or a compression stroke relative to each piston 1012. This requires the intake and exhaust functions, i.e., scavenging, to occur rapidly at the end of each power stroke and before the succeeding compression stroke. In the illustrated embodiment, each piston 1012 undergoes one power stroke for each revolution of the crank-cam 1016, resulting in twice as many power strokes as in a similarly designed four-stroke cycle engine for a given RPM.

Still referring to FIG. 24, the cylinder liner 1014 is depicted at the commencement of the compression portion of the thermodynamic cycle. More specifically, the cylinder liner 1014 is depicted as it moves upward from the cylinder liner's BDC position toward the piston 1012. As cylinder liner 1014 moves upward, the piston 1012 completely covers the intake ports 1046, thereby sealing off the cylinder 1032. In the depicted position, an exhaust lobe 1054 on the crank-cam 1016 is oriented just as the valve stem 1066 comes off of the exhaust lobe 1054, thereby allowing a valve spring 1056 to bias an exhaust valve 1052 into a closed position. In the closed position, the exhaust valve 1052 sealingly engages an exhaust valve seat 1034 in the cylinder liner 1014, thereby preventing the discharge of any combustion gases from the cylinder 1032. Configured as described, the combustion gases are sealingly contained within a combustion chamber 1033, defined by the side and bottom peripheral walls of the cylinder 1032 and the end surface, or crown 1019 of the piston head 1018.

Figure 25:
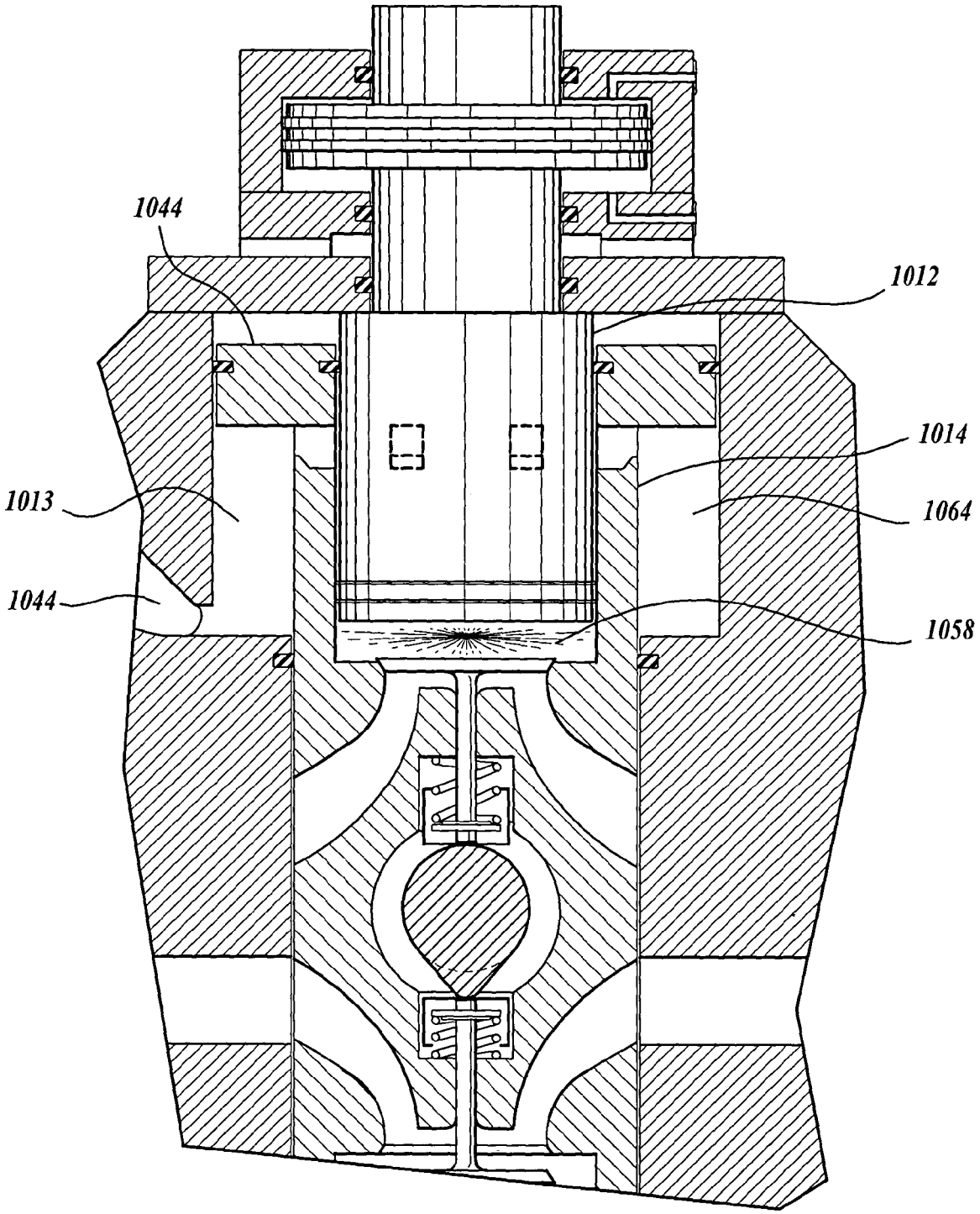
FIG. 25 is a fragmentary cross-sectional view of the reciprocating cylinder liner and related components shown in FIG. 21, illustrating the reciprocating cylinder liner in a top-dead-center (TDC) position with respect to the shown substantially stationary piston as the reciprocating cylinder liner transitions into an expansion portion of the thermodynamic cycle.
Figure 26:
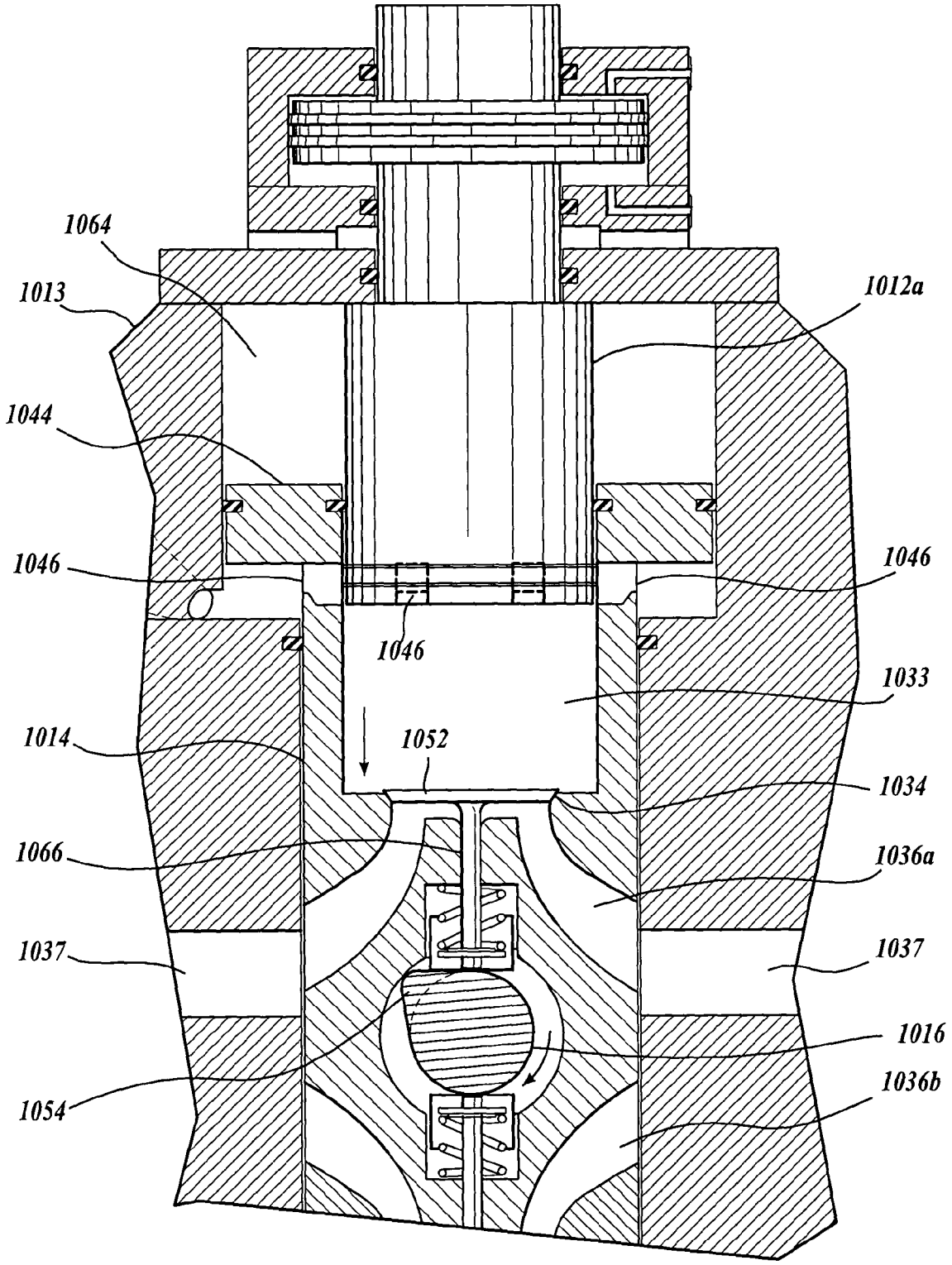
FIG. 26 is a fragmentary cross-sectional view of the reciprocating cylinder liner and related components shown in FIG. 21, illustrating the reciprocating cylinder liner as the cylinder liner transitions into a scavenging portion of the thermodynamic cycle, marked by the opening of a plurality of intake ports near a crown of the substantially stationary piston and the opening of an exhaust valve.

As the cylinder liner continues to approach the piston, departing from its BDC position and approaching its TDC position relative to the piston 1012, the volume of the combustion chamber 1033 is accordingly decreased, thereby compressing the combustion gases contained therewithin. Referring now to FIG. 25, when, or just prior to arrival of the cylinder liner 1014 at its TDC position respective to the piston 1012, a high voltage spark 1058 is discharged from the spark plug 1024 (see FIG. 22) by well-known means, thereby igniting the combustion gases. As the combustion gases burn, the resulting products of combustion expand, driving the cylinder liner 1014 away from the piston 1012. Referring now to FIG. 26, the expansion of the products of combustion continues to drive the cylinder liner 1014 down and away from the piston 1012, until the point in the cycle wherein the exhaust valve 1052 is displaced from its seat 1034 and the intake ports 1046 are uncovered, thus initiating the scavenging of the products of combustion from the combustion chamber 1033.

However, prior to scavenging the products of combustion from the combustion chamber 1033, a new volume of combustion gases is pressurized to aid in scavenging of the combustion chamber 1033. In the illustrated embodiment of the present invention, this is accomplished by the sweeping of the annular precompression plates 1044 through an intake chamber 1064. More specifically, as the cylinder liner 1014 travels upward from the position shown in FIG. 24 to the position shown in FIG. 25, the annular precompression plate 1044 is forced to sweep through the cylindrically-shaped intake chamber 1064. As the precompression plate 1044 sweeps upward through the intake chamber 1064, a vacuum is created within the intake chamber 1064, which draws new combustion gases into the intake chamber 1064. A well-known one-way reed check valve (not shown) allows the flow of the combustion gases into the intake chamber 1064, while preventing the passage of any combustion gases or products of combustion out of the intake chamber 1064.

As the cylinder liner 1014 travels downward from the position shown in FIG. 25 to the position shown in FIG. 26, i.e., from a TDC position to a BDC position, the intake chamber 1064 is a sealed pressure vessel as the intake ports 1046 are sealed off by the piston 1012 and the one-way reed check valves prevent the discharge of combustion gases out the intake chamber 1064. As the precompression plate 1044 sweeps downward through the intake chamber 1064, the combustion gases contained in the intake chamber 1064 are compressed until released into the combustion chamber 1033 by the uncovering of the intake ports 1046.

The intake chamber 1064 preferably contains a volume greater than the maximum displacement of the combustion chamber 1033. In the illustrated embodiment, the intake chamber 1064 is three times larger than the maximum displacement of the combustion chamber, although it should be apparent to one skilled in the art that other ratios of intake chamber volume to maximum combustion chamber volume are suitable for use with the present invention, such as low as 1:1 and up to 3:1 or higher. As a result of the relatively greater volume of the intake chamber 1064 relative to the combustion chamber 1033, combustion gases may be provided at an elevated pressure. Thus, by selecting the relative size of the intake chamber 1064, combustion gases at elevated pressures similar to those reached in a super-charged or turbo-charged conventional engine may be achieved. The pressurization of the combustion gases occurs even at low RPMs, unlike conventional super-charged or turbo-charged engines, which typically are unable to provide sufficient pressurization of the combustion gases at low RPM, resulting in a lag in engine performance as the engine reaches an elevated RPM able to provide sufficiently pressurized combustion gases.

Scavenging of the combustion chamber 1033 commences at the end of the power stroke. The end of the power stroke is marked by the opening of the intake ports 1046 and the exhaust valve 1052. This occurs, as depicted in FIG. 26, as the cylinder liner 1014 moves down and away from the substantially stationary piston 1012 to the point that the intake ports 1046 are initially uncovered and the exhaust valve 1052 is initially lifted from its seat 1034. As the intake ports 1046 are initially uncovered, the pressurized combustion gases contained within the intake chamber 1064 below the precompression plate 1044 are released into the combustion chamber 1033. At approximately the same time, the exhaust valve 1052 is initially lifted off the valve seat 1034 as the lobe 1054 of the crank-cam 1016 engages the valve stem 1066, thereby disposing the exhaust valve 1052 toward the substantially stationary piston 1012. Thus, the products of combustion contained in the combustion chamber 1033 begin to be swept from the combustion chamber 1033 as the pressurized combustion gases contained in the intake chamber 1064 are released from the intake chamber 1064 through the intake ports 1046 and through the combustion chamber 1033. The entrance of the pressurized combustion gases into the combustion chamber 1033 forces the products of combustion out the exhaust gas passageways 1036 in the cylinder liner 1014 as they align with the exhaust gas passageways 1037 located in the engine block 1013.

The exhaust gas passageways 1037 are centrally located in the engine block 1013 and are alternately aligned depending upon the position of the cylinder liner 1014, in fluid communication with a first pair of exhaust gas passageways 1036*a* and a second pair of exhaust gas passageways 1036*b* in the cylinder liners 1014. More specifically, when the cylinder liner 1014 is at a BDC position with respect to a first piston 1012*a*, the first pair of exhaust gas passageways 1036*a* associated with the first piston 1012*a* are in fluid communication with the exhaust gas passageways 1037 in the engine block 1013. When the cylinder liner moves to a BDC position with respect to a second piston opposing the first piston, the second pair of exhaust gas passageways 1036*b* associated with the second piston will be in fluid communication with the exhaust gas passageways 1037 in the engine block 1013.

Figure 27:
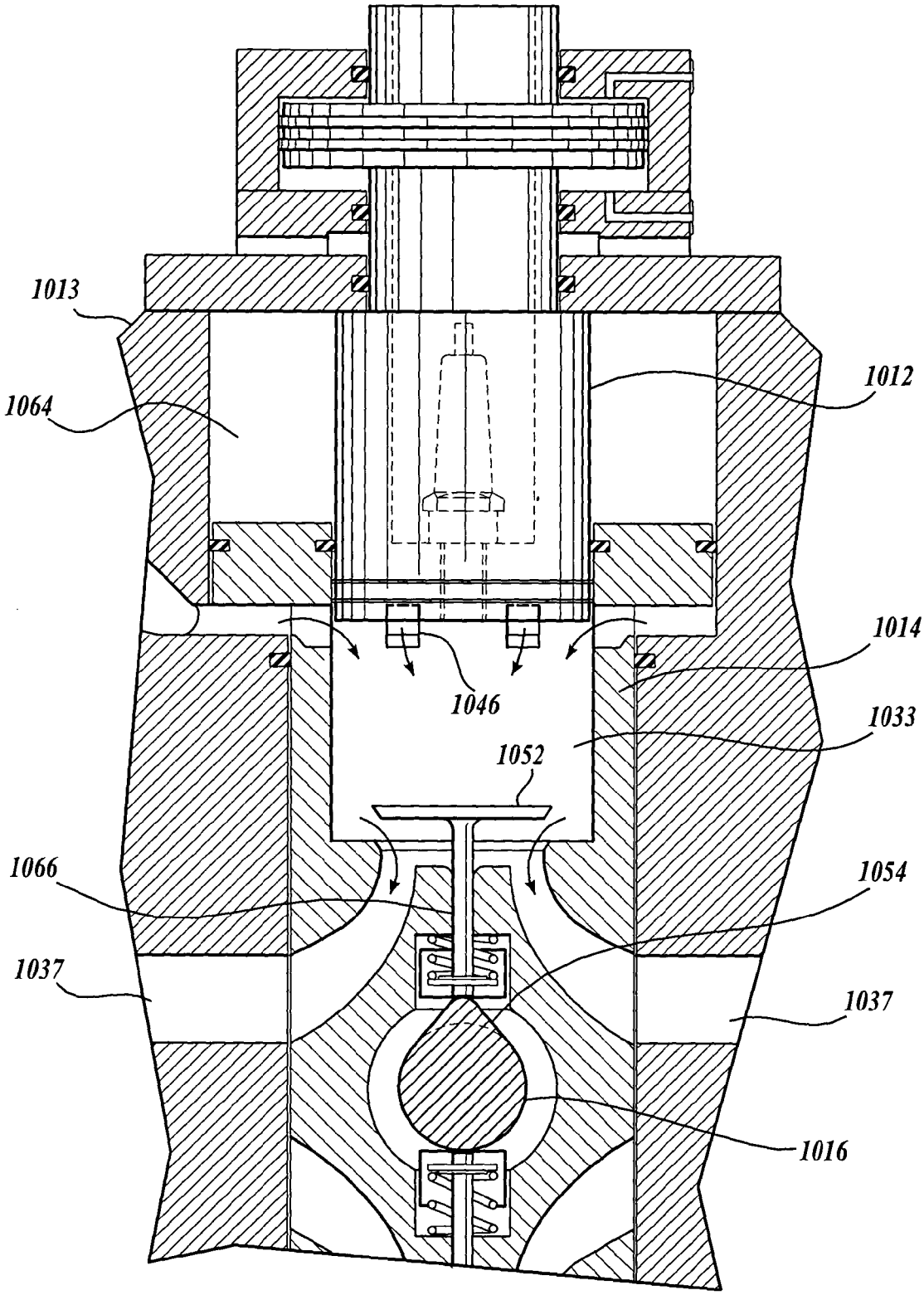
FIG. 27 is a fragmentary cross-sectional view of the reciprocating cylinder liner and related components shown in FIG. 21, illustrating the reciprocating cylinder liner in a bottom-dead-center (BDC) position with respect to the shown substantially stationary piston as the reciprocating cylinder liner undergoes scavenging with the intake ports fully open and the exhaust valve fully open.

Returning now to the operation of the engine, the cylinder liner 1014 continues to move away from the substantially stationary piston 1012*a* until the cylinder liner 1014 reaches BDC. At BDC, as depicted in FIG. 27, the intake ports 1046 and exhaust valve 1052 are fully open. At this point, the pressurized combustion gases are flowing into the combustion chamber 1033 at a high rate, thus purging the combustion chamber 1033 of the products of combustion and recharging the combustion chamber 1033 with fresh combustion gases. As the crank-cam 1016 continues to rotate clockwise past the BDC position, the exhaust valve 1052 retracts into a closed position as the lobe 1054 disengages from the valve stem 1066 and the cylinder liner 1014 moves toward the substantially stationary piston 1012, thereby closing off the intake ports 1046. Thus, the combustion chamber 1033 is completely sealed and the combustion gases contained therewithin begin to be compressed, thus returning the cycle to the position depicted in FIG. 24.

Referring to FIGS. 29–32, a crank-cam 1016 formed in accordance with the present invention will now be described in further detail. The crank-cam 1016 of the illustrated embodiment of the present invention serves both the functions of a crankshaft and a camshaft in a conventional reciprocating internal combustion engine. The crank-cam 16 includes three circular crank webs 1070, two crank journals 1072*a* and 1072*b*, and two crank-cam lobes 1054. The crank-cam 1016 may be of steel or other suitably rigid material, forged in one piece, or may be built up, such as by shrink-fitting separately forged crank journals 1072 to cast crank webs 1070. Although the crank webs 1070 are concentrically aligned relative to one another, the crank journals 1072 are offset relative to one another by a distance equal to one half of the stroke length and are also offset relative to the centerline 1074 of the crank webs 1070.

Referring now to FIGS. 21, and 29–32, the crank journals 1072*a* and 1072*b* are disposed relative to one another so that when a first cylinder liner 1014*a* is in a TDC relationship relative to one piston 1012*b* and at a BDC relationship to a second opposing piston 1012*a*, the second cylinder liner 1014*b* is equidistant from its opposing pistons 1012*c* and 1012*d*. Likewise, the crank-cam lobes 1054 of each respective crank journal 1072 face in opposite directions, so that when the first crank-cam lobe 1054*a* has positioned an exhaust valve 1052 in its fully open position relative to a piston 1012*a*, the other crank-cam lobe 1054*b* is equidistant from the opposing substantially stationary pistons 1012*c* and 1012*d*, and therefore does not engage the valve stems of either exhaust valve, thus placing the respective exhaust valves in a closed position.

As should be apparent to one skilled in the art, the force to compress the combustion gases associated with a first piston 1012*a* is provided by the expansion of the gases related to the opposing piston 1012*b*. Therefore, as should be apparent to one skilled in the art, the force exerted upon the crank journal 1072*a* is a resultant force of an expansion force generated by the expansion of the combustion gases minus a compression force required to compress the combustion gases related to the opposing piston. Further, inasmuch as the compression force and the expansion force are collinear, a moment is not created upon the crank-cam 1016 by the simultaneous application of the expansion and compression forces. Thus, the crank-cam 1016 of the present invention may be reduced in size relative to a crankshaft of a conventional engine that does not counter the expansion force with a collinear compression force.

Figure 33:
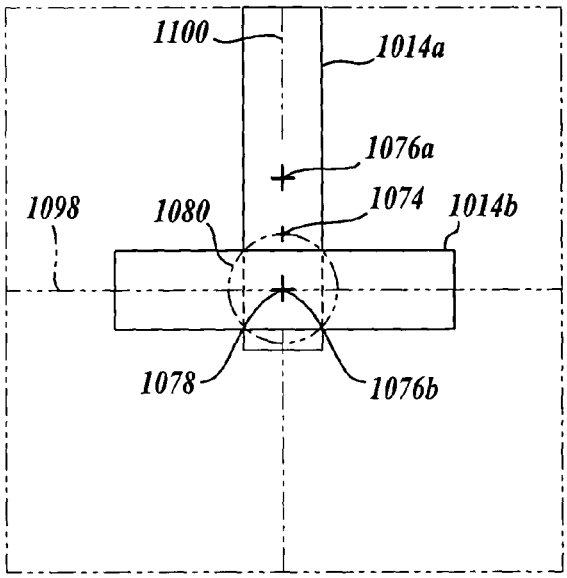
FIG. 33 is a diagrammatic elevation view showing the linear and rotary motion of a crank-cam with attached first and second cylinder liners; showing the first vertically oriented cylinder liner in an fully extended position and the second horizontally oriented cylinder liner in a mid-stroke position, wherein the distance between a pair of crank journals has been exaggerated to better show the movement of the cylinder liners.
Figure 34:
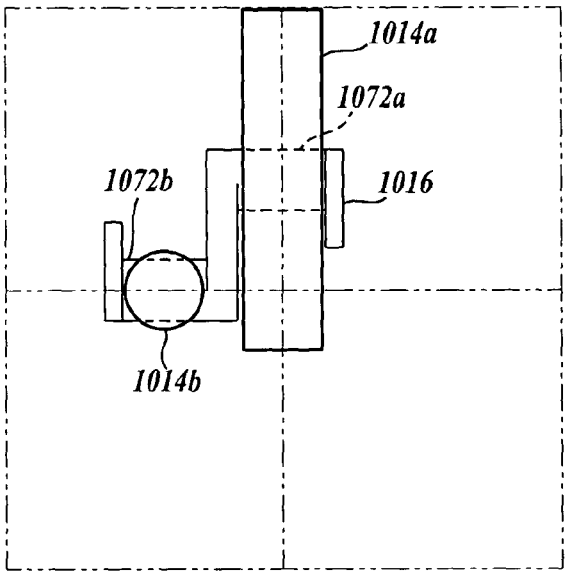
FIG. 34 is a diagrammatic side view of the crank-cam with attached first and second cylinder liners depicted in FIG. 33.

Referring now to FIGS. 29–32 and 33–48, the relationship between the cylinder liners 1014*a* and 1014*b* relative to the crank-cam 1016 during operation will now be described. Referring to FIGS. 33 and 34, wherein FIG. 34 is a side view of the components depicted in FIG. 33, a first cylinder liner

1014*a* is mounted vertically on a first crank journal 1072*a*. A second cylinder liner 1014*b* is perpendicularly, and thus horizontally, mounted relative to the first cylinder liner 1014*a* on a second crank journal 1072*b*. The first cylinder liner 1014*a* is restricted to a vertical reciprocating path of travel by the engine block represented by the line identified by the reference numeral 1100. Likewise, the second cylinder liner 1014*b* is restricted by the engine block to a horizontal-reciprocating path of travel represented by the line identified by the reference numeral 1098.

The reciprocating linear motion of the cylinder liners 1014*a* and 1014*b* is translated into rotary motion via the crank-cam 1016. More specifically, the crank-cam 1016 rotates on two axes of rotation. The first axis of rotation 1074 is about the centerline of the crank-cam 1016. More specifically, the first axis of rotation 1074 is defined by a line coplanar, parallel, and equidistant from the centerline 1076*a* and 1076*b* of each crank journal 1072*a* and 1072*b*. During operation, the crank-cam 1016 rotates about the first axis of rotation 1074, while the first axis of rotation 1074 is further rotated in a circular orbit 1080 around a second axis of rotation 1078. The second axis of rotation 1078 is defined as a line normal to both the centerline of the first cylinder liner 1014*a* and the second cylinder liner 1014*b* that bisects the midpoint of the strokes of each cylinder liner 1014*a* and 1014*b*. The radius of the circular orbit 1080 from the second axis of rotation 1078 is equal to one-quarter of the stroke length.

Still referring to FIGS. 33 and 34, cylinder liner 1014*a* is depicted in an extended position, where the cylinder liner 1014*a* is in a TDC and a BDC position relative to its two opposing pistons, while cylinder liner 1014*b* is depicted in a midpoint position, where the cylinder liner 1014*b* is equidistant from its respective opposing pistons. In this configuration, the second axis of rotation 1078 is collinear with the centerline of the crank journal 1072*b* and bisects the midpoint of the stroke length of cylinder liner 1014*b*. As the crank-cam rotates clockwise about the first axis of rotation 1074 while the first axis of rotation 1074 simultaneously rotates counter clockwise along the circular orbit 1080 centered around the second axis of rotation 1078, crank-journal 1072*b* and its related cylinder liner 1014*b* move linearly to the left along the horizontal path of travel 1098 of the cylinder liner 1014*b*. Likewise, crank-journal 1072*a* and its related cylinder liner 1014*a* move linearly downward along the vertical path of travel 100 of its related cylinder liner 1014*a* to the configuration shown in FIGS. 35 and 36.

Figure 35:
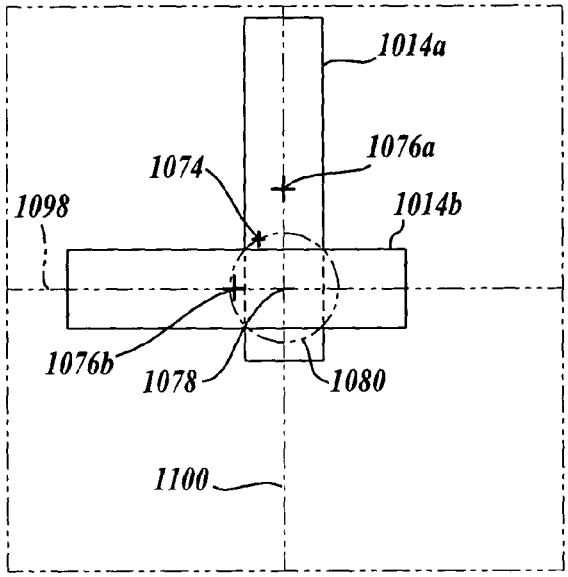
FIG. 35 is a diagrammatic elevation view of the crank-cam with attached first and second cylinder liners of FIG. 33; wherein the crank-cam has rotated 30° about a first axis of rotation from the position depicted in FIG. 33, showing the first vertically oriented cylinder liner as the liner moves linearly downward and the second horizontally oriented cylinder liner as it moves linearly to the left.
Figure 36:
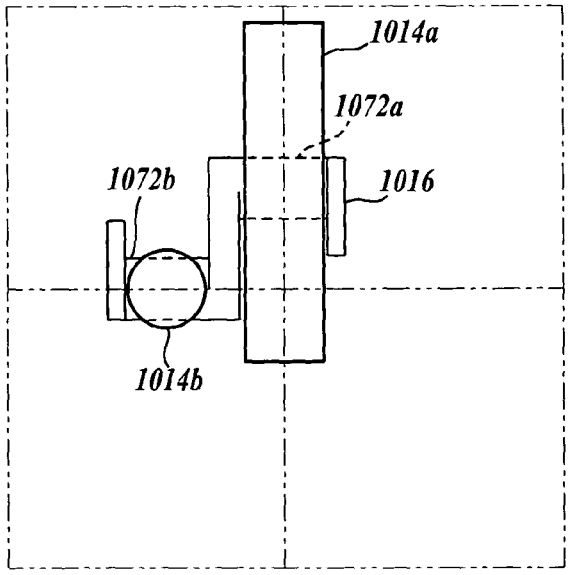
FIG. 36 is a diagrammatic side view of the crank-cam with attached first and second cylinder liners depicted in FIG. 35.

Referring to FIGS. 35 and 36, the crank-cam with attached cylinder liners 1014*a* and 1014*b* are shown after the crank-cam has rotated 30° about the first axis of rotation 1074. Thus, cylinder liner 1014*a* is depicted as it moves linearly downward and away from its extended position depicted in FIGS. 33 and 34 and cylinder liner 1014*b* is depicted as it travels left from the midpoint position depicted in FIGS. 35 and 36. As the crank-cam rotates clockwise about the first axis of rotation 1074 while the first axis of rotation 1074 simultaneously rotates counter clockwise along the circular orbit 1080 centered around the second axis of rotation 1078, crank-journal 1072*b* and its related cylinder liner 1014*b* move linearly to the left along the horizontal path of travel 1098 of the cylinder liner 1014*b*. Likewise, crank-journal 1072*a* and its related cylinder liner 1014*a* move linearly downward along the vertical path of travel 1100 of its related cylinder liner 1014*a* to the configuration shown in FIGS. 37 and 38.

Figure 37:
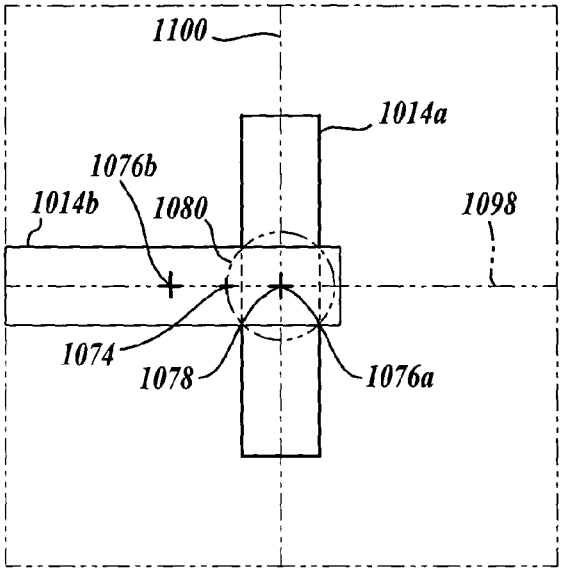
FIG. 37 is a diagrammatic elevation view of the crank-cam with attached first and second cylinder liners of FIG. 33; wherein the crank-cam has rotated 90° about the first axis of rotation from the position depicted in FIG. 33, showing the first vertically oriented cylinder liner in a mid-stroke position and the second horizontally oriented cylinder liner in a fully extended position.
Figure 38:
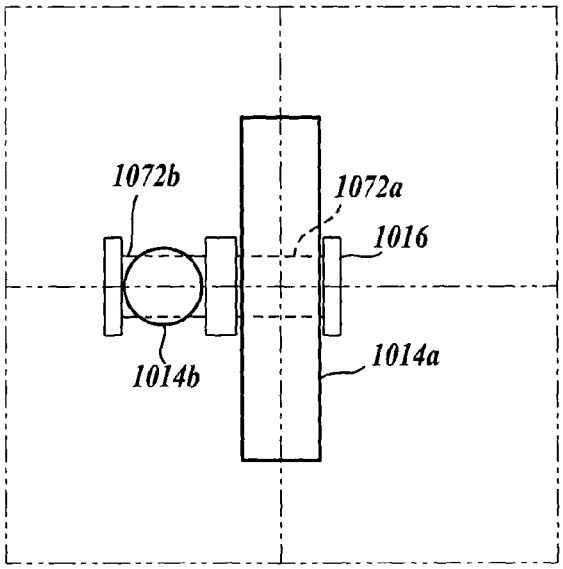
FIG. 38 is a diagrammatic side view of the crank-cam with attached first and second cylinder liners depicted in FIG. 37.

Referring now to FIGS. 37 and 38, the crank-cam with attached cylinder liners 1014*a* and 1014*b* are shown after the crank-cam has rotated 90° about the first axis of rotation 1074. Thus, cylinder liner 1014*b* is depicted in an extended position relative to its two opposing pistons, while cylinder liner 1014*a* is depicted in a midpoint position, where the cylinder liner 1014*a* is equidistant from its respective opposing pistons. In this configuration, the second axis of rotation 1078 is collinear with the centerline 1076*a* of the crank journal 1072*a* and bisects the midpoint of the stroke length of cylinder liner 1014*a*. As the crank-cam continues to rotate clockwise about the first axis of rotation 1074 while the first axis of rotation 1074 simultaneously rotates counter clockwise along the circular orbit 1080 centered around the second axis of rotation 1078, crank-journal 1072*b* and its related cylinder liner 1014*b* change direction and now move linearly to the right along the horizontal path of travel 1098 of the cylinder liner 1014*b*. Crank-journal 1072*a* and its related cylinder liner 1014*a* continue to move linearly downward along the vertical path of travel 1100 of its related cylinder liner 1014*a* to the configuration shown in FIGS. 39 and 40.

Figure 39:
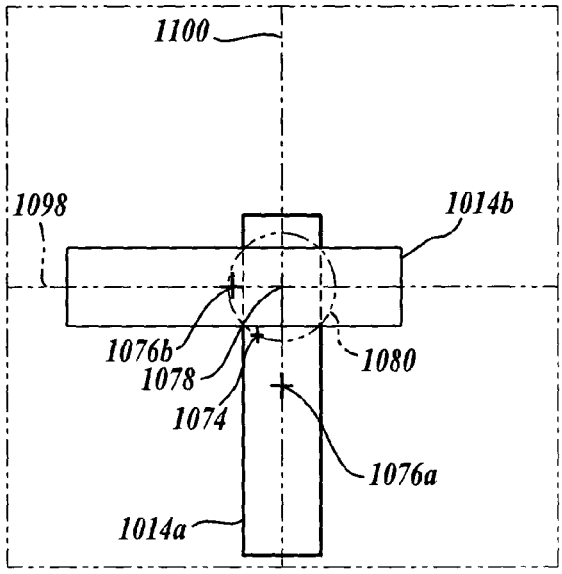
FIG. 39 is a diagrammatic elevation view of the crank-cam with attached first and second cylinder liners of FIG. 33; wherein the crank-cam has rotated 150° about the first axis of rotation from the position depicted in FIG. 33, showing the first vertically oriented cylinder liner as the liner moves linearly downward and the second horizontally oriented cylinder liner as it moves linearly to the right.
Figure 40:
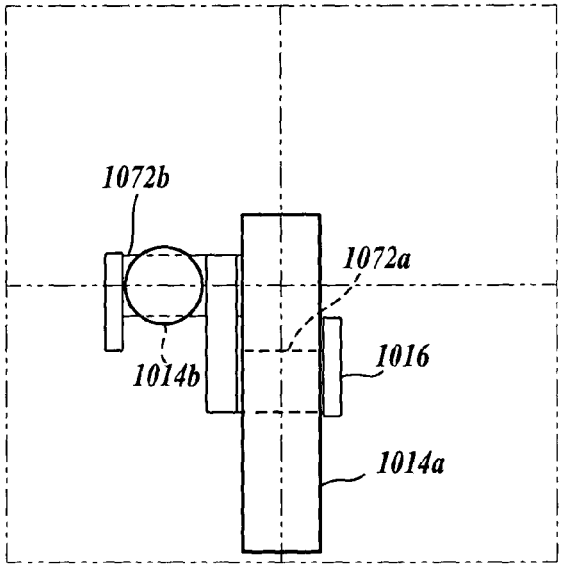
FIG. 40 is a diagrammatic side view of the crank-cam with attached first and second cylinder liners depicted in FIG. 39.

Referring now to FIGS. 39 and 40, the crank-cam with attached cylinder liners 1014*a* and 1014*b* are shown after the crank-cam has rotated 150° about the first axis of rotation 1074. Thus, cylinder liner 1014*a* is depicted as it moves linearly downward from its midway position depicted in FIGS. 37 and 38 and cylinder liner 1014*b* is shown as the cylinder liner 1014*b* travels right from its extended position depicted in FIGS. 37 and 38. As the crank-cam rotates clockwise about the first axis of rotation 1074 while the first axis of rotation 1074 simultaneously rotates counterclockwise along the circular orbit 1080 centered around the second axis of rotation 1078, crank-journal 1072*b* and its related cylinder liner 1014*b* moves linearly to the right along the horizontal path of travel 1098 of the cylinder liner 1014*b* to its midpoint position. Likewise, crank-journal 1072*a* and its related cylinder liner 1014*a* move linearly downward along the vertical path of travel 1100 of its related cylinder liner 1014*a* to the configuration shown in FIGS. 41 and 42.

Figure 41:
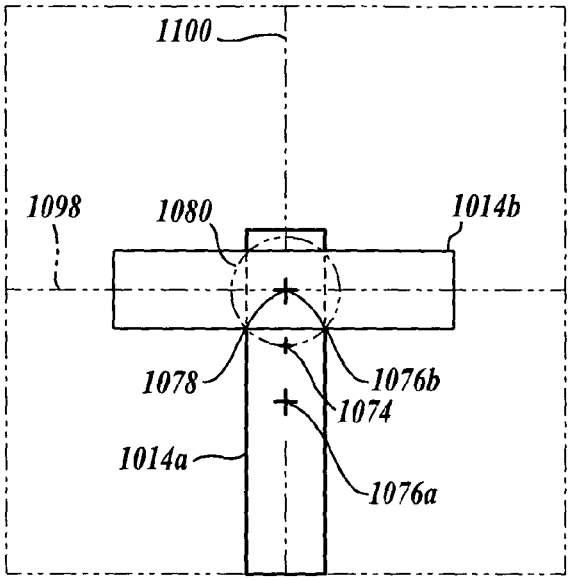
FIG. 41 is a diagrammatic elevation view showing the linear and rotary motion of a crank-cam with attached first and second cylinder liners; wherein the crank-cam has rotated 180° about a first axis of rotation from the position depicted in FIG. 33; showing the first vertically oriented cylinder in a fully extending position and the second horizontally oriented cylinder liner in a mid-stroke position.
Figure 42:
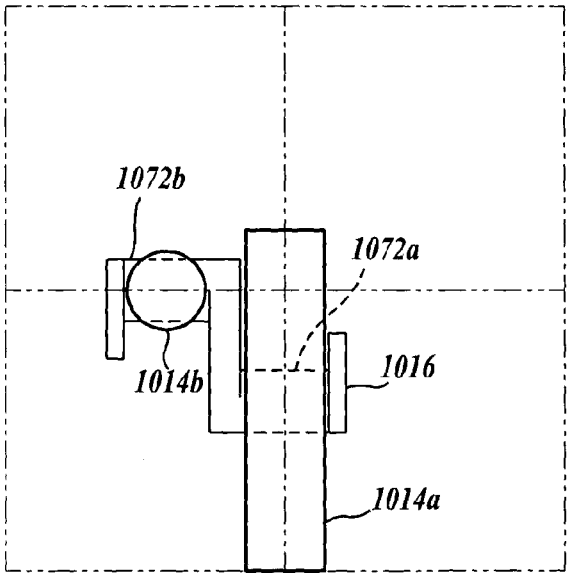
FIG. 42 is a diagrammatic side view of the crank-cam with attached first and second cylinder liners depicted in FIG. 41.

Referring to FIGS. 41 and 42, cylinder liner 1014*a* is depicted in a extended position, where the cylinder liner 1014*a* is in a TDC and BDC position relative to its two opposing pistons, while cylinder liner 1014*b* is depicted in a midpoint position, where the cylinder liner 1014*b* is equidistant from its respective opposing pistons. In this configuration, the second axis of rotation 1078 is collinear with the centerline of the crank journal of the cylinder liner 1014*b* and bisects the midpoint of the stroke length of cylinder liner 1014*b*. As the crank-cam rotates clockwise about the first axis of rotation 1074 while the first axis of rotation 1074 simultaneously rotates counter clockwise along the circular orbit 1080 centered around the second axis of rotation 1078, crank-journal 1072*b* and its related cylinder liner 1014*b* move linearly to the right along the horizontal path of travel 1098 of the cylinder liner 1014*b*. Likewise, crank-journal 1072*a* and its related cylinder liner 1014*a* move linearly upward along the vertical path of travel 100 of its related cylinder liner 1014*a* to the configuration shown in FIGS. 43 and 44.

Figure 43:
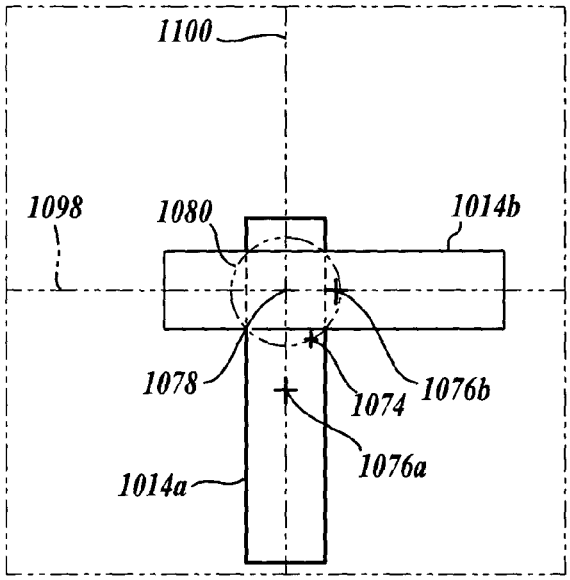
FIG. 43 is a diagrammatic elevation view of the crank-cam with attached first and second cylinder liners of FIG. 33; wherein the crank-cam has rotated 210° about a first axis of rotation from the position depicted in FIG. 33, showing the first vertically oriented cylinder liner as the liner moves linearly upward and the second horizontally oriented cylinder liner as it moves linearly to the right.
Figure 44:
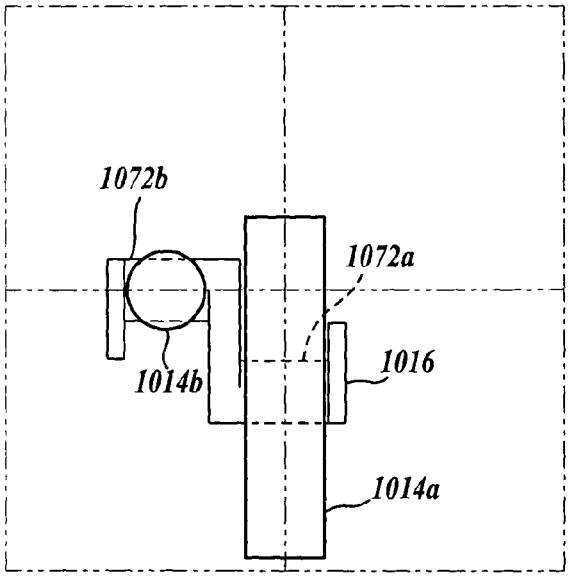
FIG. 44 is a diagrammatic side view of the crank-cam with attached first and second cylinder liners depicted in FIG. 43.

Referring to FIGS. 43 and 44, the crank-cam with attached cylinder liners 1014*a* and 1014*b* are shown after the crank-cam has rotated 210° about the first axis of rotation 1074. Thus, cylinder liner 1014*a* is depicted as it moves linearly upward and away from its extended position depicted in FIGS. 41 and 42 and cylinder liner 1014*b* is depicted as it travels right from the equidistant position depicted in FIGS. 41 and 42. As the crank-cam rotates clockwise about the first axis of rotation 1074 while the first axis of rotation 1074 simultaneously rotates counter clockwise along the circular orbit 1080 centered around the second axis of rotation 1078, crank-journal 1072*b* and its related cylinder liner 1014*b* move linearly to the right along the horizontal path of travel 1098 of the cylinder liner 1014*b*. Likewise, crank-journal 1072*a* and its related cylinder liner 1014*a* move linearly upward along the vertical path of travel 1100 of its related cylinder liner 1014*a* to the configuration shown in FIGS. 45 and 46.

Figure 45:
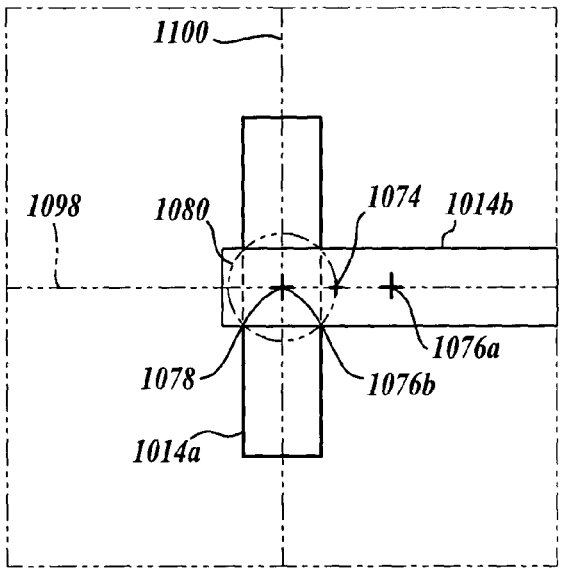
FIG. 45 is a diagrammatic elevation view of the crank-cam with attached first and second cylinder liners of FIG. 33; wherein the crank-cam has rotated 270° about the first axis of rotation from the position depicted in FIG. 33; showing the first vertically oriented cylinder line in a mid-stroke position and the second horizontally oriented cylinder liner in a fully extended position.
Figure 47:
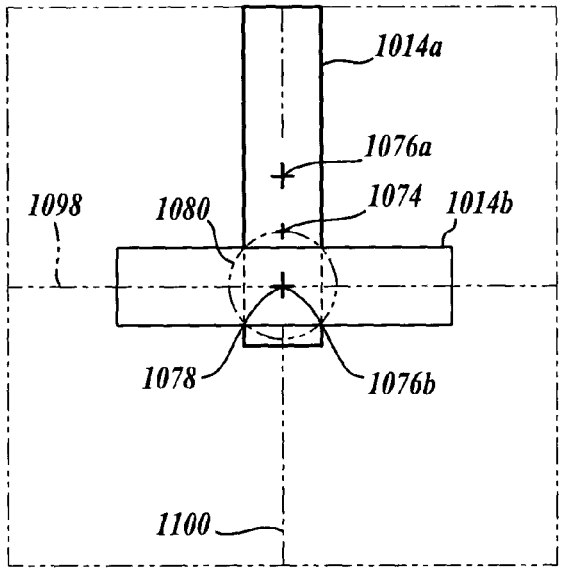
FIG. 47 is a diagrammatic elevation view of the crank-cam with attached first and second cylinder liners of FIG. 33; wherein the crank-cam has rotated 360° about the first axis of rotation from the position depicted in FIG. 33, showing the first vertically oriented cylinder liner in a fully extend position and the second horizontally oriented cylinder liner in a mid-stroke position.
Figure 46:
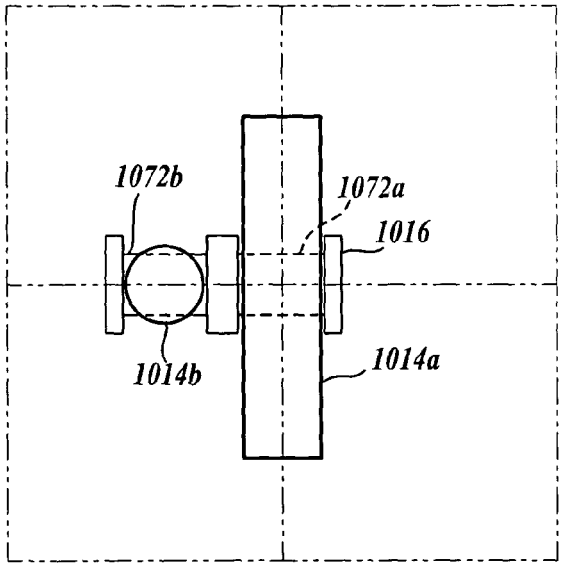
FIG. 46 is a diagrammatic side view of the crank-cam with attached first and second cylinder liners depicted in FIG. 45.
Figure 48:
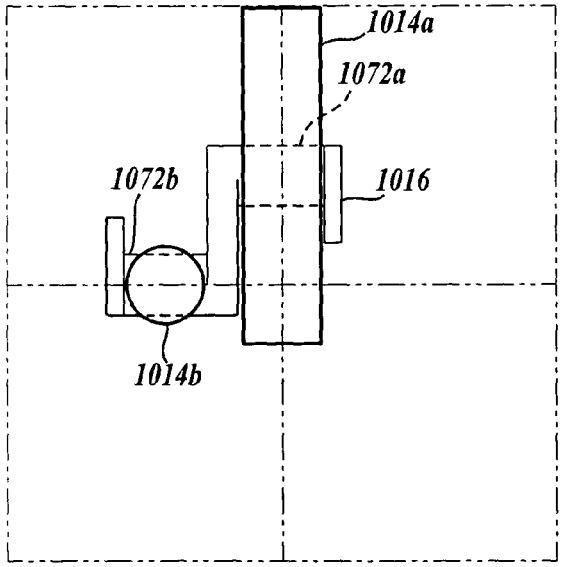
FIG. 48 is a diagrammatic side view of the crank-cam with attached first and second cylinder liners depicted in FIG. 47.

Referring now to FIGS. 45 and 46, the crank-cam with attached cylinder liners 1014*a* and 1014*b* are shown after the crank-cam has rotated 270° about the first axis of rotation 1074. Thus, cylinder liner 1014*b* is depicted in an extended position relative to its two opposing pistons, while cylinder liner 1014*a* is depicted in a midpoint position, where the cylinder liner 1014*b* is equidistant from its respective opposing pistons. In this configuration, the second axis of rotation 1078 is collinear with the centerline of the crank journal 1072*b* and bisects the midpoint of the stroke length of cylinder liner 1014*b*. As the crank-cam continues to rotate clockwise about the first axis of rotation 1074 while the first axis of rotation 1074 simultaneously rotates counter clockwise along the circular orbit 1080 centered around the second axis of rotation 1078, crank-journal 1072*b* and its related cylinder liner 1014*b* change direction and now move linearly to the left along the horizontal path of travel 1098 of the cylinder liner 1014*b*. Crank-journal 1072*a* and its related cylinder liner 1014*a* continue to move linearly upward along the vertical path of travel 1100 of its related cylinder liner 1014*a* to the configuration shown in FIGS. 47 and 48, thus returning the engine to the configuration depicted in FIGS. 33 and 34, marking the completion of a single thermodynamic cycle relative to each piston.

Referring now to FIG. 28, the interrelationship between the crank-cam 1016 and the cylinder liners 1014*a* and 1014*b* will now be described in further detail. FIG. 28 depicts a fragmentary cross-section of a reciprocating internal combustion engine 1010 formed in accordance with the present invention. The cross-section is taken substantially along the longitudinal length of the crank-cam 1016. With the cross-section taken as such, the vertically oriented-cylinder liner 1014*a* is sectioned along the centerline of the cylinder liner 1014*a*. Inasmuch as cylinder liner 1014*b* is orientated normal to cylinder liner 1014*a*, and thus in a horizontal orientation, the cross-section passes laterally through cylinder liner 1014*b* midway between the ends of the cylinder liner 1014*b*. Cylinder liner 1014*a* is shown in a BDC configuration relative to piston 1012*a* (not shown) and in a TDC relationship relative to piston 1012*b*.

Cylinder liner 1014*b* is shown equidistant from its opposing pistons. With the crank-cam 1016 configured as such, the lobe 1054*a* associated with the crank journal 1072*a* has engaged the valve stem 1066*a* of the exhaust valve 1052 associated with piston 1012*a*, lifting the valve 1052 off of its seat 1034. The lobe 1054*b* associated with the crank journal 1072*b* of cylinder liner 1014*b* is shown equidistant between the valve stems of the opposing substantially stationary pistons. Inasmuch as cylinder liner 1014*b* is midpoint between the opposing pistons associated with the cylinder liner 1014*b*, the cylinder liner 1014*b* is not currently undergoing scavenging. Accordingly, the exhaust gas passageways 1037 in the engine block 1013 are not yet configured in fluid communication with the exhaust gas passageways 1036 (see FIG. 23) of the cylinder liner 1014*b*.

Figure 49:
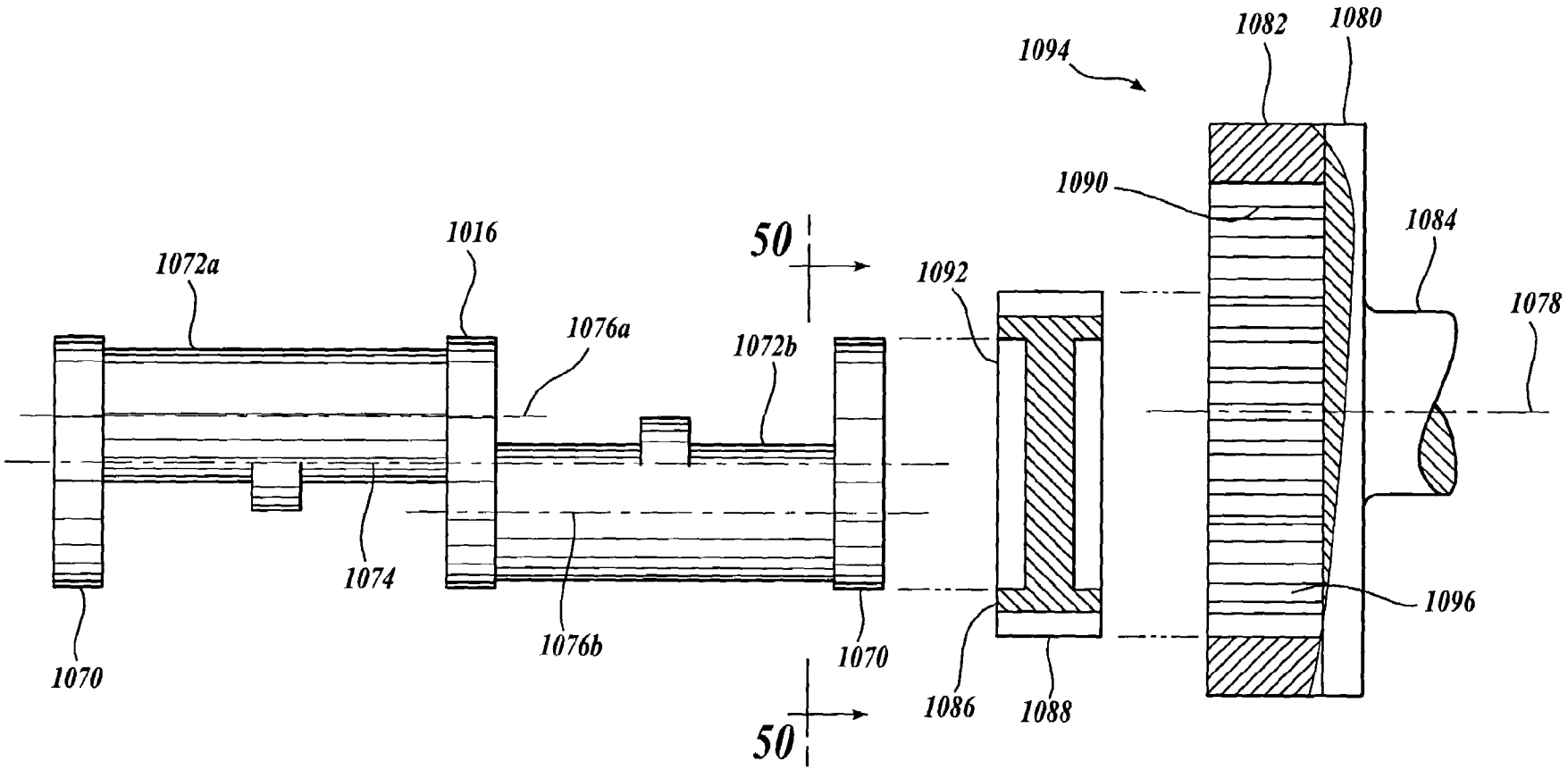
FIG. 49 is an exploded view of a crank-cam, out-drive gear, out-drive reduction gear, and power take-off flange, suitable for use with the illustrated embodiment of the present invention, wherein the out-drive gear is shown in cross-section and the out-drive reduction gear is shown with a partial cut-away.

Referring now to FIG. 49, the components of an out-drive system 1094 will now be described. The out-drive system 1094 translates the reciprocating and rotational motion of the crank-cam 1016 to rotational motion about a centerline of a power take-off shaft 1084. The out-drive system 1094 includes an out-drive reduction gear 1082 and an out-drive gear 1086. The out-drive reduction gear 1082 further includes internal gear teeth 1090 disposed along the peripheral cylindrical wall of an out-drive gear receiving recess 1096. The out-drive reduction gear 1082 is rigidly coupled to a power take-off drive flange 1080 by well-known means, such as fasteners. The power take-off shaft 1084 is perpendicularly and concentrically attached to the power take-off drive flange 1080. The centerline of the power take-off shaft 1084 is collinear with the second axis of rotation 1078. The out-drive gear 1086 has external gear teeth 1088 shaped and dimensioned to communicate with the internal gear teeth 1090 of the out-drive reduction gear 1082. The out-drive gear 1086 has a crank web 1070 receiving recess 1092 shaped and dimensioned to receive the circular shaped crank web 1070. The crank web 1070 is rigidly coupled to the receiving recess 1092 of the out-drive gear 1086 by means well known in the art, such as by fasteners.

In light of the above description of the components of the out-drive system 1094, the operation of the out-drive system 1094 will now be described. Referring to FIGS. 50–55, a letter A is used as an arbitrarily selected reference point on the out-drive gear 1086 and a letter B is used as an arbitrarily selected reference point on the out-drive reduction gear 1082. A reference letter C marks the center point of crank journal 1072*b*, and thus the cylinder liner 1014*b* (not shown), and reference letter D marks the centerpoint of the crank journal 1072*a* and thus the cylinder liner 1014*a* (not shown).

Figure 50:
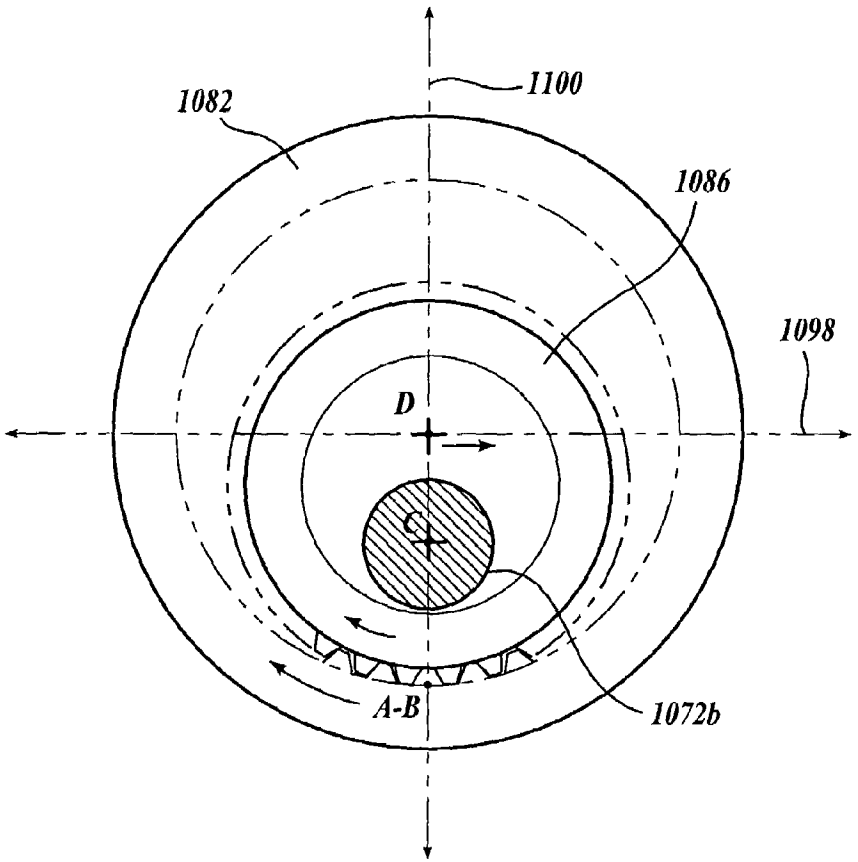
FIG. 50 is a planar cross-sectional end view of the out-drive gear, out-drive reduction gear, power take-off flange, and crank-cam shown in FIG. 49, taken substantially through SECTION 50—50 of FIG. 49.

Referring now to FIG. 50, the out-drive gear 1086 is disposed within the out-drive reduction gear 1082, so that the external gear teeth 1088 of the out-drive gear 1086 intermesh with the internal gear teeth 1090 of the out-drive reduction gear 1082. As the out-drive reduction gear 1082 and the out-drive gear 1086 rotate clockwise while intermeshing, reference point D on the out-drive gear 1086 reciprocates along a horizontal reference line 1098. The reference line 1098 represents the linear path of the cylinder liner 1014*b* (not shown) and is the same reference line depicted in FIGS. 33–48. Likewise, reference point C reciprocates along a vertical reference line 1100. Vertical reference line 1100 represents the linear path of the cylinder liner 1014*a* (not shown) and is the same reference dine depicted in FIGS. 33–48. As the out-drive reduction gear 1082 and out-drive gear 1086 rotate clockwise, reference point D moves to the right and reference point C moves upward, along their reference lines 1098 and 1100, respectively.

Figure 51:
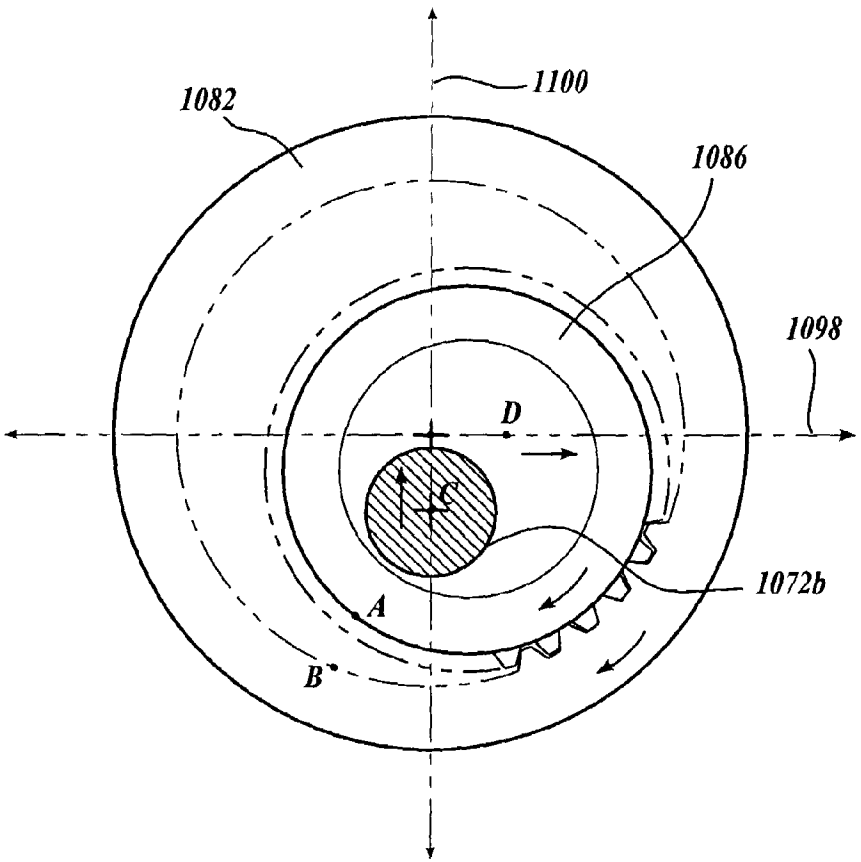
FIG. 51 is a planar end view of the crank-cam, out-drive gear, out-drive reduction gear, and power take-off flange shown in FIG. 49, wherein the out-drive reduction gear has rotated 1/16 of a turn from its position depicted in FIG. 49.

Referring now to FIG. 51, the out-drive gear 1086 has rotated one-eighth of a turn clockwise while the out-drive reduction gear 1082 has rotated one-sixteenth of a turn clockwise from the configuration depicted in FIG. 50. As is apparent from reference to FIG. 51, reference points C and D still lie upon their respective reference lines 1100 and 1098, thereby maintaining the linear path of travel of the centers of the crank journals and, thus, their attached cylinder liners.

Figure 52:
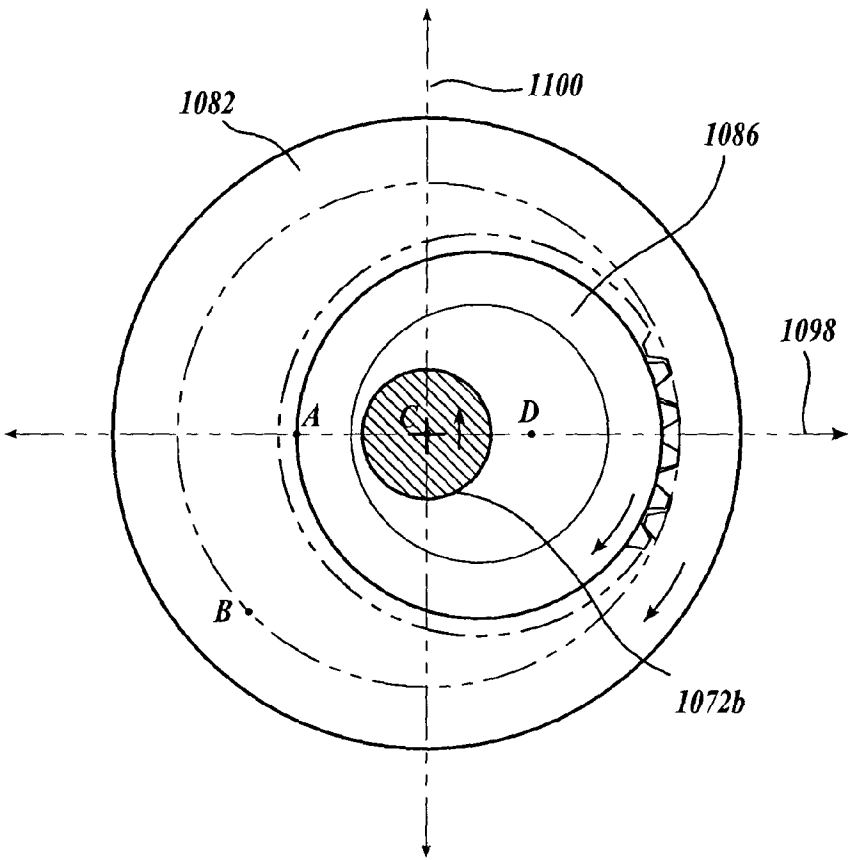
FIG. 52 is a planar end view of the crank-cam, out-drive gear, out-drive reduction gear, and power take-off flange shown in FIG. 49, wherein the out-drive reduction gear has rotated 1/8 of a turn from its position depicted in FIG. 49.

Referring to FIG. 52, the out-drive gear 1086 has now rotated one-quarter of a turn clockwise, while the out-drive reduction gear 1082 has rotated one-eighth of a turn clockwise from the configuration depicted in FIG. 50. By referring to FIG. 52, it is apparent that reference point C has moved vertically upward along the linear reference line 1100, while reference point D has moved horizontally to the right along the horizontal reference line 1098 from their respective positions depicted in FIG. 51. Reference point D is currently at its "zenith"; therefore the respective cylinder liner is in an extended position, with the cylinder liner at a TDC and BDC position with reference to the substantially stationary opposing pistons associated with the cylinder liner. As the out-drive gear 1082 is rotated further clockwise, reference point D transitions from a rightward direction of travel to a leftward direction of travel along the reference line 1098.

Figure 53:
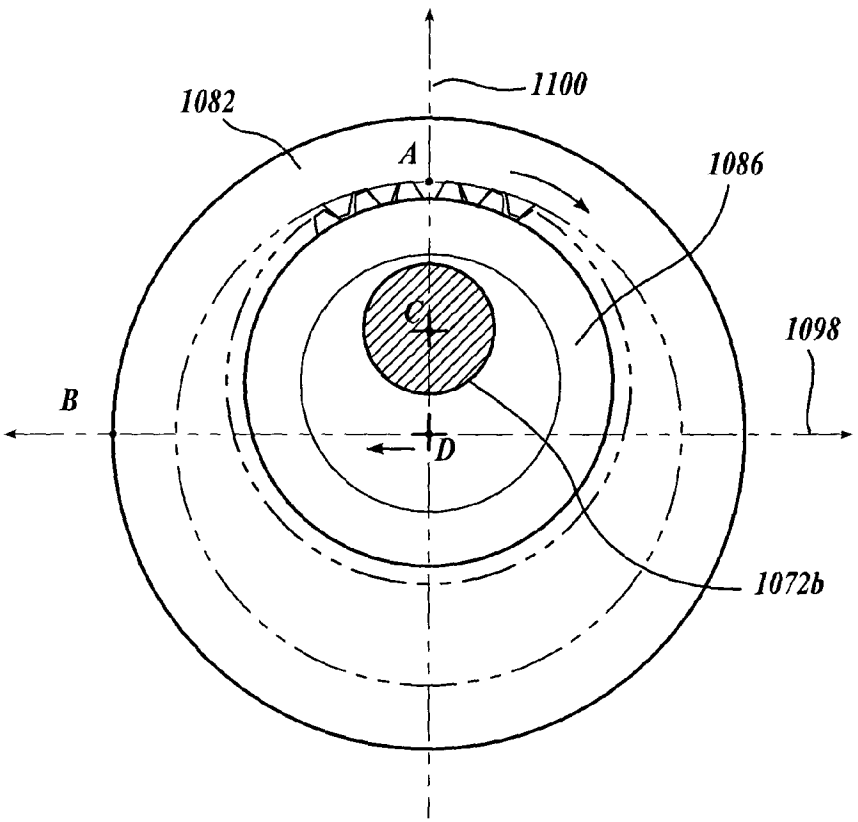
FIG. 53 is a planar end view of the crank-cam, out-drive gear, out-drive reduction gear, and power take-off flange shown in FIG. 49, wherein the out-drive reduction gear has rotated 1/4 of a turn from its position depicted in FIG. 49.

Referring now to FIG. 53, the out-drive gear 1086 has rotated one-half turn and the out-drive reduction gear 1082 has rotated one-quarter turn. Reference point C is now at its zenith; therefore the corresponding cylinder liner is in an extended position with the cylinder liner at its TDC and BDC position with respect to the two substantially stationary opposing pistons associated with the cylinder liner. As the out-drive gear 1082 is rotated further clockwise, reference point C transitions from a upward direction of travel to a downward direction of travel along the reference line 1100.

Figure 54:
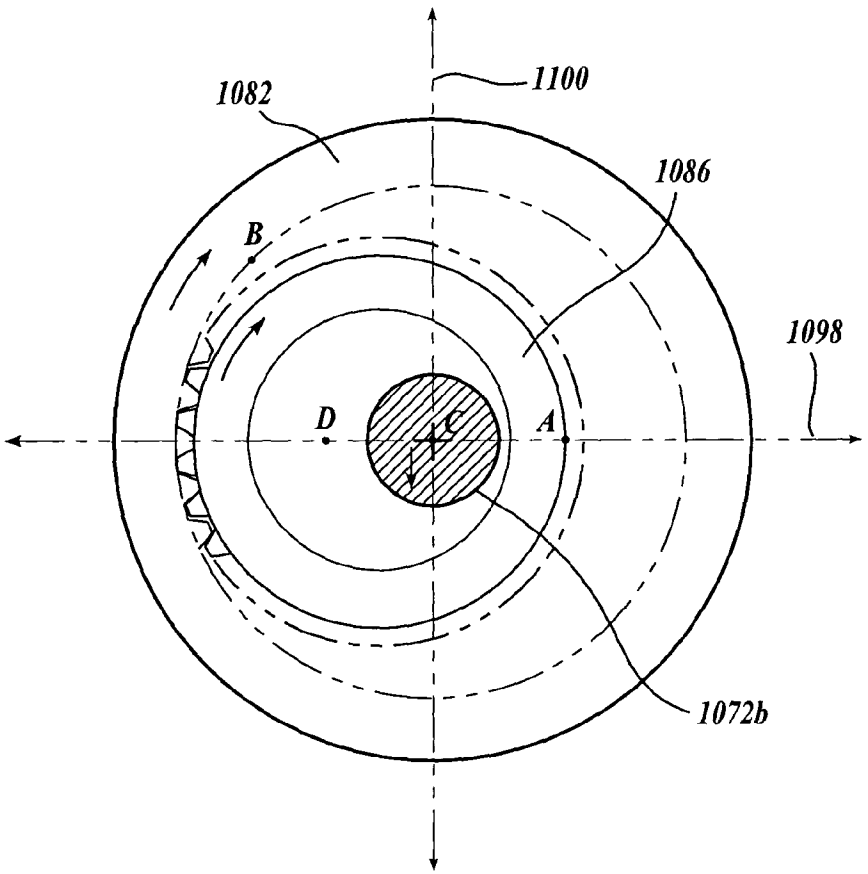
FIG. 54 is a planar end view of the crank-cam, out-drive gear, out-drive reduction gear, and power take-off flange shown in FIG. 49, wherein the out-drive reduction gear has rotated 3/8 of a turn from its position depicted in FIG. 49.

Referring now to FIG. 54, the out-drive gear 1086 has rotated three-quarters of a turn. The out-drive reduction gear 1082 has rotated three-eighths of a turn. Reference point C is now at the center of the reference path 1100. This center position indicates that the cylinder liner associated with reference point C is now equidistant from the substantially stationary pistons associated with the cylinder liner. Correspondingly, reference point D is now at a zenith. Therefore, the cylinder liner associated with reference point D is at an extended position and thus, at a TDC and BDC position with regard to the substantially stationary opposing pistons associated with the cylinder liner.

Figure 55:
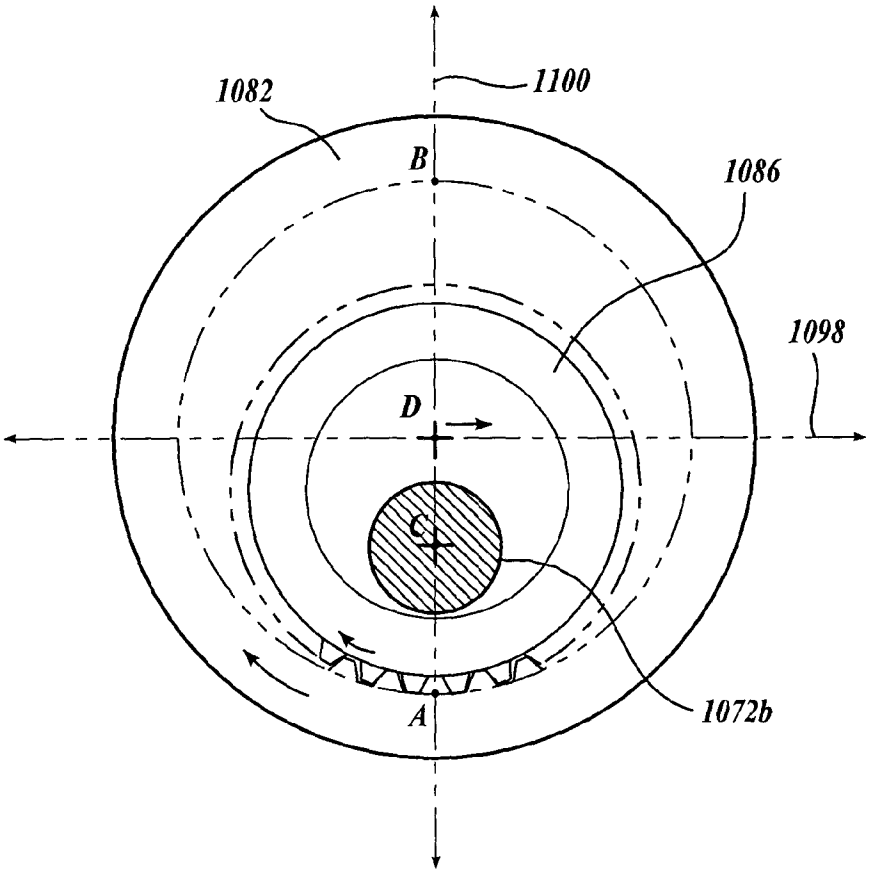
FIG. 55 is a planar end view of the crank-cam, out-drive gear, out-drive reduction gear, and power take-off flange shown in FIG. 49, wherein the out-drive reduction gear has rotated 1/2 of a turn from its position depicted in FIG. 49.

Referring now to FIG. 55, the out-drive gear 1086 has rotated one full turn while the out-drive reduction gear 1082 has rotated one-half turn, as indicated by the relative positions of the reference points A and B. In one full rotation of the out-drive gear 1086, each individual piston has gone through one complete thermodynamic cycle. Through the manipulation of diameters and the possible amount of gear teeth involved, different reduction ratios of engine RPM to power take-off shaft 1084 RPM are possible as should be apparent to one skilled in the art. In the illustrated embodiment depicted in FIGS. 50–55, the out-drive gear 1086 has 30 teeth and the out-drive reduction gear 1082 has 40 teeth. In one 360° rotation of the out-drive gear 1086, the out-drive gear 1086 cams 60 teeth of the out-drive reduction gear 1082. The out-drive reduction gear 1082 has 40 teeth, therefore it rotates in the process the distance of 20 teeth, which results in a 180° rotation of the out-drive reduction gear 1082 and attached shaft. Thereby a ratio of 2:1 reduction in RPM is accomplished.

Figure 58:
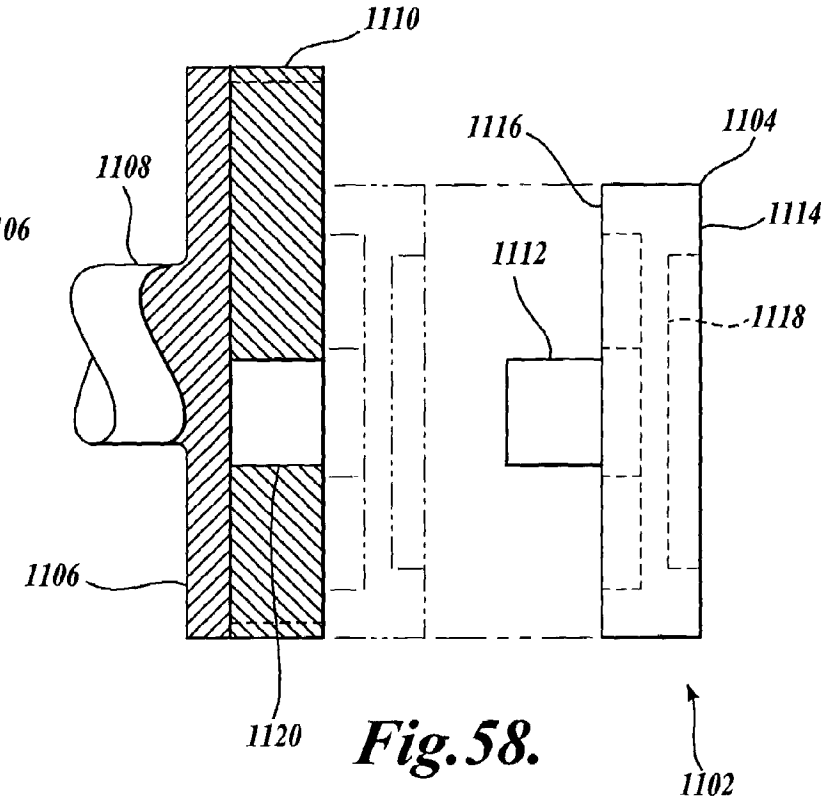
FIG. 58 is an exploded side view of the direct out-drive and the gliding block shown in FIG. 56, and in addition showing a direct out-drive adapter.
Figure 56:
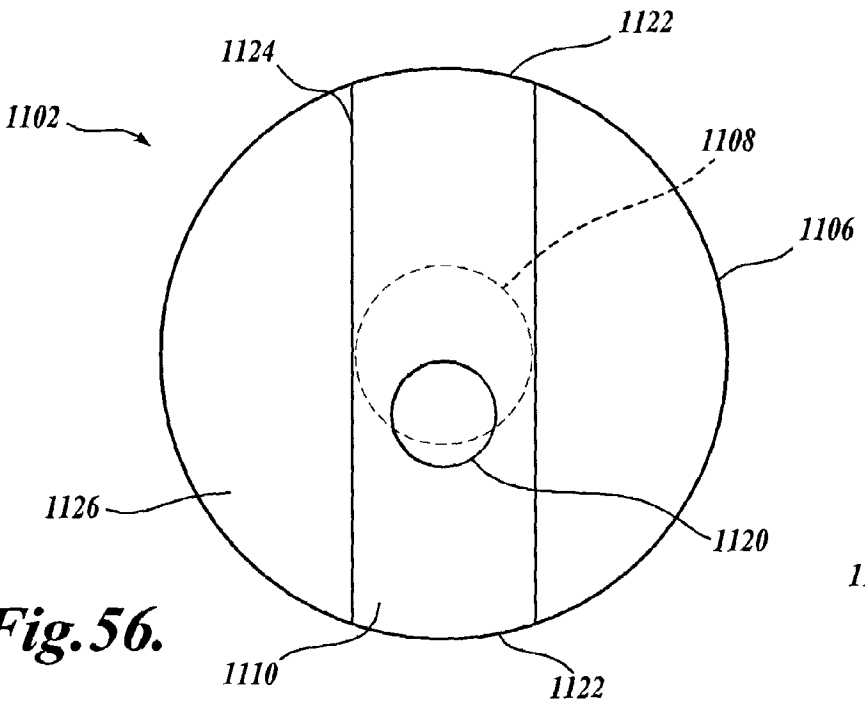
FIG. 56 is a planar end view of a direct out-drive and a gliding block formed in accordance with the present invention.
Figure 57:
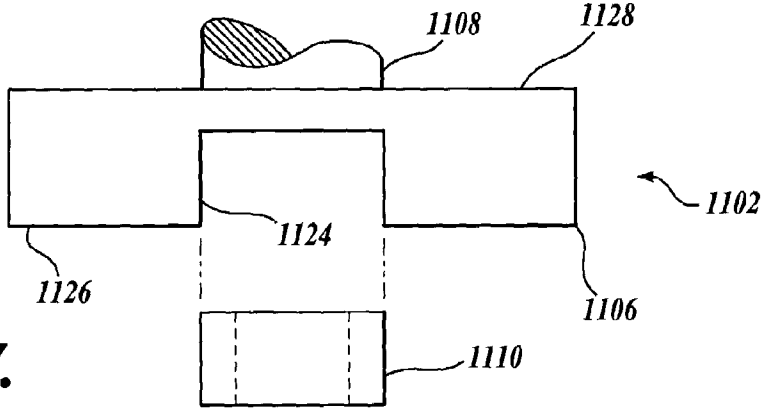
FIG. 57 is an exploded top view of the direct out-drive and the gliding block shown in FIG. 56.

Often it is desirable to have a direct out-drive shaft that rotates at the same RPM as the engine or more specifically, at the crank-cam RPM. The direct out-drive shaft may be used to drive accessories, such as a distributor. Referring to FIGS. 56–58, a direct out-drive system 1102 formed in accordance with and suitable for use with the present invention is illustrated. The direct out-drive system 1102 includes a direct out-drive adapter 1104, a direct out-drive 1106, a direct out-drive shaft 1108, and a gliding block 1110. These components work in combination to convert the rotating and reciprocating motion of the crank-cam to a rotational movement in the direct out-drive output shaft 1108.

The configuration of the direct out-drive adapter 1104 will now be discussed. The direct out-drive adapter 1104 is a disk-shaped member having inner (facing the engine) and outer (facing away from the engine) annular surfaces 1114 and 1116, respectively. Formed adjacent to the inner annular surface 1114 is a crank web receiving recess 1118 where one of the crank webs 1070 (see FIG. 31) is received and rigidly fastened therewithin. Perpendicularly and concentrically mounted relative to the outer annular surface 1116 is a drive shaft 1112. The drive shaft 1112 is received within a bore 1120 located within the gliding block 1110.

The configuration of the gliding block 1110 will now be discussed. The gliding block 1110 is generally a rectangular-shaped block structure having arcuate ends 1122 formed to match the outer circular circumference of the direct out-drive 1106. The length and width of the gliding block 1110 is selected to match the length and width of a channel 1124 formed in the direct out-drive 1106, thereby allowing the gliding block 1110 to be received within the channel 1124. Preferably, a polished finish is applied to the contact surfaces of both the gliding block 1110 and the channel 1124 of the direct out-drive 1116 of which it rides within, to reduce friction and wear.

The direct out-drive 1106 is a disk-shaped member having inner (facing the engine) and outer (facing away from the engine) circular planar surfaces 1126 and 1128, respectively. The channel 1124 for receiving the gliding block 1110 is formed on the inner planar surface 1126. A direct drive output shaft 1108 is perpendicularly and concentrically mounted on the outer planar surface 1128.

Figure 59:
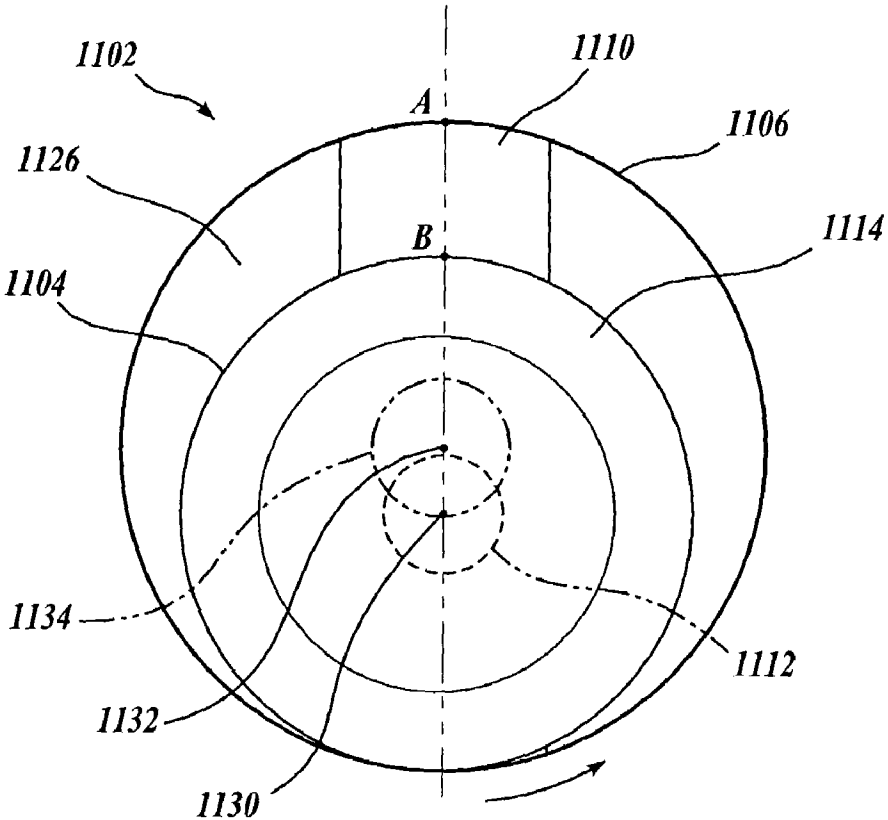
FIG. 59 is a planar end view of the direct out-drive, gliding block, and direct out-drive adapter shown in FIG. 58.

The operation of the direct out-drive system 1102 will now be described in reference to FIGS. 59–62. Referring now to FIG. 59, a planar end view of the direct out-drive system 1102 is shown, depicting the inner planar surface 1114 of the direct out-drive adapter 1104 with the crank-cam removed and the inner circular planar surface 1126 of the direct out-drive 1106. The drive shaft 1112 of the adapter 1104 is shown in phantom. The gliding block 1110 is shown; however the majority of the gliding block 1110 is obscured by the adapter 1104. The letter A is an arbitrarily selected reference point on the outer circumference of the direct out-drive 1106, and the letter B is an arbitrarily selected reference point on the direct out-drive adapter 1104.

Still referring to FIG. 59, the center of the direct out-drive adapter 1104 is indicated by reference numeral 1130. The center of the direct out-drive 1106 is indicated by reference numeral 1132. The direct out-drive adapter 1104 rotates about its center 1130, while also revolving around the center 1132 of the direct out-drive 1106 along a circular orbit 1134, the circular orbit 1134 having a radius equal to ¼ of the stroke length.

Figure 60:
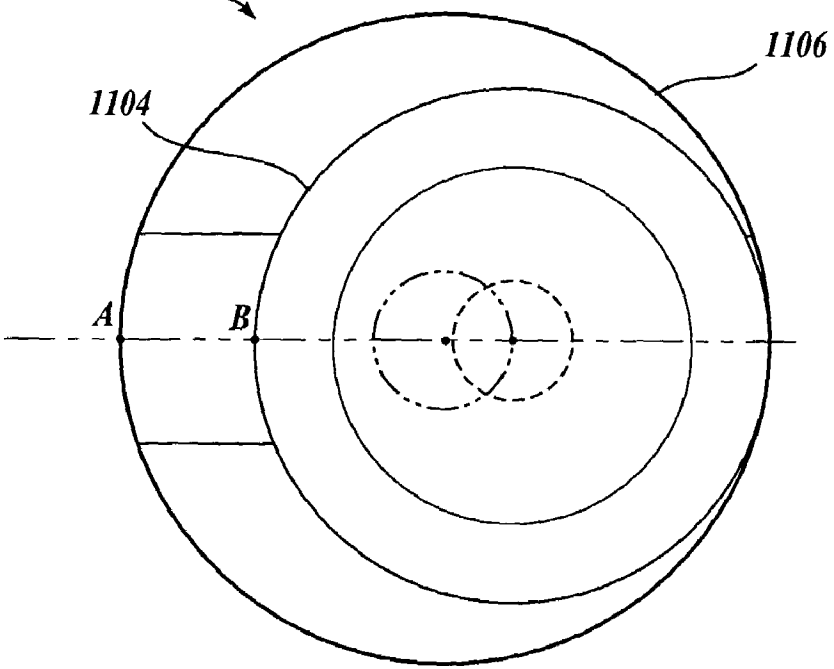
FIG. 60 is a planar end view of the direct out-drive, gliding block, and out-drive adapter shown in FIG. 59, where the direct out-drive has rotated 90° from its position depicted in FIG. 59.
Figure 62:
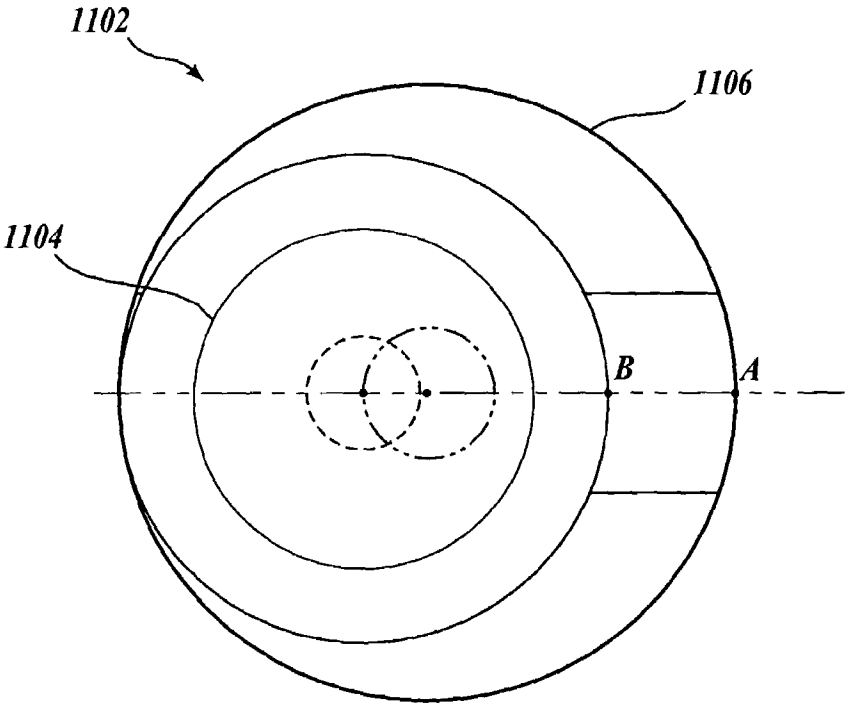
FIG. 62 is a planar end view of the direct out-drive, gliding block, and out-drive adapter shown in FIG. 59, where the direct out-drive has rotated 270° from its position depicted in FIG. 59.
Figure 61:
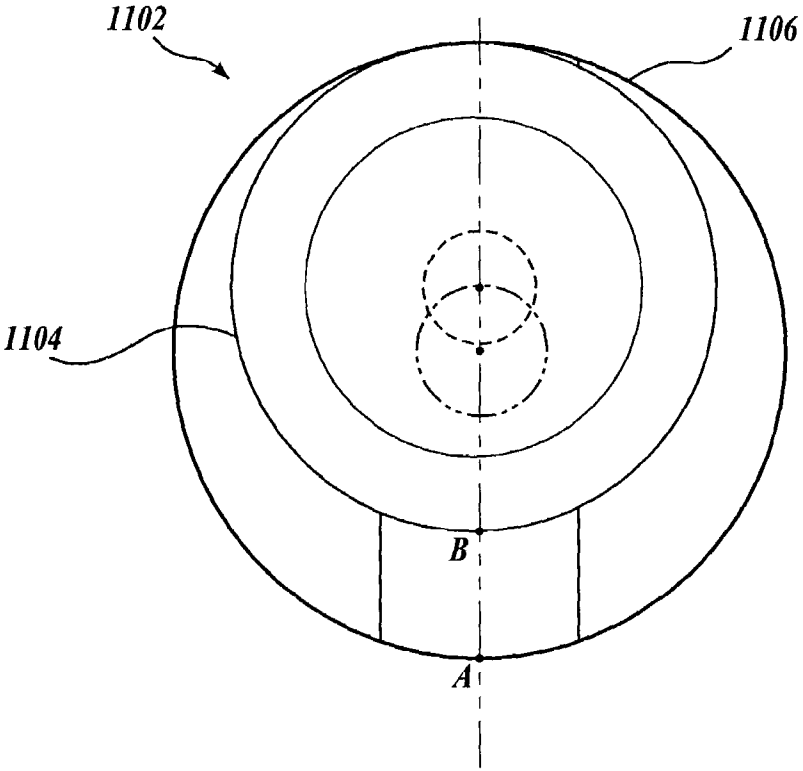
FIG. 61 is a planar end view of the direct out-drive, gliding block, and out-drive adapter shown in FIG. 59, where the direct out-drive has rotated 180° from its position depicted in FIG. 59.

FIG. 60 shows the direct out-drive system 1102 rotated ¼ of a turn counterclockwise from that depicted in FIG. 59. FIG. 61 shows the direct out-drive system 1102 rotated ½ of a turn counterclockwise from that depicted in FIG. 59. FIG. 62 shows the direct out-drive system 1102 rotated ¾ of a turn counterclockwise from that depicted in FIG. 59. Inasmuch as the reference letters A and B remain radially aligned during the rotation of the direct out-drive adapter 1104 and direct out-drive 1106, as shown in FIGS. 59–62, it should be apparent to one skilled in the art that both the adapter 1104 and the direct out-drive 1106 rotate at the same rate. Therefore, the direct out-drive output shaft 1108 (see FIG. 58) may be used to drive components requiring rotary input rotating at engine RPM.

From examination of FIGS. 59–62, it appears that the sliding block 1110 does not move during operation. This would be true if the parts of the engine were constructed so as to have zero tolerances. However, in the event the ports are constructed so as to be within selected tolerances, as is typically the case, the sliding block 1110 would undergo slight movements within the channel 1124, thereby "absorbing" the tolerances of the parts, mitigating vibration and reducing the potential of the parts' binding.

Figure 63:
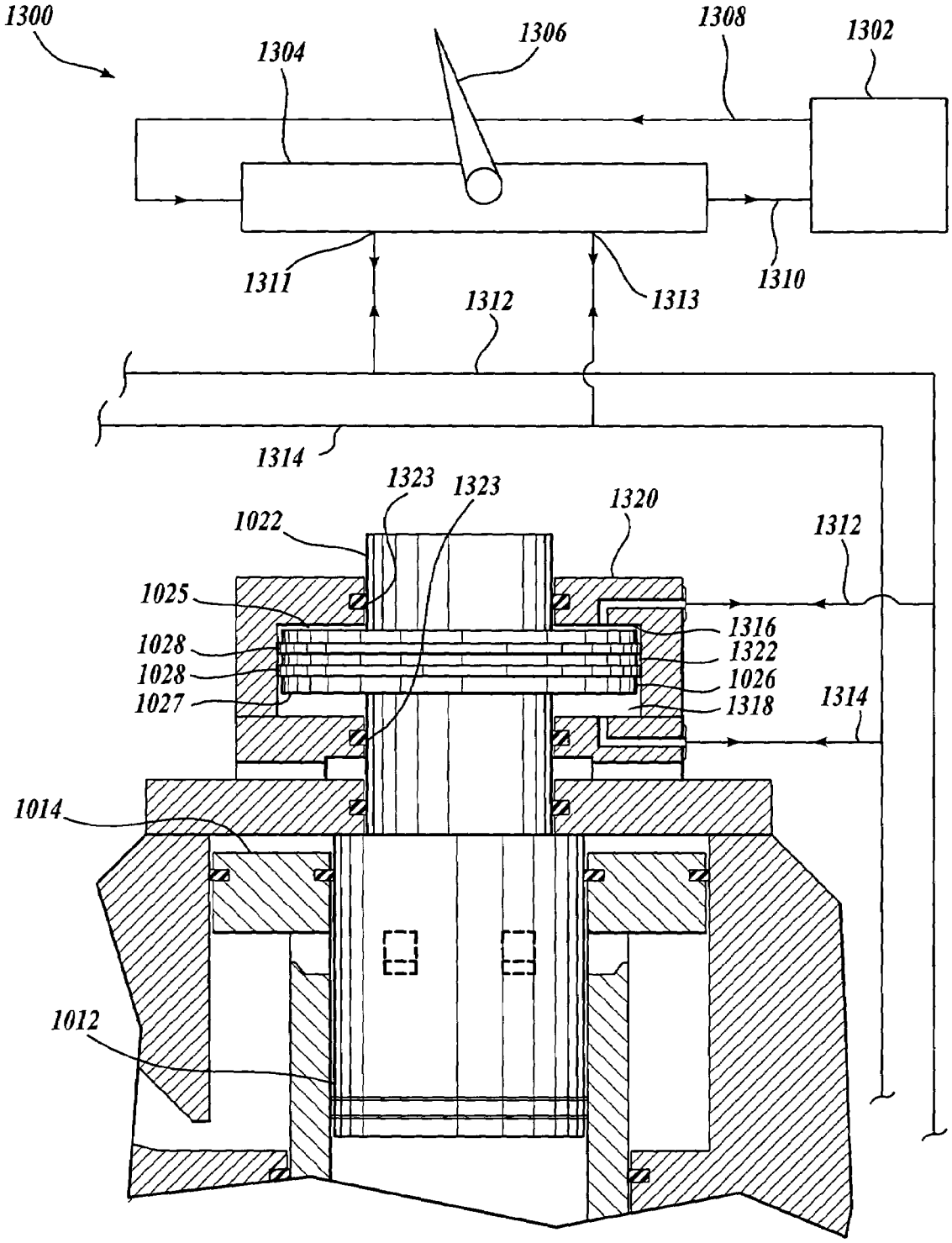
FIG. 63 is a diagrammatic fragmentary view of one embodiment of a compression ratio and power setting control system formed in accordance with the present invention.
Figure 64:
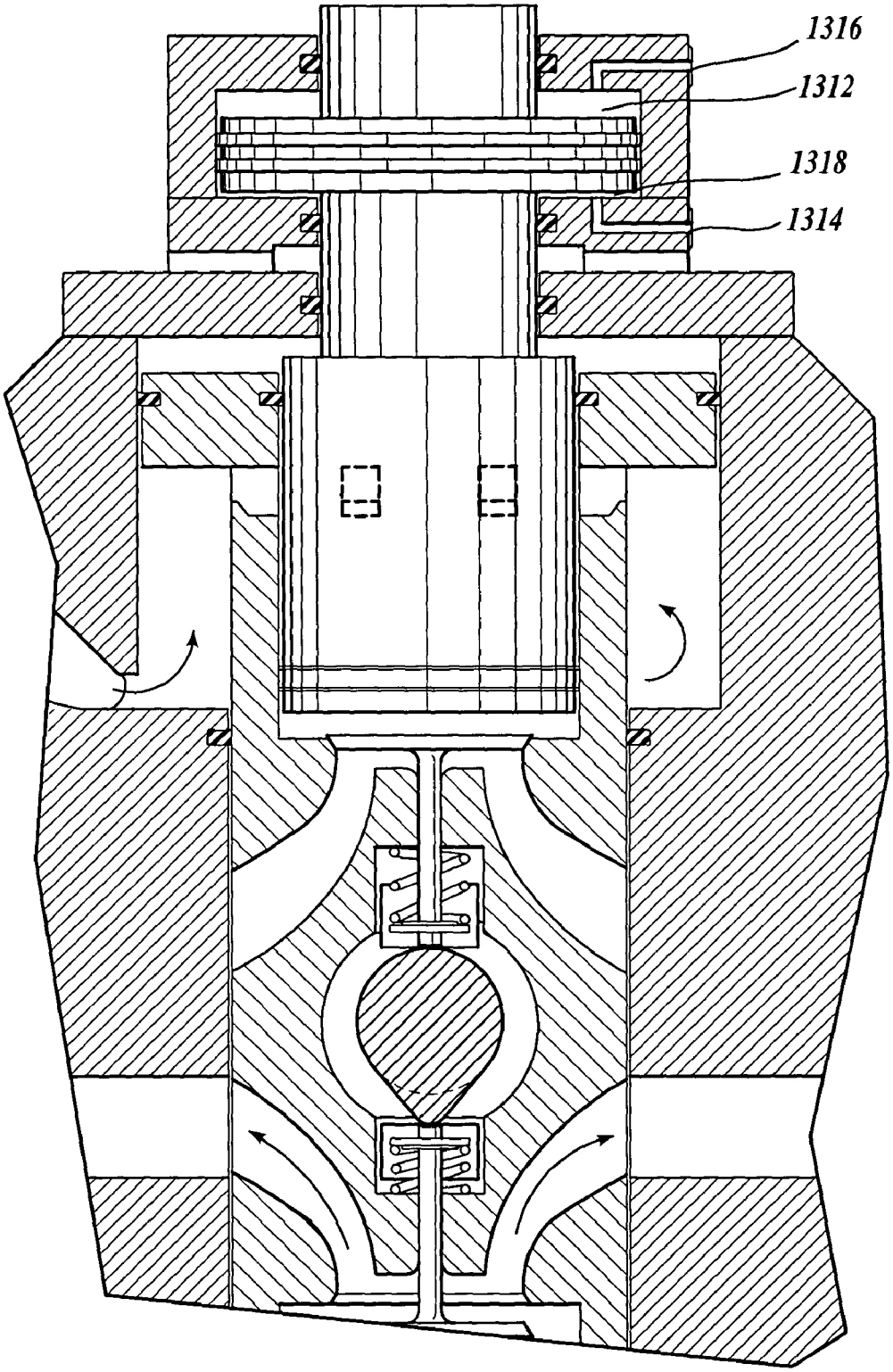
FIG. 64 is a fragmentary cross-sectional view of one of the reciprocating cylinder liners and related components shown in FIG. 21, illustrating the reciprocating cylinder liner at a TDC position with respect to a substantially stationary piston configured in its high compression ratio, low power setting position.

Referring now to FIG. 63, the compression ratio and power setting control system 1300 of the illustrated embodiment of the present invention will now be described. The control system 1300 allows the compression ratio and power setting of the engine to be simultaneously adjusted during operation. More specifically, under low boost conditions, the control system 1300 allows the engine to be selectively configured to have a low compression ratio, such as 10:1 at a high power setting (full throttle), and a high compression ratio, such as 15:1 at a low power setting (idle). Under high boost conditions, the control system 1300 allows the engine to be selectively configured to have a low compression ratio, such as 5.6:1 at a high power setting (full throttle), and a high compression ratio, such as 15:1 at a low power setting (idle). The control system 1300 controls the compression ratio and power setting of the engine by selectively manipulating the axial position of the substantially stationary pistons 1012 of the engine, as will be described more fully below. In the illustrated embodiment, the axial position of the pistons is adjusted by selectively providing pressurized fluid to either the upper or lower annular surfaces 1025 and 1027 of the control plate 1026 circumferentially attached to the piston 1012, thereby forcing the piston 1012 to move axially along its axis.

The major components of the control system 1300 include a hydraulic pump 1302, a control valve 1304, the control plate 1026, and a control plate housing 1320. The hydraulic pump 1302 is coupled in fluid flow communication with the control valve 1304 by a feed line 1308 and a return line 1310. The hydraulic pump 1302 may be any suitable device known in the art for providing a pressurized control fluid. In operation, the hydraulic pump 1302 discharges pressurized control fluid, such as a hydraulic oil, through the feed line 1308 to the control valve 1304. Likewise, the return line 1310 returns spent control fluid back to the hydraulic pump 1302 for re-pressurization.

The control valve 1304 selectively controls the flow of control fluid to the control plate housing 1320, thereby allowing the selective manipulation of the axial position of the substantially stationary piston 1012. The control valve 1304 is actuatable between three positions. In a first position, the pressurized control fluid obtained from the hydraulic pump 1302 via the feed line 1308 is delivered to a first port 1311, while a second port 1313 is configured to be in fluid communication with the return line 1310 of the hydraulic pump 1302. In a second position, the flow is reversed, and the pressurized control fluid obtained from the hydraulic pump 1302 via the feed line 1308 is delivered to the second port 1313, while the first port 1311 is configured to be in fluid communication with the return line 1310 of the hydraulic pump 1302. In a third position, the control valve 1304 is placed in a no flow position, wherein the control fluid is blocked from being received or discharged from the ports 1311 and 1313. The control valve is actuated among the three positions by any suitable means known in the art, such as a lever 1306. Preferably, the position of the lever 1306 is controlled in direct relationship to a position of a power setting device, such a throttle or a gas pedal.

The control plate housing 1320 includes a cylindrical cavity 1322 that houses the control plate 1026. The control plate bisects the cavity 1322 into an upper chamber 1316 and a lower chamber 1318, wherein oil control rings 1028 circumferentially disposed on the edge of the control plate 1026 allow the upper and lower chambers 1316 and 1318 to be independently pressurized. Additional oil control rings 1323 prevent any pressurized fluid contained within the cavity 1322 from escaping therefrom. Upper chamber piping 1312 couples the upper chamber 1316 associated with each piston 1012 in fluid communication with the first port 1311 of the control valve 1304. Lower chamber piping 1314 couples the lower chamber 1316 associated with each piston 1012 in fluid communication with the second port 1313 of the control valve 1304.

In light of the above description of the elements of the compression ratio and power setting control system 1300, the operation will now be described. Still referring to FIG. 63, when the control valve 1304 is placed in the first position, pressurized fluid obtained from the hydraulic pump 1302 is directed into the upper chamber 1316. The pressurized fluid acts upon the upper annular surface 1025 of the control plate 1026, thereby forcing the control plate 1026 and rigidly attached piston 1012 downward along the axis of the piston 1012 and into the position depicted in FIG. 64. Conversely, when the control valve 1304 is placed in the second position, pressurized fluid obtained from the hydraulic pump 1302 is directed into the lower chamber 1318. The pressurized fluid acts upon the lower annular surface 1027 of the control plate 1026, thereby forcing the control plate 1026 and rigidly attached piston 1012 upward along the axis of the piston 1012, transferring the piston from the configuration depicted in FIG. 64 to that depicted in FIG. 63.

Manipulation of the axial position of the piston 1012 adjusts the compression ratio of the engine. More specifically, the stroke length of the cylinder liner 1014 remains constant. Therefore, by adjusting the axial position of the piston 1012, the distance between the crown of the piston 1012 and the opposing inner surface of the cylinder liner 1014 is reduced at TDC. Therefore, substantially the same volume of combustion gases is compressed into a relatively smaller final volume when the cylinder liner reaches a TDC position relative to the piston, thereby raising the compression ratio as should be apparent to one skilled in the art. For example, referring to FIG. 64 in comparison to FIG. 25, both of which are depicted at a TDC position relative to the shown piston 1012, it should be apparent to one skilled in the art that the final volume of combustion chamber is substantially reduced in FIG. 64, as compared to FIG. 25, thereby resulting in a high compression ratio in FIG. 64 and a relatively lower compression ratio in FIG. 25.

Figure 65:
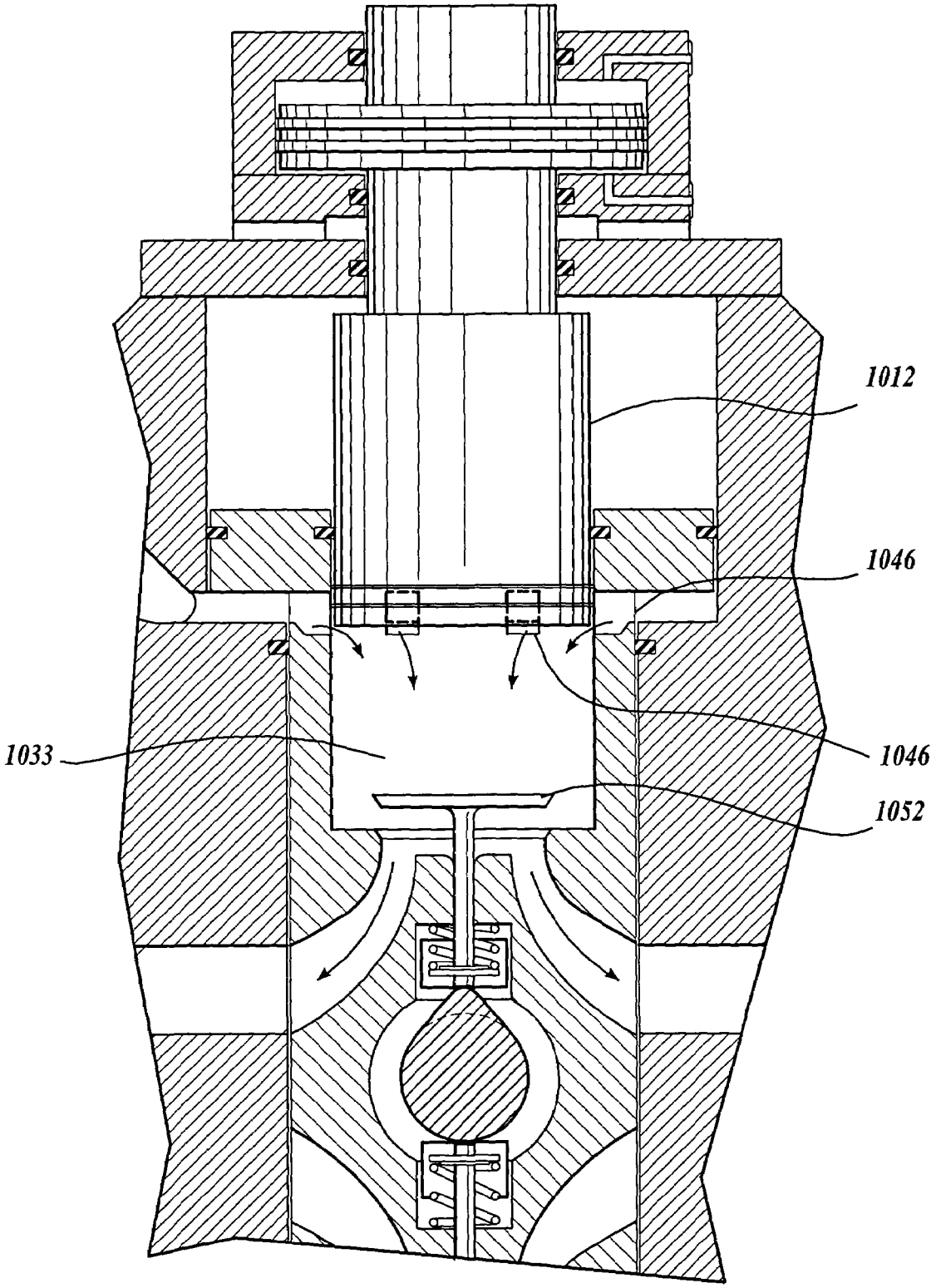
FIG. 65 is a fragmentary cross-sectional view of one of the reciprocating cylinder liners and related components shown in FIG. 21, illustrating the reciprocating cylinder liner at a BDC position with respect to a substantially stationary piston configured in its high compression ratio, low power setting position.

Referring to FIG. 65, manipulation of the axial position of the piston 1012 also simultaneously adjusts the power setting of the engine. More specifically, by adjusting the axial position of the piston 1012, the degree to which the intake ports 1046 are in fluid communication with the combustion chamber 1033 is selectively controlled in both duration and surface area. By controlling the degree to which the intake ports 1046 are in fluid communication with the combustion chamber 1033, the volume of combustion gases delivered to the combustion chamber 1033 is controlled, in an analogous manner to a butterfly valve in a carburetor of a conventional naturally aspirated engine.

Referring to FIG. 65 in comparison to FIG. 27, the power setting or throttle effect realized by the manipulation of the axial position of the piston 1012 can be readily understood by one skilled in the art. Referring to FIG. 65, the piston 1012 is shown in a high compression, low power setting configuration with the cylinder liner 1014 depicted in a BDC position. As shown in FIG. 65, the intake ports 1046 are partially blocked by the piston 1012 when the liner is at BDC. Referring now to FIG. 27, the cylinder liner 1014 is also at BDC. However, the intake ports 1046 are now fully exposed, since the piston 1012 has been moved axially away from the cylinder liner 1014 relative to the piston 1012 position depicted in FIG. 65. By moving the piston 1012 downward to partially block the intake ports 1046, both the surface area of the intake ports 1046 and the duration of which the intake ports 1046 are in fluid communication with the combustion chamber 1033 is substantially reduced. By reducing the degree of which the intake ports 1046 are in fluid communication with the combustion chamber 1033, the volume of combustion gases drawn into the combustion chamber 1033 is thereby reduced, thus throttling the engine to a lower power setting. As should be apparent to one skilled in the art, the engine may be shut down by fully blocking the intake ports 1046. As should also be apparent to one skilled in the art, adjustment of the axial position of the piston also manipulates the timing of the intake process.

Although the above detailed description of the control system 1300 describes a hydraulic system for initiating piston 1012 movement, it should be apparent to one skilled in the art that other methods of actuating the pistons 1012 are suitable for use with the present invention. For example, the pistons 1012 may be actuated by an electromagnetic system or by mechanical means, such as where a cam is rotated to selectively position the pistons 1012.

Like all internal combustion engines, the illustrated reciprocating internal combustion engine 1010 produces large amounts of heat during operation, most of it as a result of the combustion process, additional heat being generated by the compression of the gases within the cylinder liners and the friction between the moving parts of the engine 1010. Temperatures within the engine 1010 are kept under control by a cooling system that circulates coolant through passages in the engine block and around critical parts to remove excess heat and to equalize stresses produced by heating. Inasmuch as the design and components of internal combustion engine cooling systems are well known in the art, the cooling passages in the engine and cooling system components are not shown for the purpose of clarity.

Figure 66:
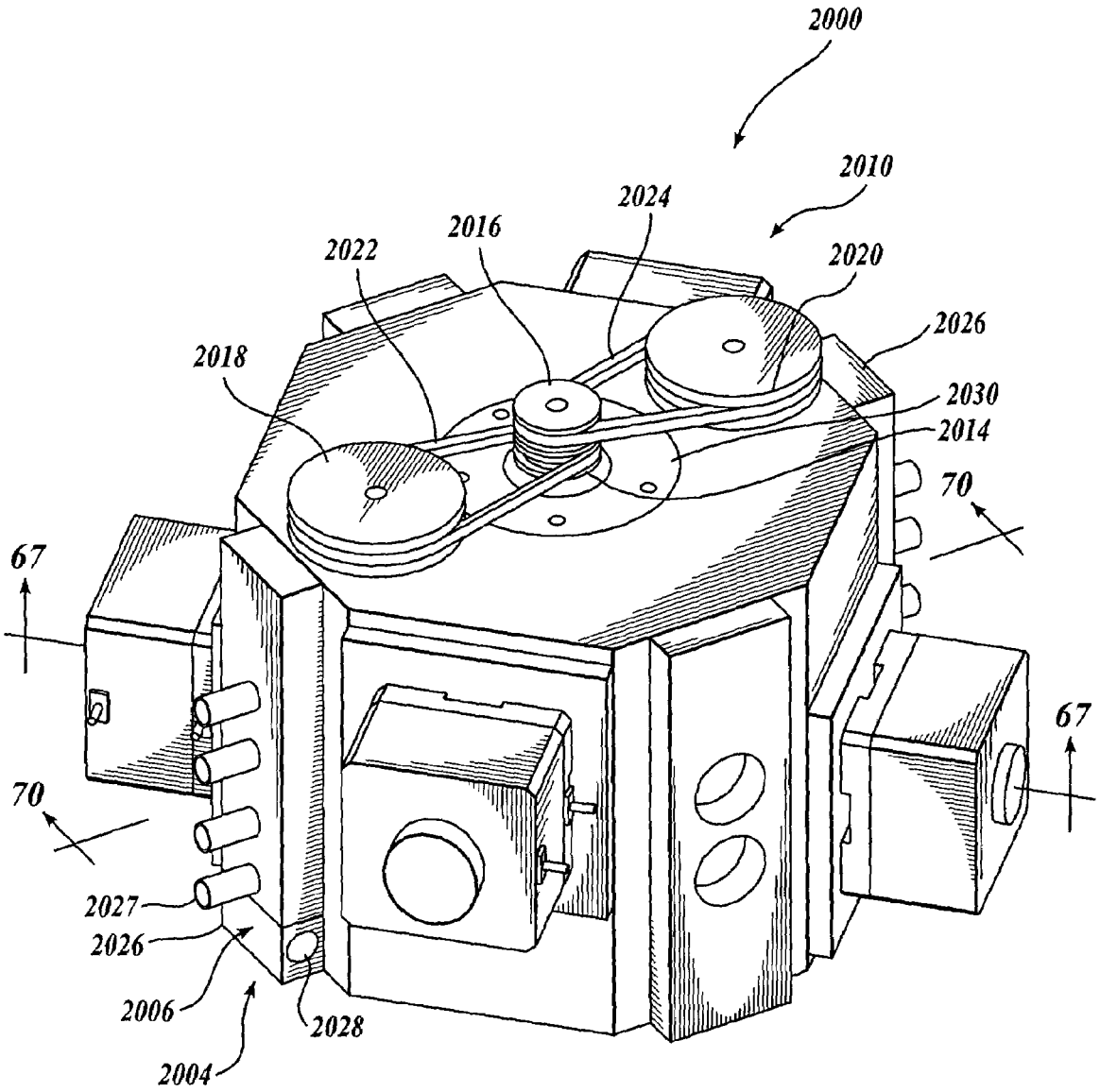
FIG. 66 is an isometric view of an alternate embodiment of a diesel reciprocating internal combustion engine formed in accordance with the present invention having exhaust gas recovery capabilities, showing an engine block and related components, such as an exhaust gas recovery valve drive assembly, exhaust assembly, intake manifold, and compression ratio control system attached thereto.

FIGS. 66–70 illustrate an alternate embodiment of a reciprocating internal combustion engine 2000 formed in accordance with the present invention. The engine 2000 is suitably a four piston internal combustion engine adapted to run on a diesel fuel source. Referring to FIG. 66, the internal combustion engine 2000 is substantially similar in many aspects to the above described embodiments, therefore, for the sake of brevity, this detailed description will focus on the aspects of the engine 2000 which depart from the above described embodiments.

Figure 67:
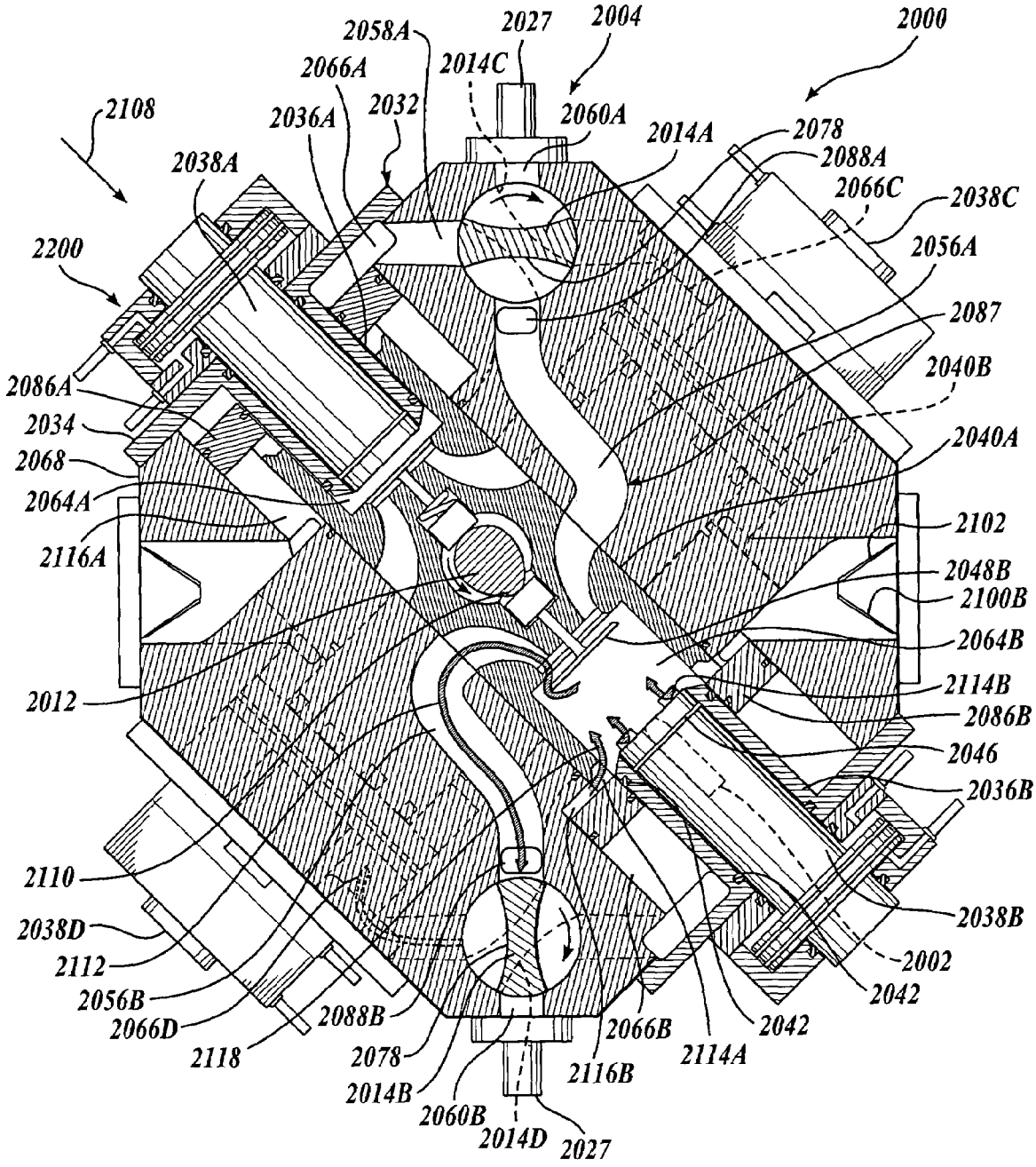
FIG. 67 is a cross-sectional view of the diesel reciprocating internal combustion engine of FIG. 66, the cross-sectional cut taken substantially through Section 67—67 of FIG. 66, the cross-sectional view showing a cylinder in a top-dead-center position relative to a first piston assembly and a bottom-dead-center position relative to a second piston assembly.

The engine 2000 includes the addition of fuel injectors 2002 (See FIG. 67) and piston liner assemblies 2034 (See FIG. 67). The engine 2000 also includes an exhaust recovery system 2004 adapted to convert pressure and heat present in exhaust gases to useable energy, i.e. to horsepower. The engine 2000 includes a pair of waste gate valve assemblies 2006, each operable to control the operation of a waste gate valve 2008.

In the embodiment depicted in FIGS. 66–70, many of the components are found in multiple locations within or upon the engine 2000. Thus, only one component is often described in greater detail. It should be apparent to those skilled in the art that the description of one component of a substantially identical group of components applies to all members of the group.

Referring to FIG. 66, the exhaust gas recovery drive system 2010 will now be described in greater detail. The exhaust recovery drive system 2010 is adapted to transfer power from a crank-cam 2012 (See FIG. 67) to a rotary valve 2014 (See FIG. 67). Coupled to the crank-cam 2012 is a bottom pulley 2014 and a top pulley 2016. Spaced from the bottom and top pulleys 2014 and 2016 are first and second rotary valve drive pulleys 2018 and 2020.

A first belt 2022 extends between the bottom pulley 2014 and the first rotary valve drive pulley 2018, while a second belt 2024 extends between the second rotary valve drive pulley 2020. The diameter of each of the bottom and top pulleys 2014 and 2016 is suitably half that of the diameter of the first and second rotary valve drive pulleys 2018 and 2020. Accordingly, the rotational speed of the first and second rotary valve drive pulleys 2018 and 2020 is half that of the bottom and top pulleys 2014 and 2016, and half that of the crank-cam 2012 upon which the bottom and top pulleys 2014 and 2016 are coupled. A well known cover plate 2030 is disposed below the bottom and top pulleys 2014 and 2016.

Although the illustrated embodiment depicts placing the crank-cam 2012 in communication with the rotary valves by an exhaust recovery drive system 2010 utilizing belts and pulleys, it should be apparent to those skilled in the art that alternate systems for coupling the crank-cam 2012 in communication with the rotary valves. As non-limiting examples, gears, chains, etc. may be used to coordinate the motion of the crank-cam to the that of the rotary valves. Alternately, separate drive motor(s) may be used to drive the rotary valves, eliminating the need to physically couple the rotation of the rotary valves to the crank-cam 2012. Therefore, such mechanisms are also within the scope of the present invention.

Also coupled to the exterior of the engine 2000 is a pair of external exhaust manifolds 2026. Each external exhaust manifold 2026 suitably includes four exhaust ports 2027, two for each piston. Each external exhaust manifold 2026 also includes a waste gate exhaust gas port 2028 coupled in communication with a waste gate valve 2008 (See FIG. 70). The waste gate exhaust gas port 2028 permits the discharge of exhaust gases from the engine 2000 when it becomes desirable to reduce the exhaust back pressure of the engine. The remaining components disposed on the exterior of the engine 2000 are substantially identical to those described for the above embodiments and therefore will not be described further herein for the sake of brevity.

As may be best seen by referring to FIG. 67, the engine 2000 includes four piston liner assemblies 2032. The piston liner assemblies 2032 each include a base plate 2034 coupled to a piston liner 2036. The base plate 2034 is considered a portion of a housing 2068 of the engine 2000 for purposes of this detailed description. The piston liner 2036 may have an inner diameter adapted to slidingly receive a piston 2038 and an outer diameter adapted to be slidingly received within a cylinder 2040. The piston liner 2036 includes seals 2042 adapted to seal the piston liner 2036 to the piston 2038 and to the cylinder 2040. Likewise, the piston 2038 may include a seal 2046 to seal the piston 2038 to the piston liner 2036.

Disposed within the piston 2038 is a well known fuel injector 2002. The fuel injector 2002 is disposed in the piston 2038 in a similar manner as the spark plug for the previously described embodiments. As should be apparent to those skilled in the art, the fuel injector 2002 may be coupled to a well known fuel system that provides selected quantities of pressurized fuel at predetermined intervals during a combustion cycle. The fuel injector 2002 is suitably oriented to direct discharged fuel upon or at an exhaust valve 2048. The discharged fuel may impact the exhaust valve 2048, cooling the exhaust valve during operation.

Figure 70:
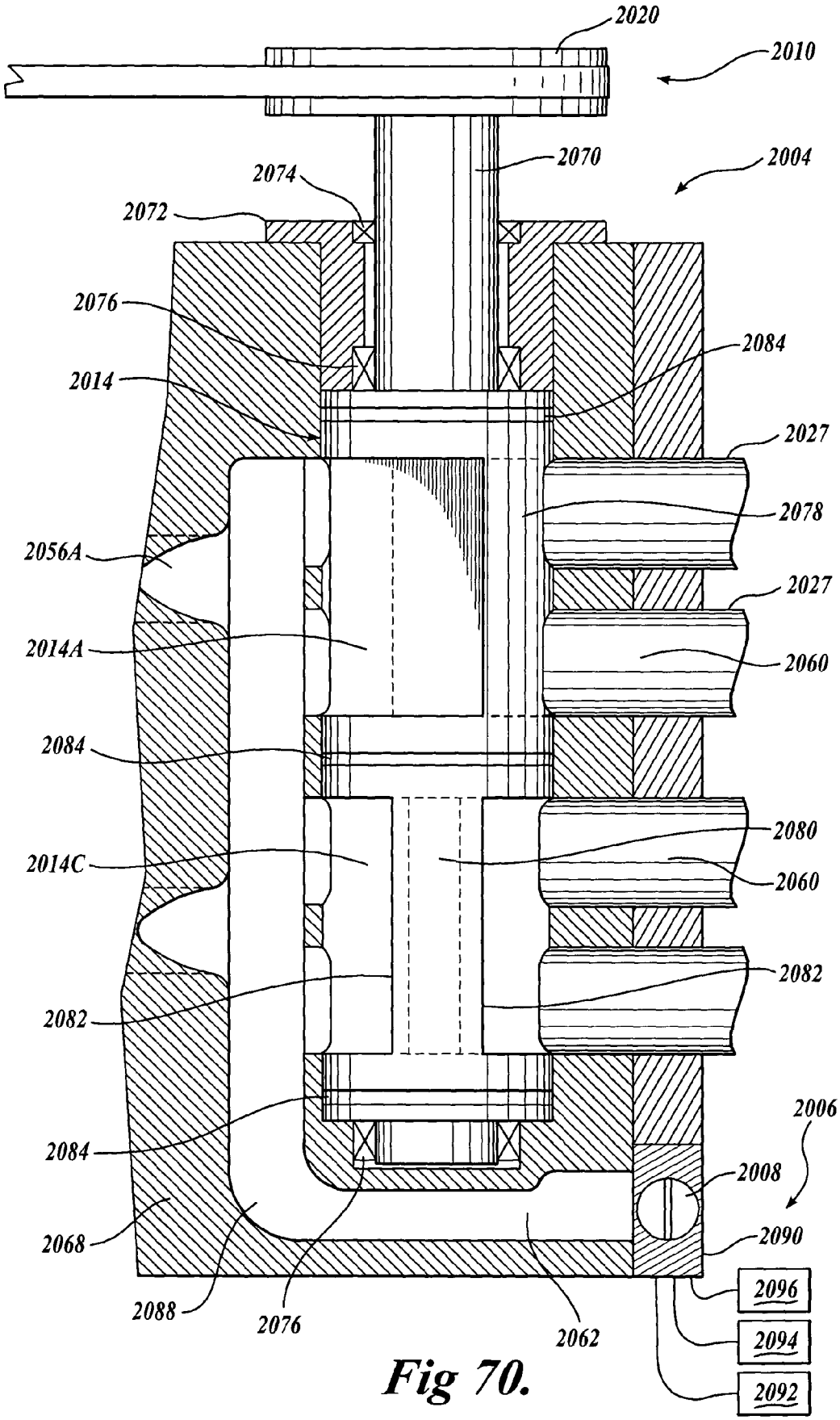
FIG. 70 is a cross-sectional view of a rotary valve and adjacent associated components of the diesel reciprocating internal combustion engine of FIG. 66, the cross-sectional cut taken substantially through Section 70—70 of FIG. 66.

The exhaust recovery system 2004 may be best understood by referring to FIGS. 67 and 70. The exhaust recovery system 2004 includes the exhaust recovery drive system 2010 described above, an exhaust gas passageway network, a suitable number of rotary valves 2014, which in the present embodiment is four, and a suitable number of exhaust gas recovery chambers 2066, which in the present embodiment is four.

The exhaust gas passageway network includes a plurality of combustion chamber passageways 2056, recovery chamber passageways 2058, exhaust port passageways 2060, recovery valve manifolds 2088, and waste gate valve passageways 2062. Generally, the combustion chamber passageways 2056, recovery valve manifolds 2088, and waste gate valve passageways 2062 form, collectively, an internal exhaust manifold 2087. The combustion chamber passageways 2056 couple the rotary valves 2014 in fluid communication with the combustion chambers 2064 of the cylinders 2040. The recovery chamber passageways 2058 couple the rotary valves 2014 in fluid communication with a series of exhaust gas recovery chambers 2066. The exhaust port passageways 2060 couple the rotary valves 2014 in fluid communication with the exhaust ports 2027. The waste gate valve passageways 2062 couple the rotary valves 2014 in fluid communication with a pair of waste gate valves 2008.

The internal exhaust manifold 2087 acts as a reservoir for receiving exhaust gases from a series of combustion chambers 2064 upon opening of exhaust valves 2048 associated with the combustion chambers 2064. The rotary valves 2014 in turn selectively draw and discharge from the reservoir of exhaust gases contained within the internal exhaust manifold 2087. Moreover, the rotary valves 2014 selectively direct exhaust gases from the internal exhaust manifold 2087 at selective times during the combustion cycle to a series of exhaust gas recovery chambers 2066, wherein the exhaust gases undergo a second expansion (the first being in the combustion chambers 2064). During the second expansion, the pressure and heat contained in the exhaust gases are used to drive the cylinders 2040. Further, the rotary valves 2014 also control the discharge to atmosphere of the exhaust gases contained in the exhaust gas recovery chambers 2066 by selectively placing the exhaust gas recovery chambers 2066 in communication with the exhaust gas ports 2027.

During operation, the internal exhaust manifold 2087 may be maintained at selected pressure through the operation of the waste gate valve 2008. In one embodiment, the internal exhaust manifold 2087 is maintained at about 40 psi, however it should be apparent to those skilled in the art that the pressure may be maintained at any pressure or range of pressures selected by the engine designer.

Referring to FIG. 70, an exemplary rotary valve 2014 will now be described. The rotary valve 2014 is disposed in a housing 2068 of the engine 2000. The rotary valve 2014 is generally an elongate cylindrical structure. A drive shaft 2070 of the rotary valve 2014 extends outward of the housing 2068. The second rotary valve drive pulley 2020 is coupled to the drive shaft 2070 and is used to rotate the rotary valve 2014 at half the speed of the crank-cam 2012 (see FIG. 67). The drive shaft 2070 is sealed against a sleeve 2072 by a seal 2074. A pair of bearings 2076 assist in reducing the rotational friction of the rotary valve 2014.

Two valve plates 2078 and 2080 are concentrically aligned upon a center axis of the rotary valve 2014. The valve plates 2078 and 2080 are generally rectangular in shape, wherein the outer surfaces 2082 of the valve plates 2078 and 2080 are bowed inward/concave in shape as best seen in FIG. 67. As a result, the width of the valve plates 2078 and 2080 is less along the center axis of the rotary valve 2014 relative to the outer edges of the valve plates 2078 and 2080. Seals 2084 impede exhaust gases from flowing between the valve plates 2078 and 2080 and their associated passageways. The upper valve plates 2078 (one shown in FIG. 70) are in fluid communication with the upper cylinder 2040A (see FIG. 67) and form the upper rotary valves 2014A and 2014B (see FIG. 67). The lower valve plates 2080 (one shown in FIG. 70) are in fluid communication with the lower cylinder 2040B (see FIG. 67) and form the lower rotary valves 2014C and 2014D. The valve plates 2078 and 2080 may be angularly displaced 45 degrees from one another.

As seen in FIG. 67, an exhaust gas recovery chamber 2066 is disposed above each of the precompression plates 2086 of the cylinders 2040. The exhaust gas recovery chambers 2066 have a volume defined by the precompression plate 2086 and the housing 2068, which includes the base plate 2034 of the piston liner assemblies 2032. Exhaust gases discharged into the exhaust gas recovery chambers 2066 act upon the precompression plates 2086, thereby applying a force upon the precompression plates 2086 urging the cylinders 2040 away from the exhaust gas recovery chambers 2066, as will be discussed in further detail below.

Referring to FIGS. 66 and 70, the waste gate valve assembly 2006 will be described in further detail. The waste gate valve assembly 2006 includes a waste gate valve 2008 coupled to an exhaust gas manifold 2088. In the illustrated embodiment, the waste gate valve 2008 is a well known butterfly valve and is coupled to an actuation system 2090.

The actuation system 2090 may be coupled to a pressure sensor 2092. The pressure sensor 2092 may be adapted to sense the pressure of exhaust gases present in the internal exhaust gas manifold 2087, such as in the internal exhaust gas manifold 2087, and transmit a signal indicative of the pressure of the exhaust gases to the actuation system 2090. Depending upon the sensed pressure, the actuation system 2090 may selectively open or close the waste gate valve 2008 to control the pressure of exhaust gases in the internal exhaust gas manifold 2087. For instance, if the pressure of exhaust gases in the internal exhaust gas manifold 2087 exceeds a predetermined value, such as 40 psi, then the actuation system 2090 may open the waste gate valve 2008 to release exhaust gases from the internal exhaust gas manifold 2087.

Alternately, the actuation system 2090 may be coupled to a Revolutions Per Minute (RPM) sensor 2094, the RPM sensor 2094 adapted to sense an operating speed of the engine and transmit a signal indicative of the operating speed of the engine to the actuation system 2090. Depending upon the sensed operating speed of the engine, the actuation system 2090 may selectively open or close the waste gate valve 2008 to control the pressure of exhaust gases in the internal exhaust gas manifold 2087.

Alternately, the actuation system 2090 may be coupled to a power setting sensor 2096 adapted to sense a power setting of the engine and transmit a signal indicative of the power setting to the actuation system 2090. Depending upon the sensed power setting of the engine, the actuation system 2090 may selectively open or close the waste gate valve 2008 to control the pressure of exhaust gases in the internal exhaust gas manifold 2087.

As should be apparent to those skilled in the art, the sensors 2092, 2094, and 2096 may be coupled individually or in any combination thereof to the actuation system 2090. In one embodiment, the RPM sensor 2094 and the power setting sensor 2096 are coupled in combination to the actuation system 2090. The actuation system 2090 controls the configuration of the waste gate valve 2008 and thus the exhaust back pressure of the engine based upon the signals received from both sensors 2094 and 2096.

Preferably, the engine is dyno tested to determine the preferred position of the waste gate valve 2008. More specifically, the engine is run at a series of power settings and RPMs and the optimum waste gate valve 2008 position determined at each point in the series. A data set representing optimum waste gate valve 2008 position at all operating conditions is then created and stored in the actuation system 2090 and used to control waste gate valve 2008 position during use. As should be apparent to those skilled in the art, this type of testing regime is suitable for correlating an optimum waste gate valve 2008 position relative to an individual sensor 2092, 2094, or 2096 signal or any combination of signals from the sensors 2092, 2094, and/or 2096.

Figure 68:
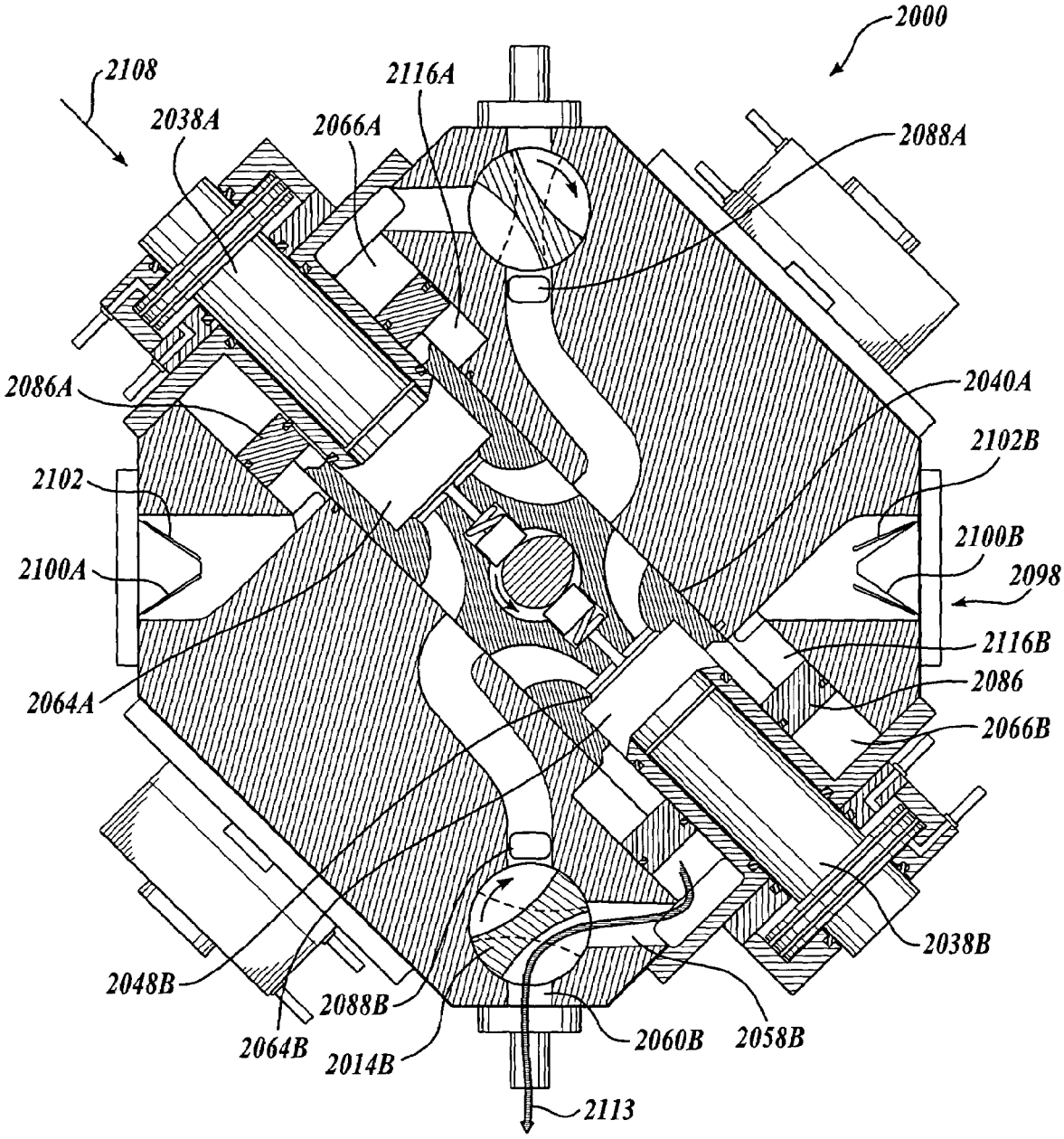
FIG. 68 is the diesel reciprocating internal combustion engine of FIG. 67 wherein the cylinder has moved to approximately a midpoint position wherein the cylinder is located substantially equidistant from the first and second piston assemblies.

Referring to FIG. 68, this detailed description will now focus upon an intake system 2098. The intake system 2098 includes a reed valve 2100 having a plurality of reeds 2102. During an intake portion of a combustion cycle, the low pressure created by the sweeping of the precompression plate 2086 through an intake chamber 2116 creates a low pressure/vacuum condition in the intake chamber 2116. The vacuum forces air through the reed valve 2100, lifting the reeds 2102 off of their respective seats, permitting air to flow into the intake chamber 2116. Upon elimination of the vacuum, the reeds 2102 are reset, impeding flow out through the reed valve 2100.

Turning now to FIG. 67, a compression ratio control system 2200 will now be described. The compression ratio control system 2200 is substantially identical to the compression ratio and power setting control system described for the above embodiments. In the embodiment of FIGS. 66–70, movement of the pistons 2038 does not significantly alter the duration of intake port 2114 opening or the area of the intake ports 2114. Thus, the compression ratio of the engine 2000 may be adjusted without significantly effecting the intake ports 2114. Thus, the compression ratio of the engine 2000 may be adjusted without significantly effecting the power setting of the engine.

More specifically, as the pistons 2038 are moved inward toward the crank-cam 2012 within their respective piston liner 2036, the intake ports 2114 are substantially unaffected in duration or opening size since the piston liners 2036 displace the piston 2038 away from the cylinder 2040. In previous embodiments, the pistons, when moved by the compression ratio and power setting control system, slid directly along the walls of the combustion chamber and therefore were able to partially or fully close the intake ports through adjustment of the position of the pistons. In the present embodiment, because the pistons are displaced by the liner 2036 from the walls of the combustion chambers 2064, movement of the pistons 2038 has substantially little effect upon the duration of opening of the intake ports 2114 nor the area of the intake ports 2114. Thus, the intake ports 2114 remain in a fully open position during all power settings and compression ratios of the engine 2000. The power setting of the engine 2000 is determined by the amount of fuel injected into the combustion chambers 2064 during operation. More specifically, the more fuel injected, the higher the power setting, the less fuel injected, the lower the power setting.

In the illustrated embodiment, the compression ratio control system 2200 may be adapted to adjust the compression ratio of the engine 2000 automatically based upon the operating speed/RPM and/or power setting of the engine 2000. In one embodiment, the compression ratio control system 2200 is adapted to increase the compression ratio of the engine 2000 when the operating speed/RPM of the engine falls below a first selected RPM. Additionally, the compression ratio control system 2200 may be adapted to increase the compression ratio of the engine 2000 when the operating speed/RPM of the engine is elevated above a second selected RPM, which may be the same as or greater than the first selected RPM.

More specifically, the compression ratio is adjusted to maintain a constant compression pressure in each combustion chamber. Compression pressures are a function of intake air speed. Intake air speed is in turn a function of the RPM of the engine. Moreover, at low RPMs, intake air speed may be too low to result in an optimum filling of the combustion chamber, and compression pressures accordingly decrease below optimum values. At high RPM, intake air speed is too high to result in optimum filling of the combustion chamber, and compression pressures accordingly decrease below optimum values. Thus, to maintain a constant compression pressure, the compression ratio of the engine may be altered through the selective use of the compression ratio control system 2200. In the illustrated embodiment, the compression ratio is selectively and preferably gradually increased as the intake air speed departs from (either rising above or falling below) an optimum intake air speed.

It should be apparent to those skilled in the art that preferred compression ratios for various combinations of power settings and RPMs may be readily determined by testing, such as upon a dyno or by a bench flow testing apparatus. Moreover, it is within the skill and knowledge of one skilled in the art to determine the preferred compression ratio for various engine RPMs and power settings, and to actuate the compression ratio control system 2200 accordingly to actuate the pistons 2038 into a position to obtain the preferred compression ratio. Further, it should be apparent to those skilled in the art that the power setting of the engine 2000 may be sensed and used individually or in combination with the sensed operating speed/RPM of the engine to determine the preferred compression ratio.

In light of the above description of the components of the engine 2000, the operation of the engine 2000 will now be described. Referring to FIG. 67, a first cylinder 2040A is shown at a top-dead-center (TDC) position relative to a first piston 2038A and a bottom-dead center (BDC) position relative to a second piston 2038B. A second cylinder 2040B (shown in phantom) is depicted in a midpoint position, equidistant from a third piston 2038C and a fourth piston 2038D. At this point in the cycle, diesel fuel is injected into a combustion chamber 2064A disposed between the cylinder 2040A and the first piston 2038A. Due to the heat of the compressed air, the diesel fuel ignites causing the rapid expansion of the fuel and air mixture within the combustion chamber 2064A. The expansion of the fuel and air mixture causes the cylinder 2040A to be driven in the direction of arrow 2108.

As the cylinder 2040A is driven in the direction of arrow 2108, the rotary valves 2014 rotate clockwise at half the speed of the crank-cam 2012, which is rotating in a counterclockwise direction. An exhaust valve cam 2110 has actuated a second exhaust valve 2048B into a fully open configuration. Exhaust gases 2112 rush from the combustion chamber 2064B, pressurizing the internal exhaust manifold 2087. In the position shown in FIG. 67, the majority of the exhaust gases 2112 exiting the combustion chamber 2064B flow through combustion chamber passageway 2056B and into recovery valve manifold 2088B. The exhaust gases 2112 flow down (into the paper) through the recovery valve manifold 2088B to rotary valve 2014D which is disposed directly below rotary valve 2014B and which is shown in phantom in FIG. 67. Rotary valve 2014D is configured to direct the exhaust gases 2112 exiting the combustion chamber 2064B into the exhaust gas recovery chamber 2066D associated with the piston 2038D. The exhaust gases expand within the exhaust gas recovery chamber 2066D moving cylinder 2040B toward piston 2038C.

Rotary valve 2014B is shown just prior to rotating to place the exhaust gas recovery chamber 2066B in fluid communication with exhaust port passageway 2060B such that the exhaust gases present in the exhaust gas recovery chamber 2066B may be discharged from the engine 2000.

Rotary valve 2014A is shown just prior to rotating to place the combustion chamber passageway 2056A in fluid communication with the recovery chamber passageway 2058A. After the rotary valve 2014A rotates further clockwise, the exhaust gases 2112 flow into combustion chamber passageway 2056B will decrease as flow is redirected into combustion chamber passageway 2056A. More specifically, as the rotary valve 2014A rotates further clockwise, the exhaust gases 2112 will flow into the exhaust gas recovery chamber 2066A, charging the exhaust gas recovery chamber 2066A with high pressure exhaust gases 2112. The high pressure exhaust gases 2112 act upon the precompression plate 2086A, thereby driving the cylinder 2040A in the direction of arrow 2108. As the cylinder 2040A moves in the direction of arrow 2108, the precompression plate 2086A sweeps through the intake chamber 2116A, thereby compressing (supercharging) air present therein.

As shown in FIG. 67, rotary valve 2014C, which is disposed directly below rotary valve 2014A and which is shown in phantom in FIG. 67, is shown in an exhaust discharge position. More specifically, rotary valve 2014C is shown coupling exhaust gas recovery chamber 2066C in fluid communication with the exhaust gas ports 2027, such that the exhaust gases present within the exhaust gas recovery chamber 2066C may be discharged from the engine.

Still referring to FIG. 67, the cylinder 2040A is located at a BDC position with respect to piston 2038B. In this position, the intake ports 2114B are in their fully open configurations and a charge of fresh air 2118, pressurized by the precompression plate 2086B, is flowing into the combustion chamber 2064B. As described above, the exhaust valve 2048B is also in a fully open position to permit the exhaust gases present in the combustion chamber 2064B to begin exiting the combustion chamber 2064B to pressurize the internal exhaust gas manifold 2087.

As the cylinder 2040A moves in the direction of arrow 2108 to the configuration shown in FIG. 68, the intake ports 2114B are covered/closed by the piston liner 2036B. The exhaust valve 2048B closes and the intake air in the combustion chamber 2064B begins to become increasingly pressurized as the volume of the combustion chamber 2064B decreases. The precompression plate 2086B will sweep through the intake chamber 2116B, thereby causing a vacuum to be created in the intake chamber 2116B. This causes the reeds 2102 of the reed valve 2100B to lift from their seats, allowing intake air to rush into the intake chamber 2116B.

As seen best in FIG. 68, the cylinder 2040A is near an equidistant or midpoint location, wherein the cylinder 2040A is nearly the same distance away from each piston 2038A and 2038B. The products of combustion are expanding rapidly in the combustion chamber 2064A forcing the cylinder 2040A in the direction of arrow 2108. Further, exhaust gases are expanding in the exhaust gas recovery chamber 2066A, also forcing the cylinder 2040A in the direction of arrow 2108.

As the cylinder 2040A moves in the direction of arrow 2108, the precompression plate 2086A sweeps through the intake chamber 2116A compressing intake air present therein. The pressurization of the intake air by the precompression plate 2086A causes the reeds 2102 of the reed valve 2100A to seat, substantially sealing the intake chamber 2116A from outward gas flow. Seating of the reeds 2102 temporarily forms the intake chamber 2116A into a pressure vessel, allowing the movement of the cylinder 2040A to supercharge the intake air for later injection into the combustion chamber 2064A.

Focusing now on piston 2038B, the volume of the combustion chamber 2064B is rapidly decreasing. The exhaust valve 2048B and the intake ports 2114B (See FIG. 67) are in closed positions, forming the combustion chamber 2064B into a substantially sealed pressure vessel. The decrease in volume of the combustion chamber 2064B is causing a substantial increase in the pressure and temperature of the intake air contained therein. Rotary valve 2014B has rotated such that the recovery chamber passageway 2058B is in fluid communication with exhaust port passageway 2060B.

With the rotary valve 2014B positioned as described, exhaust gases 2113 are permitted to be discharged from the exhaust gas recovery chamber 2066B to the outside atmosphere. Preferably, the exhaust gases 2113 have expanded to the point that the pressure and temperature of the exhaust gases 2113 have been significantly reduced. In one embodiment, the exhaust gases 2113 are discharged at a pressure of slightly above atmospheric pressure, such as at about 3 psi.

Figure 69:
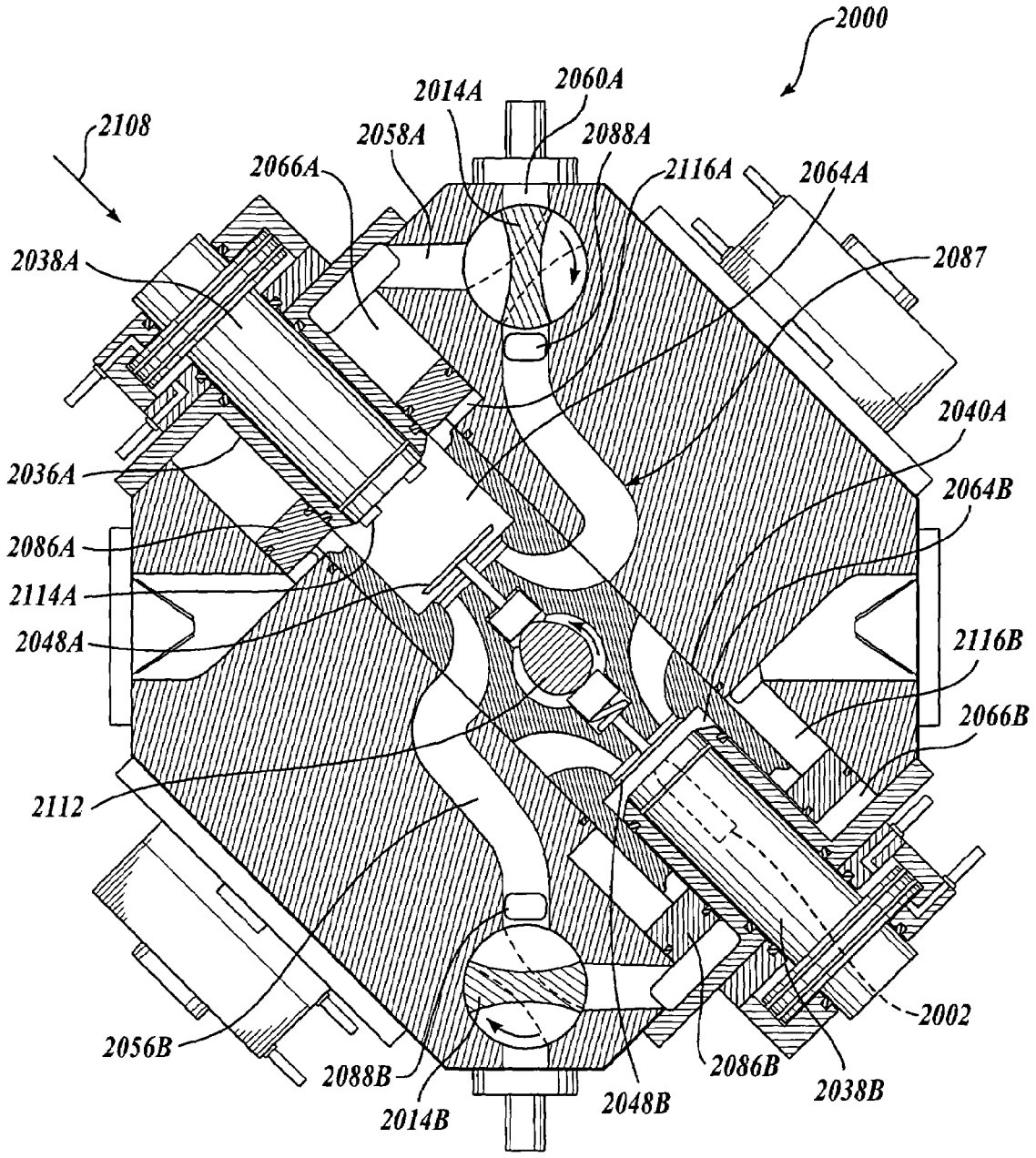
FIG. 69 is the diesel reciprocating internal combustion engine of FIG. 67 wherein the cylinder has moved such that the cylinder is in a bottom-dead-center position relative to the first piston assembly and a top-dead-center position relative to the second piston assembly.

Referring to FIG. 69, the cylinder 2040A has moved from the substantially midpoint position in the direction of arrow 2108 to the position shown in FIG. 69. In the configuration shown in FIG. 69, the cylinder 2040A is shown at a BDC position relative to the first piston 2038A and at a TDC position relative to the second piston 2038B.

Focusing on piston 2038A, the scavenging process has begun. The exhaust valve 2048A is in an open position, permitting high pressure exhaust gases to enter the internal exhaust gas manifold 2087. The cylinder 2040A has reciprocated sufficiently in the direction of arrow 2108 to uncover the intake ports 2114A, permitting the supercharged intake air to rush into the combustion chamber 2064A from the intake chamber 2116A. As the crank-cam 2112 rotates further in the counterclockwise direction from that depicted in FIG. 69, the cylinder 2040A will change direction from movement in the direction of arrow 2108 to movement in a direction opposite of arrow 2108.

As the cylinder 2040A moves in a direction opposite of arrow 2108, the intake ports 2114A will be closed/covered by the piston liner 2036A and the exhaust valve 2048A will seat, substantially closing off the combustion chamber 2064A, allowing the compression phase of the combustion cycle to begin. The rotary valve 2014A will rotate clockwise permitting the exhaust gases present in the exhaust gas recovery chamber 2066A to escape to atmosphere through the recovery chamber passageway 2058A and the exhaust port passageway 2060A. The precompression plate 2086A will sweep through intake chamber 2116A, drawing fresh air into the intake chamber 2116A.

Focusing on piston 2038B, the expansion process has begun. The fuel injector 2002 injects a selected volume of diesel fuel into the combustion chamber 2064B. The fuel injector 2002 is oriented such that the diesel fuel at least partially impinges upon the exhaust valve 2048B, cooling the exhaust valve. The introduction of the fuel into the high pressure and high temperature intake gases present in the combustion chamber 2064B causes ignition of the diesel fuel, thereby causing rapid expansion of the fuel and air mixture present in the combustion chamber 2064B. The rapid expansion of the fuel and air mixture causes the cylinder 2040A to move in the direction opposite of arrow 2108.

As the cylinder 2040A moves in the direction opposite of arrow 2108, the rotary valve 2014B rotates clockwise permitting the exhaust gases located in the combustion chamber 2064A of the first piston 203 8A and in the internal exhaust manifold 2087 to enter the exhaust recovery chamber 2066B of the second piston 2038B. The expansion of the fuel and air mixture present in the combustion chamber 2064B and the expansion of the exhaust gases in the exhaust gas recovery chamber 2066B forces the cylinder 2040A in the direction opposite arrow 2108. Intake air present in the intake chamber 2116B is compressed by the sweeping of the precompression plate 2086B through the intake chamber 2116B, supercharging the intake air for later injection into the combustion chamber 2064B.

To complete the thermodynamic cycle, the cylinder 2040A continues moving in the direction opposite of arrow 2108 to the position shown in FIG. 68 and continues moving in the direction opposite of arrow 2108 until reaching the position shown in FIG. 67, wherein the thermodynamic cycle is complete. Turning to FIG. 67, as should be apparent to those skilled in the art, the above described process continues in an endless loop during operation. As should further be apparent to those skilled in the art, the second cylinder 2040B operates in substantially the same manner as described for the first cylinder 2040A, but 90 degrees out of phase of the first cylinder 2040A. More specifically, when the first cylinder 2040A is at a TDC and BDC position with respect to the pistons 2038A and 2038B, the second cylinder 2040B is at a position midpoint between pistons 2038C and 2038D.

Figure 71:
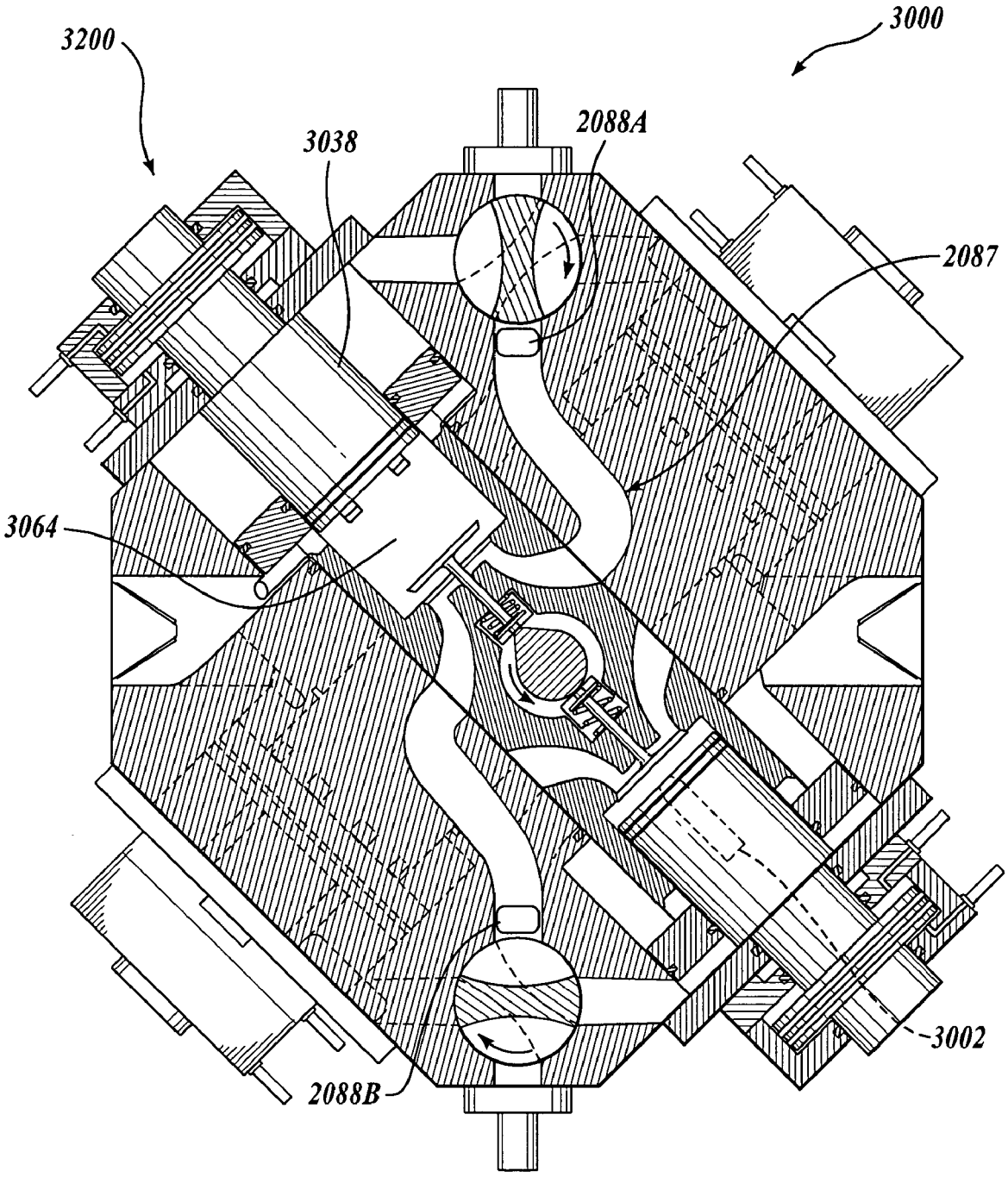
FIG. 71 is a cross-sectional view of an alternate embodiment of a reciprocating internal combustion engine formed in accordance with the present invention, wherein the alternate embodiment is the diesel reciprocating internal combustion engine of FIG. 66 modified to run on gasoline, the cross-sectional view showing a cylinder in a top-dead-center position relative to a first piston assembly and a bottom-dead-center position relative to a second piston assembly.

Referring to FIG. 71, a cross-sectional view of an alternate embodiment of a reciprocating internal combustion engine formed in accordance with the present invention is provided. The alternate embodiment is the diesel reciprocating internal combustion engine of FIGS. 66–70 modified to run on gasoline. To convert the diesel reciprocating internal combustion engine of FIGS. 66–70 to run on a gasoline, several steps may be performed. Referring to FIG. 67, the cylinders 2040, pistons 2038, piston liner assemblies 2032, and compression ratio control systems 2200 are removed. These items may then be replaced by the corresponding items from FIGS. 18–65 with the exception of the piston liner assemblies 2032, which were not present in the previous embodiments.

The engine 3000 may then operate in a substantially similar manner to the embodiment described in FIGS. 66–70, with a few exceptions. The fuel injector 2002 of FIG. 67 is replaced with a spark plug 3002. Gasoline may be entrained in the incoming intake air through a carburetor or fuel injection system as is well known in the art, as opposed to discharging fuel directly into the combustion chamber 3064. Preferably, the compression ratio of the embodiment depicted in FIG. 71 has been reduced relative to the embodiment depicted in FIGS. 66–70 to accommodate the use of gasoline, as is well known in the art.

Further, inasmuch as the piston liner assemblies 2032 of the embodiment of FIGS. 66–70 have been eliminated in the gasoline engine of FIG. 71, the movement of the pistons 3038 by a compression ratio and power setting control mechanism 3200 adjusts simultaneously the compression ratio and power setting of the engine 3000. While all of the components of the engine 3000 have been previously described, and the operation of the engine 3000 is apparent to those skilled in the art from the description of the operation of the previously described embodiments, the components and operation of the embodiment of FIG. 71 will not be described further herein for the sake of brevity.

The illustrated embodiments of the reciprocating internal combustion engines of the present invention also contain a lubricating system. The lubricating system reduces the friction and wear between the moving parts of the engine. Inasmuch as the design and components of internal combustion engine lubricating systems are well known in the art, the oil passages in the engine and lubricating system components are not shown for the purpose of clarity.

Although the illustrated embodiments are described for use with a gasoline-based fuel source or a diesel-based fuel source, it should be apparent to one skilled in the art that the illustrated embodiments may be modified to use diesel if described for use with gasoline, or diesel if described for use with gasoline, or an alternate fuel source here now known or to be developed. For example, for the above embodiments described for use with gasoline, the engine may be modified to run on diesel, such as by replacing the spark plug with fuel injectors and increasing the compression ratio of the engine to raise the temperature of the compressed combustion gases to that above the ignition temperature of the diesel fuel contemplated for use.

It should be apparent to one skilled in the art that all known systems of carburetion, fuel injection, or additional use of turbochargers, compressors, and blowers can be used on an engine formed in accordance with the present invention. Also, all known types of ignition systems, lubrication systems, cooling systems, emission control systems, and other engine-related systems known in the art are suitable for use with an engine formed in accordance with the present invention and, therefore, are within the scope of the present invention.

It should also be apparent to one skilled in the art that although the illustrated embodiment depicts a four-cylinder variant of the present invention, engines having other quantities of cylinders are suitable for use with the present invention and therefore within the scope of the present invention. Also, four stroke engines are also within the scope of the present invention.

Although the illustrated embodiment depicts a pair of rotary valves which rotate at half the speed of the crank-cam, it should be apparent to those skilled in the art that the rotary valves may rotate at speeds greater or less than half the speed of the crank-cam. Further, although a rotary valve is depicted for directing exhaust gases during operation of the engine, it should be apparent to those skilled in the art that other exhaust gas directing devices are suitable for use with and within the spirit and scope of the present invention.

While the illustrated embodiment of the invention has been illustrated and described, it will be appreciated that various changes can be made therein without departing from the spirit and scope of the invention.

The embodiments of the invention in which an exclusive property or privilege is claimed are defined as follows:

1. An internal combustion engine comprising:

(a) a housing;

(b) a piston assembly disposed in the housing, wherein the piston assembly is adjustably coupled to the housing;

(c) a cylinder movably disposed within the housing, wherein the cylinder reciprocates relative to the piston assembly within the housing during operation of the internal combustion engine; and (d) a combustion chamber disposed between the piston assembly and the cylinder.

2. The internal combustion engine of claim 1, wherein the piston assembly is at least partially disposed within a piston liner.

3. The internal combustion engine of claim 1, further comprising a compression ratio adjustment mechanism in communication with the piston assembly and adapted to adjust a compression ratio of the internal combustion engine during operation by moving the piston assembly.

4. The internal combustion engine of claim 3, wherein the compression ratio adjustment mechanism is adapted to increase the compression ratio when a power setting of the internal combustion engine is decreased.

5. The internal combustion engine of claim 4, wherein the compression ratio adjustment mechanism is adapted to increase the compression ratio to a maximum compression ratio when the power setting is at a minimum power setting.

6. The internal combustion engine of claim 1, further comprising an exhaust gas recovery chamber disposed between the cylinder and the housing, the exhaust gas recovery chamber adapted to receive exhaust gases to permit the exhaust gases to expand to aid in the movement of the cylinder.

7. The internal combustion engine of claim 6, further comprising a recovery valve in communication with the exhaust gas recovery chamber, the recovery valve movable between a first position and a second position.

8. The internal combustion engine of claim 7, wherein when the recovery valve is in the first position, exhaust gas flows into the exhaust gas recovery chamber to aid in the movement of the cylinder.

9. The internal combustion engine of claim 7, wherein when the recovery valve is in the second position, exhaust gas flow into the exhaust gas recovery chamber is impeded.

10. The internal combustion engine of claim 7, wherein the recovery valve is a rotary valve.

11. The internal combustion engine of claim 1, wherein the cylinder is coupled to a crankshaft.

12. The internal combustion engine of claim 11, wherein the cylinder is coupled to a first portion of the crankshaft, wherein during operation the first portion of the crankshaft is displaced along a linear path to move the cylinder along a predetermined stroke length.

13. The internal combustion engine of claim 12, wherein the first portion of the crankshaft simultaneously rotates as it is displaced along the linear path.

14. The internal combustion engine of claim 1, further comprising a fuel injection device disposed at least partially within the piston assembly, the fuel injection device adapted to discharge fuel into the cylinder.

15. The internal combustion engine of claim 1, further comprising an exhaust valve disposed within the housing for selectively sealing an exhaust port located in the combustion chamber.

16. The internal combustion engine of claim 15, further comprising a fuel injection device disposed at least partially within the piston assembly, the fuel injection device adapted to direct at least a portion of fuel discharged from the fuel injection device toward the exhaust valve.

17. The internal combustion engine of claim 1, wherein the internal combustion engine is a diesel internal combustion engine.

18. The internal combustion engine of claim 1, wherein the internal combustion engine is a gasoline internal combustion engine.

19. The internal combustion engine of claim 1, further comprising;

(a) an additional piston assembly coupled to the housing; and (b) a first chamber disposed in the cylinder for at least partially receiving the piston assembly and a second chamber disposed in the cylinder for at least partially receiving the additional piston assembly, wherein the cylinder is disposed within the housing for reciprocal movement between the piston assemblies.

20. The internal combustion engine of claim 1, further comprising a spark plug disposed at least partially within the piston assembly.

21. The internal combustion engine of claim 9, wherein when the recovery valve is in the second position, the recovery valve permits exhaust gas flow from the exhaust gas recovery chamber to an external atmosphere.

22. An internal combustion engine comprising:

(a) a housing;

(b) a piston assembly disposed in the housing;

(c) a cylinder movably disposed within the housing; and (d) an exhaust gas recovery chamber disposed between the cylinder and the housing, the exhaust gas recovery chamber adapted to receive exhaust gases produced in the internal combustion engine to aid in moving the cylinder, further including a recovery valve in communication with the exhaust gas recovery chamber, the recovery valve movable between a first position and a second position.

23. The internal combustion engine of claim 22, wherein when the recovery valve is in the first position, the exhaust gas recovery chamber receives exhaust gases to aid in the movement of the cylinder.

24. The internal combustion engine of claim 22, wherein when the recovery valve is in the second position, the exhaust gas recovery chamber is impeded from receiving exhaust gases from the internal combustion engine.

25. The internal combustion engine of claim 22, wherein the recovery valve is a rotary valve.

26. The internal combustion engine of claim 22, wherein the internal combustion engine is a diesel internal combustion engine.

27. The internal combustion engine of claim 22, wherein the internal combustion engine is a gasoline internal combustion engine.

28. An diesel internal combustion engine comprising:

(a) a housing;

(b) a piston assembly disposed in the housing, the piston assembly substantially stationary relative to the housing;

(c) a cylinder movably disposed within the housing;

(d) a combustion chamber disposed between the piston assembly and the cylinder; and (e) a fuel injection device at least partially disposed in the piston assembly and adapted to inject fuel into the combustion chamber, wherein the piston assembly is at least partially disposed within a piston liner.

29. The diesel internal combustion engine of claim 28, wherein the piston assembly is adjustably coupled to the housing.

30. The diesel internal combustion engine of claim 29, further comprising a compression ratio adjustment mechanism in communication with the piston assembly and adapted to adjust a compression ratio of the diesel internal combustion engine during operation by moving the piston assembly.

31. The diesel internal combustion engine of claim 28, further comprising an exhaust gas recovery chamber disposed between the cylinder and the housing, the exhaust gas recovery chamber adapted to receive exhaust gases produced in the diesel internal combustion engine to aid in moving the cylinder.

32. The diesel internal combustion engine of claim 31, further comprising a recovery valve in communication with the exhaust gas recovery chamber, the recovery valve movable between a first position and a second position.

33. The diesel internal combustion engine of claim 32, wherein when the recovery valve is in the first position, exhaust gas flows into the exhaust gas recovery chamber to aid in the movement of the cylinder.

34. The diesel internal combustion engine of claim 32, wherein when the recovery valve is in the second position, exhaust gas flow into the exhaust gas recovery chamber is impeded.

35. The diesel internal combustion engine of claim 28, wherein the cylinder is coupled to a first portion of the crankshaft, wherein during operation, the first portion of the crankshaft is displaced along a linear path to move the cylinder along a predetermined stroke length.

36. The diesel internal combustion engine of claim 35, wherein the first portion of the crankshaft simultaneously rotates as it is displaced along the linear path.

37. The diesel internal combustion engine of claim 28, further comprising;

(a) an additional piston assembly coupled to the housing; and (b) a first chamber disposed in the cylinder for at least partially receiving the piston assembly and a second chamber disposed in the cylinder for at least partially receiving the additional piston assembly, wherein the cylinder is disposed within the housing for reciprocal movement between the piston assemblies.

38. The diesel internal combustion engine of claim 34, wherein when the recovery valve is in the second position, the recovery valve permits exhaust gas flow from the exhaust gas recovery chamber to an external atmosphere.

* * * * *